US007327972B2

(12) United States Patent
Matsuda et al.

(10) Patent No.: US 7,327,972 B2
(45) Date of Patent: Feb. 5, 2008

(54) BELT DRIVING CONTROL APPARATUS, BELT APPARATUS AND IMAGE FORMING APPARATUS

(75) Inventors: Hiromichi Matsuda, Kanagawa (JP); Hiroshi Koide, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 11/141,639

(22) Filed: Jun. 1, 2005

(65) Prior Publication Data

US 2006/0184258 A1 Aug. 17, 2006

(30) Foreign Application Priority Data

Jun. 1, 2004 (JP) ..... 2004-163332
Jul. 15, 2004 (JP) ..... 2004-208333
Feb. 23, 2005 (JP) ..... 2005-046548

(51) Int. Cl.
*G03G 15/00* (2006.01)
*G03G 15/01* (2006.01)
*G03G 15/16* (2006.01)

(52) U.S. Cl. ..... 399/162; 399/167; 399/302; 399/313

(58) Field of Classification Search ..... 399/303, 399/313, 162, 167
See application file for complete search history.

(56) References Cited

U.S. PATENT DOCUMENTS 5,737,216 A 4/1998 Hokari
6,669,189 B2 12/2003 Seto et al.
6,933,696 B2 * 8/2005 Ueda et al. ..... 399/167
7,174,237 B2 * 2/2007 Takayama et al.
2002/0085086 A1 7/2002 Koide
2004/0086299 A1 5/2004 Matsuda et al.
2004/0164691 A1 8/2004 Andoh et al.
2005/0053388 A1 3/2005 Yokoyama et al.
2006/0184258 A1 8/2006 Matsuda et al.

FOREIGN PATENT DOCUMENTS

EP 1 020 774 A2 7/2000
EP 1 031 887 A2 8/2000
EP 1 424 609 A2 6/2004
EP 1 429 207 A2 6/2004
JP 09267946 A * 10/1997
JP 2000-330353 11/2000
JP 2003233234 A * 8/2003
JP 2004-123383 4/2004

OTHER PUBLICATIONS

U.S. Appl. No. 11/558,645, filed Nov. 10, 2006, Takahashi et al.

* cited by examiner

*Primary Examiner*—Susan Lee
(74) *Attorney, Agent, or Firm*—Oblon, Spivak, McClelland, Maier & Neustadt, P.C.

(57) ABSTRACT

A belt driving control apparatus which realizes high-precision belt driving by specifying with high precision the pitch line distance (PLD) that affects the belt movement speed. This belt driving control apparatus controls the driving of the belt by controlling the rotation of driving supporting rotating bodies via which the rotational driving force is transmitted, among the plurality of supporting rotating bodies on which the belt is installed.

70 Claims, 19 Drawing Sheets

BELT DRIVING CONTROL APPARATUS, BELT APPARATUS AND IMAGE FORMING APPARATUS

BACKGROUND OF THE INVENTION

1. Field of the Invention

The present invention relates to a belt driving control apparatus for controlling the driving of a belt installed on a plurality of supporting rotating bodies, a belt apparatus using this belt driving control apparatus, and an image forming apparatus using this belt apparatus.

2. Description of the Related Art

Conventionally, image forming apparatuses using belts such as photosensitive belts, intermediate transfer belts, paper conveyor belts and the like have been seen as such apparatuses using belts. In such image forming apparatuses, high-precision driving control of the belt is essential for obtaining high-quality images. Especially in the case of tandem type image forming apparatuses using a direct transfer system which is superior in terms of image formation speed and which is suitable for achieving a compact size, high-precision driving control of the conveyor belt that conveys the recording paper constituting the recording material is required. In this image forming apparatus, the recording paper is conveyed using a conveyor belt, and is successively caused to pass through a plurality of image forming units forming images of different single colors that are disposed along the conveying direction. As a result, color images can be obtained by superimposing respective monochromatic images on the recording paper.

In such a tandem type image forming apparatus using a direct transfer system, color deviation occurs if the speed at which the recording paper moves, i.e., the movement speed of the conveyor belt, is not maintained at a constant speed. This color deviation occurs as a result of a relative shift in the transfer positions of the respective monochromatic images that are superimposed on the recording paper. When such color deviation occurs, for example, line images formed by the superimposition of images of a plurality of colors appear blurred, and white dropout occurs around the outlines of black character images formed in background images that are formed by the superimposition of images of a plurality of colors.

Furthermore, not only in such tandem type image forming apparatuses, but also in image forming apparatuses using belts as recording material conveying members that convey recording materials, or as image carrying bodies such as intermediate transfer bodies or photosensitive bodies that carry images that are transferred onto the recording material, banding occurs if the speed of movement of the belt is not maintained at a constant speed. This banding is an irregularity in image density that occurs as a result of the belt movement speed being accelerated or slowed during image transfer. Specifically, portions of images that are transferred when the belt movement speed is relatively rapid assume a shape that is stretched out in the circumferential direction of the belt from the original image shape; conversely, portions of images that are transferred when the belt movement speed is relatively slow assume a shape that is contracted in the circumferential direction of the belt from the original image shape. Consequently, the image portions that are stretched out show a decrease in density, while the image portions that are contracted show an increase in density. As a result, an irregularity in image density is generated in the circumferential direction of the belt, so that banding occurs. This banding is conspicuously sensed by the human eye in cases where light monochromatic images are formed.

The movement speed of the belt fluctuates for various reasons; among the causes of such fluctuation is irregularity in the belt thickness in the circumferential direction of the belt in the case of single-layer belts. For example, this irregularity in the thickness of the belt occurs as a result of a bias in the thickness of the belt along the circumferential direction of the belt seen in belts that are manufactured by a centrifugal firing system using a cylindrical mold. If such irregularity in the belt thickness is present in a belt, the belt movement speed is accelerated when portions of the belt with a large thickness are wound on the driving rollers that drive the belt; conversely, the belt movement speed is slowed when portions of the belt that have a small thickness are wound on these rollers. Accordingly, a fluctuation occurs in the belt movement speed.

The belt movement speed is determined by the distance from the surfaces of the rollers to the belt pitch line, i.e., the pitch line distance (hereafter referred to as the "PLD"). In cases where the belt is a single-layer belt made of a uniform belt-material, and the absolute values of expansion and contraction on the side of the inner circumferential surface of the belt and the side of the outer circumferential surface of the belt substantially coincide, this PLD corresponds to the distance between the center of the belt in the direction of belt thickness and the inner circumferential surface of the belt, i.e., the surfaces of the rollers. Accordingly, in the case of a single-layer belt, since the relationship between the PLD and the belt thickness is substantially fixed, the belt movement speed can also be determined by fluctuations in the belt thickness. However, in the case of belts comprising a plurality of layers or the like, as a result of mutual differences in expansion and contraction between hard layers and soft layers, the distance between the roller surfaces and a position that is shifted from the center of the belt in the direction of thickness is the PLD.

When this PLD fluctuates in the circumferential direction of the belt, the belt movement speed or belt movement distance with respect to the rotational angular speed or rotational angular displacement of the driving rollers, or the rotational angular speed or rotational angular displacement of the driven rollers with respect to the belt movement speed or belt movement distance, fluctuates. Accordingly, the belt cannot be driven at the desired movement speed.

The image forming apparatuses described in Japanese Patent Application Laid-Open No. 2000-310897, Japanese Patent No. 3,186,610 and the like may be cited as examples of apparatus which make it possible to perform driving control of the belt with such fluctuations in the PLD taken into account.

In this Japanese Patent Application Laid-Open No. 2000-310897, an image forming apparatus is disclosed in which the thickness profile (belt thickness irregularity) over the entire circumference of the belt is measured beforehand in the manufacturing process before the belt (formed by the centrifugal forming method in which fluctuation in the PLD tends to occur in the form of a sine wave over the circumference of the belt) is installed in the apparatus main body, and this data is stored in a flash ROM. In this image forming apparatus, a reference mark constituting a home position which is a reference position that is used to align the phase of the thickness profile data for the entire circumference and the actual irregularity in the belt thickness is formed, and belt driving control is performed by detecting this position as a reference so that fluctuation in the belt movement speed caused by fluctuation in the belt thickness is canceled.

However, in this image forming apparatus, since the irregularity in the belt thickness is used without using the fluctuation in the PLD, accurate belt driving control is possible in the case of a single-layer belt; however, accurate belt driving control is not possible in the case of a multi-layer belt.

Furthermore, in the abovementioned Japanese Patent No. 3186610, an image forming apparatus is disclosed in which periodic fluctuations in the belt movement speed are detected by forming a detection pattern on the belt, and detecting this pattern with a detection sensor. In this image forming apparatus, the rotational speed of the driving rollers is controlled so that the detected periodic fluctuations in the belt movement speed are canceled.

However, in the image forming apparatus described in the abovementioned Japanese Patent Application Laid-Open No. 2000-310897, a measurement process that measures the irregularity in the belt thickness is required in the belt manufacturing stage; furthermore, a high-precision belt thickness measuring instrument must be used in this measurement process. Accordingly, the problem of a greatly increased manufacturing cost arises. Furthermore, the following problem also arises: namely, when the belt is replaced with a new belt, the work of inputting thickness profile data peculiar to this new belt into the apparatus is required.

Furthermore, in the image forming apparatus described in the abovementioned Japanese Patent No. 3,186,610, it is necessary to form a detection pattern for the detection of at least one circuit of the belt in order to detect the fluctuation in the belt movement speed. As a result, the following problem arises: namely, it is necessary to consume a large amount of toner in order to form this detection pattern. In particular, in cases where the mean value of belt movement speed fluctuation information for a plurality of circuits of the belt is grasped as the fluctuation in the belt movement speed in order to detect such fluctuations in the belt movement speed with a higher degree of precision, it is necessary to form a detection pattern for a plurality of circuits of the belt, so that the problem of toner consumption becomes more serious.

Furthermore, a belt driving control apparatus that can solve these problems has been proposed in Japanese Patent Application No. 2002-230537. In this belt driving control apparatus, the rotational angular displacement or rotational angular speed of driven supporting rotating bodies is detected, and an alternating current component of the rotational angular speed of the driven supporting rotating bodies which has a frequency corresponding to the periodic thickness fluctuation in the circumferential direction of the belt is extracted from this detection data. The amplitude and phase of this extracted alternating current component correspond to the amplitude and phase of the periodic thickness fluctuation in the circumferential direction of the belt. Accordingly, on the basis of the amplitude and phase of this alternating current component, control is performed so that the rotational angular speed of the driving supporting rotating bodies is lowered at a timing at which thick portions of the belt contact the driving supporting rotating bodies, and conversely, so that the rotational angular speed of the driving supporting rotating bodies is increased at a timing at which thin portions of the belt contact the driving supporting rotating bodies. If this method is used, the belt can be driven at a desired movement speed without being affected by thickness fluctuations in the circumferential direction of the belt. Furthermore, since there is no need for a measurement process that measures the irregularity in the thickness of the belt in the belt manufacturing stage, there is no increase in the manufacturing cost as there is in the apparatus of the abovementioned Japanese Patent Application Laid-Open No. 2000-310897. Furthermore, there is likewise no need for an operation that inputs thickness profile data into the apparatus whenever the belt is replaced with a new belt, as there is in the apparatus of the abovementioned Japanese Patent No. 3,186,610. In addition, since there is no need to form a detection pattern, there is likewise no consumption of toner for the purpose of belt driving control.

However, in the case of the belt driving control apparatus proposed in the abovementioned Japanese Patent Application No. 2002-230537, since the belt thickness fluctuation approaches the periodic function of a sin function (cos function), the following inconvenience arises: namely, it is necessary to predict how the belt thickness fluctuation will occur over one circuit of the belt. Specifically, the following problem arises: namely, it is necessary to predict whether the frequency component contained in the belt thickness fluctuation is only the fundamental frequency component with the same period as the period required for the belt to complete one revolution, or whether higher harmonic frequency components are also contained in this frequency component. In most cases, furthermore, the joint portions or the like of seamed belts that have a joint seam are thicker than other portions of the belt, so that a belt thickness fluctuation may be generated in the partially protruding portions. Accordingly, the following problem is encountered: namely, it is difficult to approximate such belt thickness fluctuations with a periodic function, so that a manufacturing error is contained in such portions.

SUMMARY OF THE INVENTION

It is an object of the present invention to provide a belt driving control apparatus which can solve the problems described above, a belt apparatus using this belt driving control apparatus, and an image forming apparatus using this belt apparatus.

A belt driving control apparatus in accordance with the present invention performs driving control of a belt which is installed on a plurality of supporting rotating bodies including driven rotating supporting bodies which rotate in connection with the movement of the belt, and driving supporting rotating bodies that transmit a driving force to the belt. A control device is provided for performing the driving control on the basis of rotation information relating to the rotational angular displacement or rotational angular speed in two supporting rotating bodies among the plurality of supporting rotating bodies which have different diameters, or in which the degree to which the pitch line distance of the portion of the belt that is wound on each of these supporting rotating bodies affects the relationship between the movement speed of the belt and the rotational angular speed of each of these supporting rotating bodies is different, so that the fluctuation of the movement speed of the belt that is generated by the fluctuation in the pitch line distance in the circumferential direction of the belt is reduced.

A belt driving control apparatus in accordance with the present invention performs driving control of a belt which is installed on a plurality of supporting rotating bodies including driven rotating supporting bodies which rotate in connection with the movement of the belt, and driving supporting rotating bodies that transmit a driving force to the belt. A control device is provided for performing the driving control on the basis of rotation information relating to the rotational angular displacement or rotational angular speed in two supporting rotating bodies among said plurality of supporting rotating bodies which have different diameters, or in which the degree to which the thickness of the portion of the belt that is wound on each of these supporting rotating bodies affects the relationship between the movement speed of the belt and the rotational angular speed of each of these supporting rotating bodies is different, so that the fluctuation of the movement speed of the belt that is generated by the fluctuation in the belt thickness in the circumferential direction of the belt is reduced.

A belt apparatus in accordance with the present invention comprises a belt which is installed on a plurality of supporting rotating bodies including driven rotating supporting bodies which rotate in connection with the movement of the belt, and driving supporting rotating bodies that transmit a driving force to the belt; a driving source which generates a rotational driving force for driving the belt; a belt driving control device for performing driving control of the belt; and a detection device for detecting at least one of the rotational angular displacement and rotational angular speed in two supporting rotating bodies among the plurality of supporting rotating bodies which have different diameters, or in which the degree to which the thickness or pitch line distance of the portion of the belt that is wound on each of these supporting rotating bodies affects the relationship between the movement speed of the belt and the rotational angular speed of each of these supporting rotating bodies is different. The belt driving control device comprises a controller for performing the driving control on the basis of rotation information relating to the rotational angular displacement or rotational angular speed detected by the detection device so that the fluctuation in the movement speed of the belt that is generated by the fluctuation in the pitch line distance or the belt thickness in the circumferential direction of the belt is reduced.

An image forming apparatus in accordance with the present invention comprises a latent image carrying body comprising a belt that is installed on a plurality of supporting rotating bodies; a latent image forming device for forming a latent image on the latent image carrying body; a developing device for developing the latent image on the latent image carrying body; a transfer device for transferring a sensible image on the latent image carrying body onto a recording material; and a belt apparatus that drives the latent image carrying body. The belt apparatus comprises a belt which is installed on a plurality of supporting rotating bodies including driven rotating supporting bodies which rotate in connection with the movement of the belt, and driving supporting rotating bodies that transmit a driving force to the belt, a driving source which generates a rotational driving force for driving the belt, a belt driving control device for performing driving control of said belt; and a detection device for detecting at least one of the rotational angular displacement and rotational angular speed in two supporting rotating bodies among the plurality of supporting rotating bodies which have different diameters, or in which the degree to which the thickness or pitch line distance of the portion of the belt that is wound on each of these supporting rotating bodies affects the relationship between the movement speed of the belt and the rotational angular speed of each of these supporting rotating bodies is different. The belt driving control device comprises a controller for performing the driving control on the basis of rotation information relating to the rotational angular displacement or rotational angular speed detected by the detection means so that the fluctuation in the movement speed of the belt that is generated by the fluctuation in the pitch line distance or the belt thickness in the circumferential direction of the belt is reduced.

An image forming apparatus in accordance with the present invention comprises a latent image carrying body; a latent image forming device for forming a latent image on the latent image carrying body; a developing device for developing the latent image on the latent image carrying body; an intermediate transfer body comprising a belt which is installed on a plurality of supporting rotating bodies; a first transfer device for transferring a sensible image on the latent image carrying body onto the intermediate transfer body; a second transfer device for transferring the sensible image on the intermediate transfer body onto a recording material; and a belt apparatus that drives the intermediate transfer body. The belt apparatus comprises a belt which is installed on a plurality of supporting rotating bodies including driven rotating supporting bodies which rotate in connection with the movement of the belt, and driving supporting rotating bodies that transmit a driving force to the belt, a driving source which generates a rotational driving force for driving the belt, a belt driving control device for performing driving control of the belt; and a detection device for detecting at least one of the rotational angular displacement and rotational angular speed in two supporting rotating bodies among the plurality of supporting rotating bodies which have different diameters, or in which the degree to which the thickness or pitch line distance of the portion of the belt that is wound on each of these supporting rotating bodies affects the relationship between the movement speed of the belt and the rotational angular speed of each of these supporting rotating bodies is different. The belt driving control device comprises a controller for performing the driving control on the basis of rotation information relating to the rotational angular displacement or rotational angular speed detected by the detection device so that the fluctuation in the movement speed of the belt that is generated by the fluctuation in the pitch line distance or the belt thickness in the circumferential direction of the belt is reduced.

An image forming apparatus in accordance with the present invention comprises a latent image carrying body; a latent image forming device for forming a latent image on the latent image carrying body; a developing device for developing the latent image on the latent image carrying body; a recording material conveying member comprising a belt which is installed on a plurality of supporting rotating bodies; a transfer device for transferring a sensible image on the latent image carrying body onto a recording material conveyed by the recording material conveying member, either via an intermediate transfer body or directly without an intermediate transfer body; and a belt apparatus that drives the recording material conveying member. The belt apparatus comprises a belt which is installed on a plurality of supporting rotating bodies including driven rotating supporting bodies which rotate in connection with the movement of the belt, and driving supporting rotating bodies that transmit a driving force to the belt, a driving source which generates a rotational driving force for driving the belt, a belt driving control device for performing driving control of the belt; and a detection device for detecting at least one of the rotational angular displacement and rotational angular speed in two supporting rotating bodies among the plurality of supporting rotating bodies which have different diameters, or in which the degree to which the thickness or pitch line distance of the portion of the belt that is wound on each of these supporting rotating bodies affects the relationship between the movement speed of the belt and the rotational angular speed of each of these supporting rotating bodies is different. The belt driving control device comprises a controller for performing the driving control on the basis of rotation information relating to the rotational angular displacement or rotational angular speed detected by the detection means so that the fluctuation in the movement speed of the belt that is generated by the fluctuation in the pitch line distance or the belt thickness in the circumferential direction of the said belt is reduced.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before the present invention is described, the prior art and problems that are to be solved in this prior art will be described.

First, one example of a tandem type image forming apparatus with a direct transfer system based on a conventional electrophotographic system utilizing a belt apparatus will be described with reference to FIG. 1.

In this image forming apparatus, for example, image forming units 18Y, 18M, 18C and 18K that form respective monochromatic images of yellow, magenta, cyan and black are successively disposed in the conveying direction of a recording paper. Furthermore, toner images (sensible images) are formed as a result of electrostatic latent images formed on the surfaces of respective photosensitive drums 40Y, 40M, 40C and 40K by a laser exposure unit not shown in the figures being developed by the respective image forming units 18Y, 18M, 18C and 18K. Then, following successive superimposition and transfer onto a recording paper (not shown in the figures) that is conveyed by adhesion to a conveyor belt 210 (by electrostatic force), the toner is melted and fixed by pressing by means of a fixing apparatus 25, so that color images are formed on the recording paper. The conveyor belt 210 is mounted with an appropriate tension on a driving roller 215 and driven roller 214 that are disposed parallel to each other. The driving roller 215 is rotationally driven at a specified rotational speed by a driving motor not shown in the figures. With this rotation, the conveyor belt 210 also moves in an endless manner. The recording paper is supplied to the image forming units 18Y, 18M, 18C and 18K on the conveyor belt 210 at a specified timing by a paper supply mechanism, and is conveyed while moving at the same speed as the movement speed of the conveyor belt 210, so that this recording paper successively passes through the respective image forming units.

In such an image forming apparatus, as was described above, color deviation occurs if the movement speed of the recording paper, i.e., the movement speed of the conveyor belt 210, is not maintained at a constant speed. This color deviation occurs as a result of a relative shift in the transfer positions of the respective monochromatic images that are superimposed on the recording paper. When this color deviation occurs, for example, line images formed by the superimposition of images of a plurality of colors appear blurred, and white dropout occurs around the outlines of black character images formed in background images that are formed by the superimposition of images of a plurality of colors.

Figure 2:
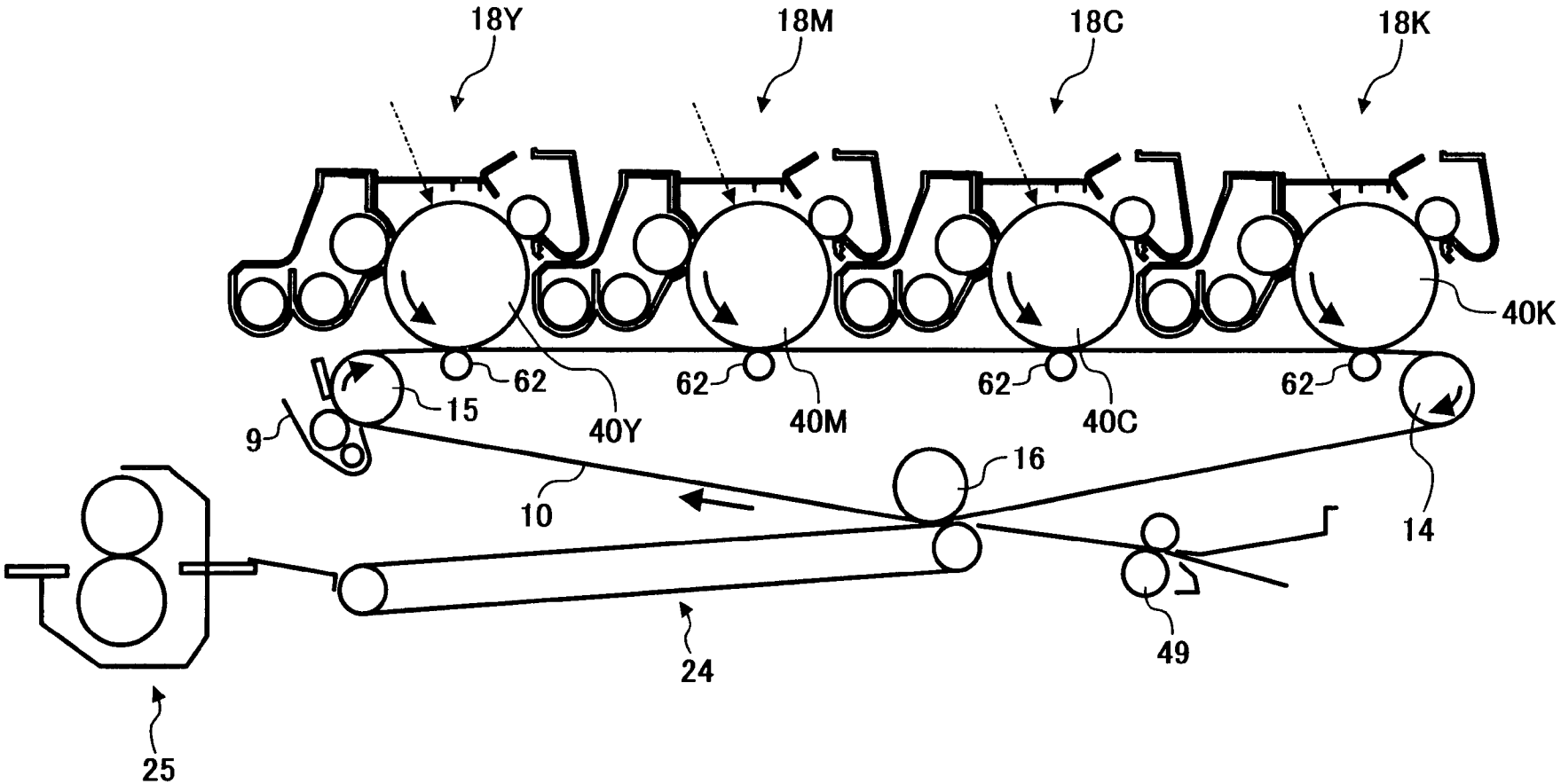
FIG. 2 PRIOR ART
FIG. 2 is a schematic structural diagram showing one example of a tandem type image forming apparatus with an intermediate transfer system.

Furthermore, as is shown in FIG. 2, there are also tandem type image forming apparatuses employing an intermediate transfer system in which respective monochromatic images formed on the surfaces of the photosensitive drums 40Y, 40M, 40C and 40K of the respective image forming units 18Y, 18M, 18C and 18K are transferred so that these images are successively superimposed on an intermediate transfer belt 10, after which these images are all transferred at one time onto the recording paper. In such apparatuses as well, color deviation similarly occurs if the movement speed of the intermediate transfer belt 10 is not maintained at a constant speed.

Next, fluctuations in the belt movement speed will be described in a concrete manner.

Figure 3:
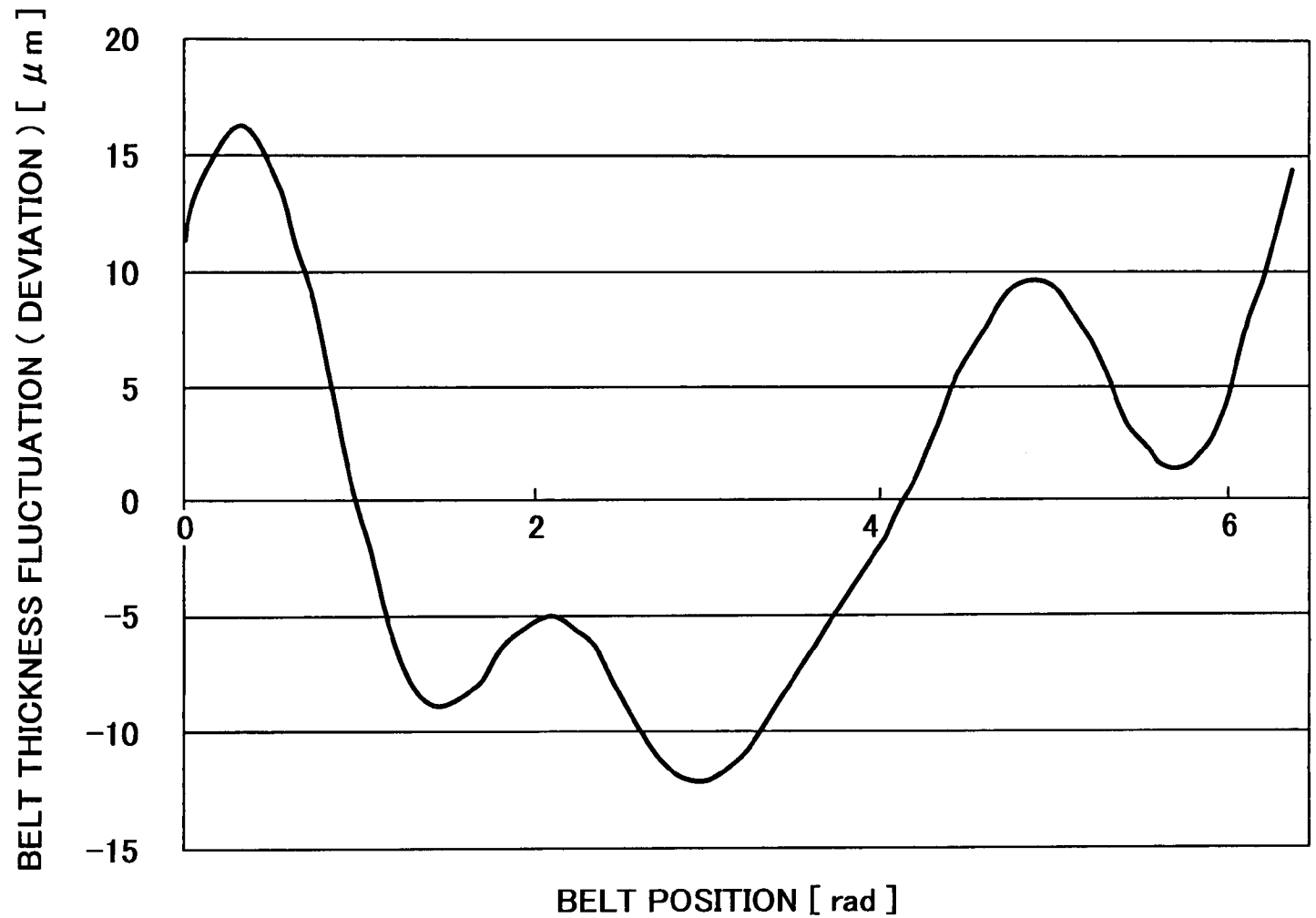
FIG. 3 is a graph showing one example of the irregularity in the belt thickness (distribution of the deviation in the belt thickness) in the circumferential direction of the intermediate transfer belt of a tandem type image forming apparatus with an intermediate transfer system.

FIG. 3 is a graph showing one example of the belt thickness irregularity (distribution of the belt thickness deviation) in the circumferential direction of the intermediate transfer belt 10 used in the image forming apparatus shown in FIG. 2. The horizontal axis of this graph shows the length of one circuit of the belt (circumferential length of the belt) replaced by an angle of 2π [rad]. The vertical axis shows the deviation value of the belt thickness with the mean thickness of the belt (100 μm) in the circumferential direction of the belt taken as a reference (reference value 0). The deviation distribution for one circuit in the circumferential direction of the belt in a belt having such belt thickness irregularity (which is the object of the present invention) will hereafter be referred to as the belt thickness fluctuation. Here, the terms "belt thickness irregularity" and "belt thickness fluctuation" used in the present specification will be explained. First, the term "belt thickness irregularity" refers to the thickness deviation distribution of the belt measured by a film thickness measuring instrument or the like; this belt thickness irregularity exists in the circumferential direction of the belt (direction of the conveying path) and in the direction of depth (axial direction of the driving roller). On the other hand, the term "belt thickness fluctuation" indicates the belt thickness deviation distribution caused by the occurrence of fluctuations in the rotational period of the belt affecting the belt conveying speed with respect to the rotational angular speed of the driving roller or the rotational angular speed of the driven roller with respect to the belt conveying speed in a state in which the belt is mounted on the belt driving control apparatus.

Figure 4:
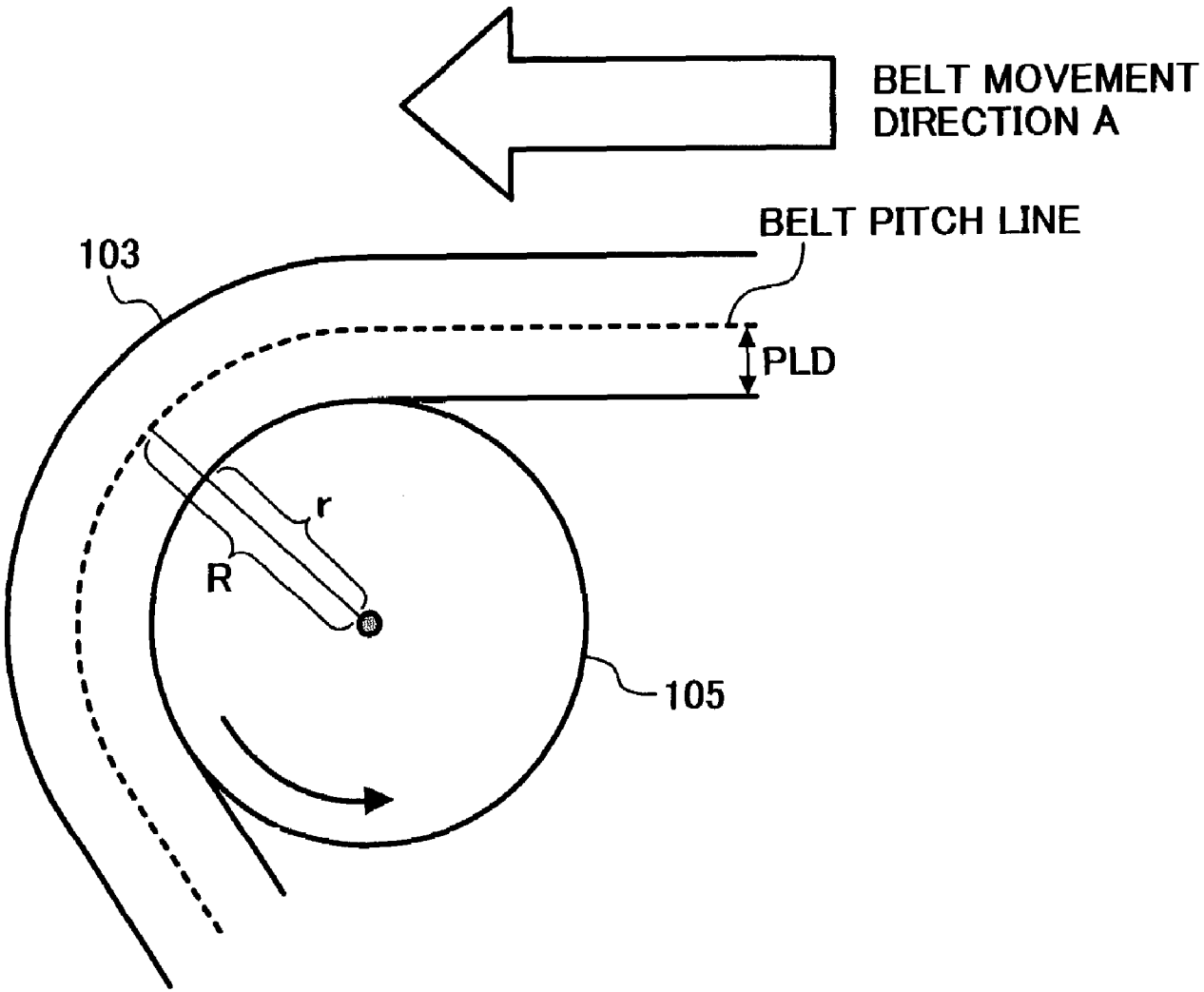
FIG. 4 is an enlarged view of the portion of the belt that is wound on the driving rollers as seen from the axial direction of the driving rollers.
Figure 5:
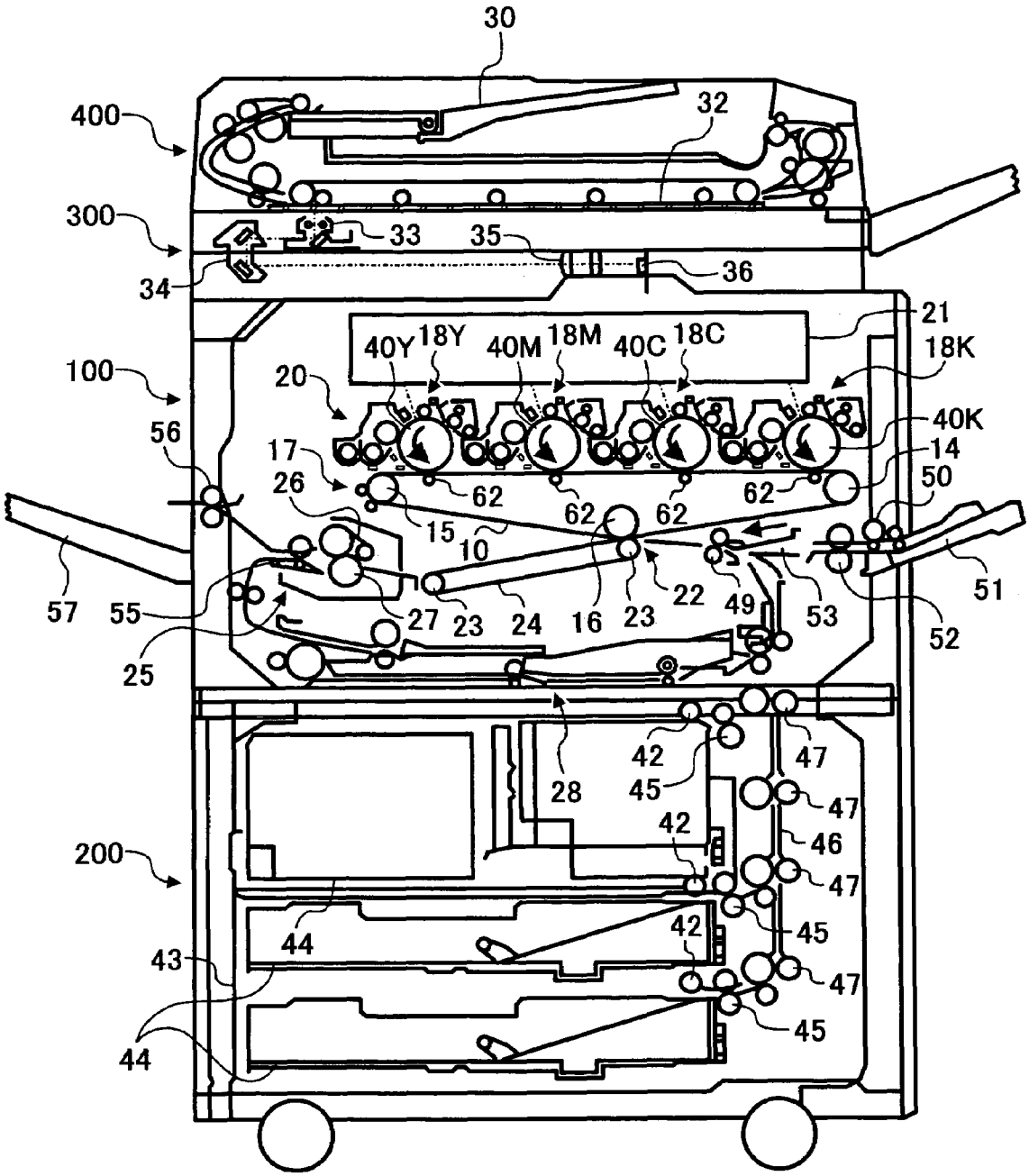
FIG. 5 is a schematic structural diagram showing an overall view of the copying machine in one embodiment of the present invention.

FIG. 4 is an enlarged view of the portion of the belt that is wound on the driving roller as seen from the axial direction of the driving roller. As was described above, the movement speed of the belt 103 is determined by the distance from the roller surfaces to the belt pitch line, i.e., the pitch line distance PLD; however, this speed may also vary according to the belt winding angle with respect to the driving roller 105.

$$PLD=PLD_{ave}+f(d) \quad \text{Eq. (1)}$$

"$PLD_{ave}$" in the equation shown in the above mentioned Equation (1) is the average value of the PLD over one circuit of the belt; for example, in the case of a single-layer belt with an average thickness of 100 [μm], $PLD_{ave}$ is 50 [μm]. Furthermore, "f(d)" is a function indicating the fluctuation in the PLD over one circuit of the belt. Here, "d" indicates the position from a ground point constituting a reference on the belt circumference (the phase where one circuit of the belt is taken as 2n). f(d) has a high correlation with the belt thickness deviation value shown in FIG. 3, and is a periodic function which takes one circuit of the belt as its period. When the PLD fluctuates in the circumferential direction of the belt, the belt movement speed or belt movement distance with respect to the rotational angular speed or rotational angular displacement of the driving roller, or the rotational angular speed or rotational angular displacement of the driven roller with respect to the belt movement speed or belt movement distance, fluctuates.

The relationship between the belt movement speed V and the rotational angular speed ω of the driving roller 105 is expressed by the following Equation (2). "r" in this equation is the radius of the driving roller 105. Furthermore, there may be cases in which the degree to which the function f(d) that indicates the fluctuation in the PLD affects the relationship between the belt movement speed or belt movement distance and the rotational angular speed or rotational angular speed of the rollers varies according to the contact state or amount of winding of the belt with respect to the rollers. The degree of this effect is expressed by the effective coefficient of PLD fluctuation κ.

$$V=\{r+PLD_{ave}+\kappa f(d)\}\omega \quad \text{Eq. (2)}$$

Below, in the present specification, the portion inside the brackets in the equation shown in the abovementioned Equation (2) will be called the effective roller radius, and the constant portion ($r+PLD_{ave}$) will be designated as the effective roller radius R. Furthermore, f(d) will be referred to as the PLD fluctuation.

It is seen from the abovementioned Equation (2) that the relationship between the belt movement speed V and the rotational angular speed ω of the driving roller 105 varies as a result of the existence of the PLD fluctuation f(d). Specifically, even if the driving roller 105 rotates at a constant rotational angular speed (ω=a constant value), the movement speed V of the belt 103 varies according to the PLD fluctuation f(d). Here, for example, in the case of a single-layer belt, when portions of the belt that are thicker than the mean thickness of the belt are wound on the driving roller 105, the PLD fluctuation f(d) which has a high correlation with the thickness deviation of the belt 103 assumes a positive value, so that the effective roller radius increases. Accordingly, even if the driving roller 105 rotates at a constant rotational angular speed (ω=a constant value), the belt movement speed V increases. Conversely, when portions of the belt that are thinner than the mean thickness of the belt are wound on the driving roller 105, the belt thickness fluctuation f(d) assumes a negative value, so that the effective roller radius decreases. Accordingly, even if the driving roller 105 rotates at a constant rotational angular speed (ω=a constant value), the belt movement speed V decreases.

Thus, even if the rotational angular speed ω of the driving roller 105 is constant, the movement speed of the belt 103 is not constant, because of the PLD fluctuation f(d). Accordingly, even if an attempt is made to control the driving of the belt 103 from the rotational angular speed ω of the driving roller 105 alone, the belt 103 cannot be driven at a desired movement speed.

Furthermore, the relationship between the belt movement speed V and the rotational angular speed of the driven roller is also similar to the abovementioned relationship between the belt movement speed V above-described the rotational angular speed ω of the driving roller 105. Specifically, the equation shown in the abovementioned Equation (2) can also be used in cases where the rotational angular speed of the driven roller is detected by means of a rotary type encoder or the like, and the belt movement speed V is determined from this detected rotational angular speed. Accordingly, for example, in the case of a single-layer belt, as in the case of the abovementioned driving roller 105, the PLD fluctuation f(d) which has a high correlation with the thickness deviation of the belt 103 assumes a positive value when portions of the belt that are thicker than the mean thickness of the belt are wound [around the driven roller], so that the effective roller radius increases. Accordingly, even if the belt 103 moves at a constant movement speed (V=a constant value), the rotational angular speed of the driven roller decreases. Conversely, when portions of the belt that are thinner than the mean thickness of the belt are wound around the driven roller, f(d) assumes a negative value, so that the effective roller radius decreases. Accordingly, even if the belt 103 moves at a constant speed, the rotational angular speed of the driven roller increases.

Thus, even if the movement speed of the belt 103 is constant, the rotational angular speed of the driven roller is not constant, because of the PLD fluctuation f(d). Accordingly, even if an attempt is made to control the driving of the belt 103 from the rotational angular speed of the driven roller alone, the belt 103 cannot be driven at a desired movement speed.

As was already described above, conventional techniques which make it possible to perform belt driving control with such PLD fluctuation f(d) taken into account have been proposed in the abovementioned Japanese Patent Application Laid-Open No. 2000-310897, Japanese Patent No. 3186610 and Japanese Patent Application No. 2002-230537, and the problems involved in these techniques have already been discussed.

An embodiment of the present invention which solve the abovementioned problems encountered in the prior art will be described in detail below with reference to the attached figures.

Figure 1:
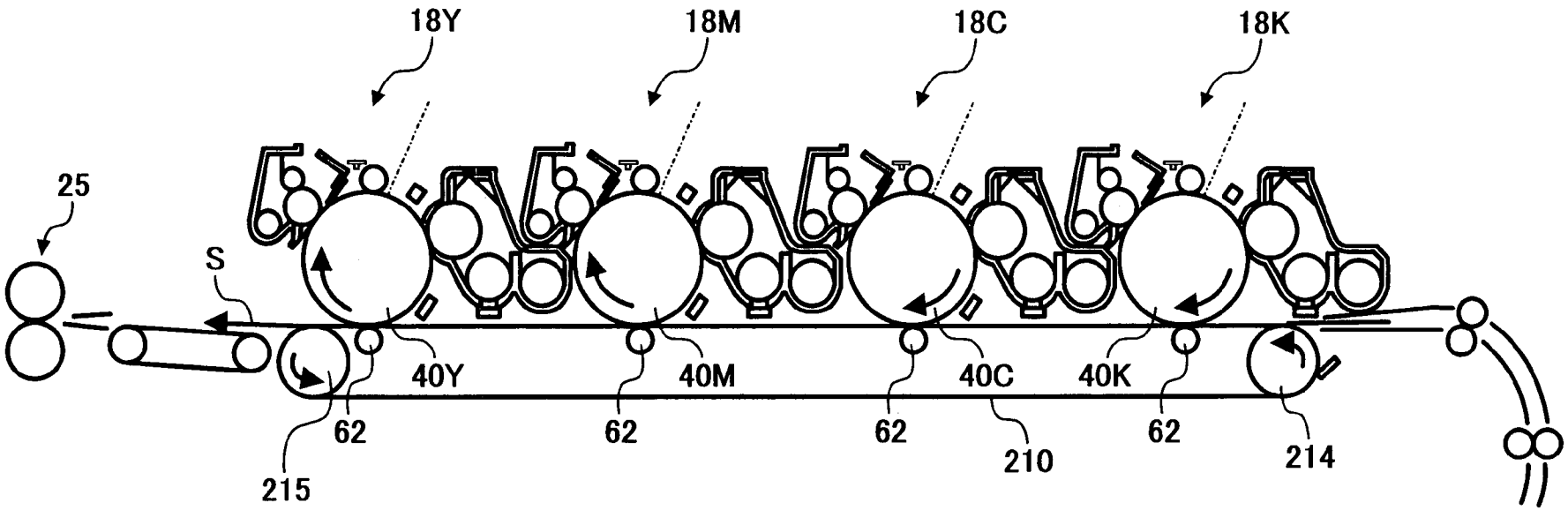
FIG. 1 PRIOR ART
FIG. 1 is a schematic structural diagram showing one example of a tandem type image forming apparatus with a direct transfer system.

FIG. 1 is a schematic structural diagram showing one example of a copying machine as an image forming apparatus using the present invention. In FIG. 1, the symbol 100 indicates the copying machine main body, the symbol 200 indicates a paper supply table carrying this copying machine main body, the symbol 300 indicates a scanner attached to the copying machine main body 100, and the symbol 400 indicates an automatic document feeder (ADF) that is attached to this scanner. This copying machine is a tandem type electrophotographic copying machine using an intermediate transfer (indirect transfer) system.

An intermediate transfer belt 10 comprising a belt which constitutes an intermediate transfer body used as an image carrying body is disposed in the center of the copying machine main body 100. This intermediate transfer belt 10 is mounted on three supporting rollers 14, 15 and 16 constituting supporting rotating bodies, and performs a rotational movement in the clockwise direction in the figures. Among these three supporting rollers, an intermediate transfer belt cleaning apparatus 17 which removes any residual toner that may remain on the intermediate transfer belt 10 following image transfer is disposed on the left side of he second supporting roller 15 in the figures. Furthermore, a tandem image forming part 20 in which four image forming parts 18, i.e., yellow (Y), magenta (M), cyan (C) and black (K) are lined up along the belt movement direction is disposed facing the portion of the belt that is mounted between the first supporting roller 14 and second supporting roller 15 (among the three supporting rollers). In the present example, the third supporting roller 16 is used as a driving roller. Furthermore, an exposure apparatus 21 used as latent image forming means is disposed above the tandem image forming part 20.

Furthermore, on the opposite side of the intermediate transfer belt 10 from the tandem image forming part 20, a secondary transfer apparatus 22 is disposed as second transfer means. In this secondary transfer apparatus 22, a secondary transfer belt 24 which is a belt used as a recording material conveying member is mounted between two rollers 23. This secondary transfer belt 24 is disposed so that this belt is pressed against the third supporting roller 16 via the intermediate transfer belt 10. Images on the intermediate transfer belt 10 are transferred onto a sheet constituting a recording material by this secondary transfer apparatus 22. Furthermore, a fixing apparatus 25 which fixes the images transferred onto this sheet is disposed on the left of this secondary transfer apparatus 22 in the figures. This fixing apparatus 25 has a construction in which pressing rollers 27 are pressed against a fixing belt 26 comprising a belt. The abovementioned secondary transfer apparatus 22 also has a sheet conveying function that conveys the sheets following transfer to this fixing apparatus 25. Of course, it would also be possible to install transfer rollers or a non-contact charger as the secondary transfer apparatus 22, and in such a case, it becomes difficult to endow this apparatus with such a combined sheet conveying function. Furthermore, in the present example, a sheet inverting apparatus 28 which inverts sheets in which images are to be formed on both sides of the sheet is also disposed parallel to the abovementioned tandem image forming part 20 beneath this secondary transfer apparatus 22 and fixing apparatus 25.

When copies are to be made using the abovementioned copying machine, the original document is set on the original document tray 30 of the automatic document feeder 400. Or, the automatic document feeder 400 is opened, the original document is set on the contact glass 32 of the scanner 300, and the automatic document feeder 400 is closed so that the original document is restrained by this feeder. Subsequently, when the starting switch (not shown in the figures) is pressed, the original document is conveyed so that this document moves onto the contact glass 32 in cases where the original document was set in the automatic document feeder 400. Otherwise, in cases where the original document was set on the contact glass 32, the scanner 300 is immediately driven. Next, a first running body 33 and second running body 34 are caused to run. Furthermore, light is emitted from a light source in the first running body 33, and the reflected light from the surface of the original document is further reflected and directed toward the second running body 34; this light is reflected by a mirror on the second running body 34 so that this light passes through an image focusing lens 35 and enters a reading sensor 36, where the content of the original document is read.

In parallel with this reading of the original document, the driving roller 16 is rotationally driven by a driving motor which is a driving source not shown in the figures. As a result, the intermediate transfer belt 10 moves in the clockwise direction in the figures, and along with this movement, the remaining two supporting rollers (driven rollers) 14 and 15 perform a rotation in connection with this rotation. Furthermore, at the same time, the photosensitive drums 40Y, 40M, 40C and 40K used as latent image carrying bodies in the individual image forming parts 18 are caused to rotate, so that respective exposure and development processes are performed using color information for yellow, magenta, cyan and black on the respective photosensitive drums, thus forming monochromatic toner images (sensible images). Then, the toner images on the respective photosensitive drums 40Y, 40M, 40C and 40K are successively transferred onto the intermediate transfer belt 10 so that these images are superimposed, thus forming a synthesized color image on the intermediate transfer belt 10.

In parallel with this image formation, one of the paper supply rollers 42 of the paper supply table 200 is selectively rotated so that sheets are fed out from one of the paper supply cassettes 44 disposed in multiple stages in the paper bank 43. This paper is separated one sheet at a time by the separating roller 45 and introduced into the paper supply path 46; the paper is then conveyed by the conveying roller 47 and introduced into the paper supply path inside the copying machine main body 100, where the paper contacts a resist roller 49 and stops. Alternatively, the paper supply roller 50 is rotated so that sheets on the manual tray 51 are fed out, separated one at a time by the separating roller 52, and introduced into the manual paper supply path 53, where the paper similarly contacts the resist roller 49 and stops. Then, the resist roller 49 is rotated with the timing matched to the synthesized color images on the intermediate transfer belt 10, so that sheets are fed into the space between the intermediate transfer belt 10 and secondary transfer apparatus 22, and transfer is performed by the secondary transfer apparatus 22 so that the color images are transferred onto the sheets. The sheets following this image transfer are conveyed by the secondary transfer belt 24 and fed into the fixing apparatus 25, where the transfer images are fixed by the application of heat and pressure by the fixing apparatus 25. Subsequently, switching is performed by a switching pawl 55, and the sheets are discharged by a discharge roller 56, and stacked on a paper discharge tray 57. Alternatively, the sheets are switched by the switching pawl 55 so that these sheets are introduced into a sheet inverting apparatus 28, where the sheets are inverted and again conducted to the transfer position, so that images are recorded on the back surfaces as well, after which the sheets are discharged onto the paper discharge tray 57 by the discharge roller 56.

Furthermore, the intermediate transfer belt 10 following image transfer is again provided for image formation by the tandem image forming part 20 after the residual toner remaining on the intermediate transfer belt 10 following transfer is removed by the intermediate transfer belt cleaning apparatus 17. Here, the resist roller 49 is generally used while being grounded; however, it would also be possible to apply a bias in order to remove paper powder from the sheets.

Black monochromatic images can also be made using this copying machine. In this case, the intermediate transfer belt 10 is separated from the photosensitive drums 40Y, 40M and 40C by means not shown in the figures. The driving of these photosensitive drums 40Y, 40M and 40C is temporarily stopped. Only the black photosensitive drum 40K is caused to contact the intermediate transfer belt 10, and image formation and transfer are performed.

Next, the construction of the intermediate transfer belt 10 in this example will be described. Furthermore, the following description is not limited to this intermediate transfer belt, but is broadly applicable to belts for which driving control is performed.

Single-layer belts comprising mainly a fluororesin, polycarbonate resin, polyimide resin or the like, or multi-layer elastic belts in which all of the layer of the belt or portions of the belt are made of an elastic material, are used as intermediate transfer belts. A plurality of functions are required not only in intermediate transfer belts, but also in belts used in image forming apparatuses in general. In recent years, multi-layer belts which have a plurality of layers in the belt thickness direction have been widely used in order to simultaneously achieve a plurality of required functions. For example, in the case of the intermediate transfer belt 10, a plurality of functions such as ability to strip the toner, photosensitive body nipping characteristics, durability, tension, high friction with respect to the driving roller, low friction with respect to the photosensitive bodies and the like are required.

The ability to strip away the toner is a function that is required in order to improve the transfer characteristics from the intermediate-transfer belt 10 to the recording paper, and in order to improve the cleaning characteristics with respect to the toner remaining on this intermediate transfer belt following transfer. Photosensitive body nipping characteristics are a function that is required in order to improve adhesion to the respective photosensitive drums 40Y, 40M, 40C and 40K and transfer to the intermediate transfer belt 10. Tension is a function that is required in order to prevent expansion and contraction in the circumferential direction of the belt during driving of the belt so that high-precision control of the belt movement speed and belt movement position is possible. High friction with respect to the driving roller is a function that is required in order to realize stable and high-precision driving by preventing slipping between the driving roller 16 and the intermediate transfer belt 10. Low friction with respect to the photosensitive bodies is a function which is required so that even if a speed difference is generated between the photosensitive drums 40Y, 40M, 40C and 40K and the intermediate transfer belt 10, slipping is caused to occur between these parts so that load fluctuations can be suppressed.

For example, an intermediate transfer belt comprising a multi-layer belt of the type described below is used in order to realize these functions simultaneously at a high level.

Figure 6:
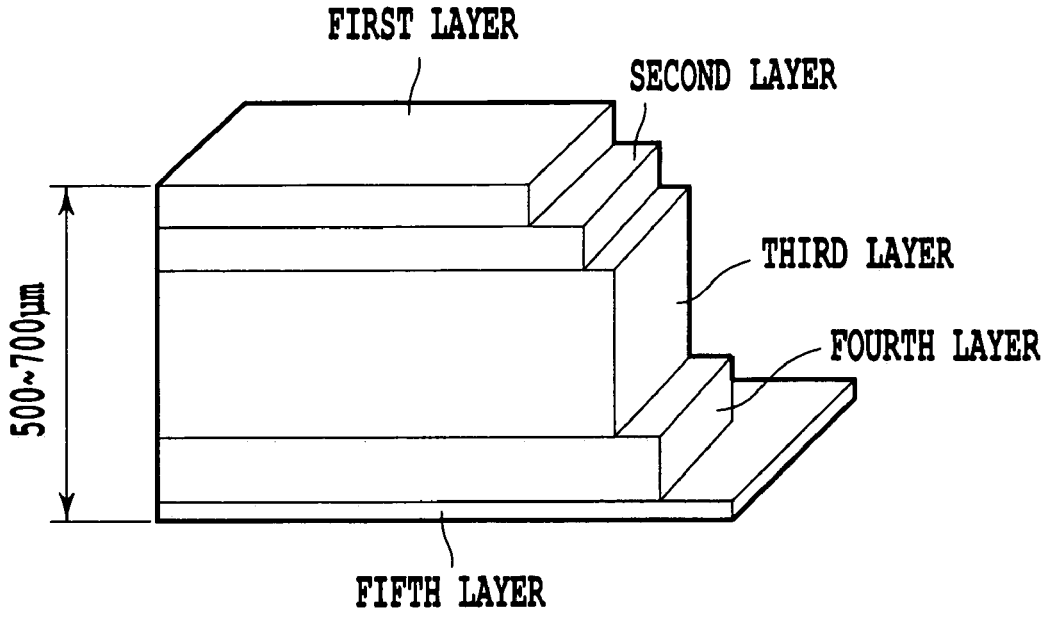
FIG. 6 is a diagram showing one example of the layer structure of the intermediate transfer belt installed in the copying machine of the present embodiment.

FIG. 6 is an explanatory diagram showing one example of the layer structure of the abovementioned intermediate transfer belt 10.

The intermediate transfer belt 10 of the present example is an endless belt with a five-layer structure with mutually different layer materials, and is formed so that the thickness of the belt is 500 to 700 [μm] or less. Furthermore, the layers are designated as the first layer, second layer, third layer, fourth layer and fifth layer in that order from the surface side of the belt (i.e., the side of the surface that contacts the photosensitive drums). The first layer is a polyurethane resin coating layer filled with fluorine. Low friction between the photosensitive drums 40Y, 40M, 40C and 40K and the intermediate transfer belt 10 (low friction with respect to the photosensitive bodies) and toner stripping characteristics are realized by means of this layer. The second layer is a silicone-acrylic copolymer coating layer; this layer acts to improve the durability of the first layer, and to prevent deterioration of the third layer over time. The third layer is a rubber layer (elastic layer) comprising a chloroprene with a thickness of approximately 400 to 500 [μm], having a Young's modulus of 1 to 20 [MPa]. Since the third layer undergoes deformation in accordance with local indentations and projections caused by the toner image in the secondary transfer part, a recording paper with poor smoothness or the like, the occurrence of character dropout can be suppressed without any excessive increase in the transfer pressure on the toner image. Furthermore, since good adhesion is obtained with respect to recording paper having a poor smoothness, transfer images with superior uniformity can be obtained. The fourth layer is a polyvinylidene fluoride layer with a thickness of approximately 100 [μm], which acts to prevent expansion and contraction in the circumferential direction of the belt. The Young's modulus of this layer is 500 to 1000 [MPa]. The fifth layer is a polyurethane coating layer which realizes a high coefficient of friction with the driving roller 16.

The following may be cited as examples of other materials.

In the first layer and second layer, a single polyurethane, polyester, epoxy resin or the like may be used, or two or more such resins may be used in combination, in order to prevent contamination of the photosensitive bodies by the elastic material, improve the cleaning characteristics by reducing the surface friction resistance on the surface of the intermediate transfer belt 10 so that the adhesive force of the toner is reduced, and improve the secondary transfer characteristics onto the recording paper. Furthermore, powders or particles of fluororesins, fluoro-compounds, carbon fluoride, titanium dioxide, silicon carbide or the like may be used singly or in combinations of two or more compounds, or the same compounds with different particle sizes may be dispersed, in order to reduce the surface energy and increase the smoothness. Moreover, materials in which the surface energy is reduced by performing a heat treatment so that a fluorine-rich layer is formed on the surface (as in fluorine type rubber materials) may also be used.

In the elastic layer of the third layer, a single compound or two or more compounds selected from a set comprising butyl rubbers, fluorine type rubbers, acrylic rubbers, EPDM, NBR, acrylonitrile-butadiene-styrene rubbers, natural rubber, isoprene rubbers, styrene-butadiene rubbers, butadiene rubbers, ethylene-propylene rubbers, ethylene-propylene terpolymers, chloroprene rubbers, chlorosulfonated polyethylenes, chlorinated polyethylenes, urethane rubbers, syndiotactic 1,2-polybutadienes, epichlorohydrin type rubbers, [si]licone rubbers, fluoro-rubbers, polysulfide rubbers, polynorbornene rubbers, hydrogenated nitrile rubbers, thermoplastic elastomers (e.g., polystyrene type, polyolefin type, polyvinyl chloride type, polyurethane type, polyamide type, polyurea type, polyester type, fluoro-resin type) and the like can be used.

As the fourth layer, a single compound or a combination of two or more compounds selected from a set comprising polycarbonates, fluoro-resins (ETFE, PVDF), styrene type resins (including homopolymers or copolymers containing styrene or substituted styrenes) such as polystyrenes, chloropolystyrenes, poly-α-methylstyrenes, styrene-butadiene copolymers, styrene-vinyl chloride copolymers, styrene-vinyl acetate copolymers, styrene-maleic acid copolymers, styrene-acrylic acid ester copolymers (styrene-methyl acrylate copolymers, styrene-ethyl acrylate copolymers, styrene-butyl acrylate copolymers, styrene-octyl acrylate copolymers, styrene-phenyl acrylate copolymers and the like), styrene-methacrylic acid ester copolymers (styrene-methyl methacrylate copolymers, styrene-ethyl methacrylate copolymers, styrene phenyl methacrylate copolymers and the like), styrene-α-methyl chloroacrylate copolymers, styrene-acrylonitrile-acrylic acid ester copolymers and the like, methyl methacrylate resins, butyl methacrylate resins, ethyle acrylate resins, butyl acrylate resins, modified acrylic resins (silicone-modified acrylic resins, vinyl chloride resin-modified acrylic resins, acrylic-urethane resins and the like), vinyl chloride resins, styrene-vinyl acetate copolymers, vinyl chloride-vinyl acetate copolymers, rosin-modified maleic acid resins, phenol resins, epoxy resins, polyester resins, polyester-polyurethane resins, polyethylenes, polypropylenes, polybutadienes, polyvinylidene chlorides, ionomer resins, polyurethane resins, silicone resins, ketone resins, ethylene-ethyl acrylate copolymers, xylene resins and polyvinylbutyral resins, polyamide resins, modified polyphenylene oxide resins and the like.

Methods for preventing the elongation of the elastic belt include methods in which a rubber layer is formed on a core resin that shows little elongation as in the abovementioned fourth layer, methods in which materials that prevent elongation are introduced into the core layer and the like. However, such methods do not particularly relate to the manufacturing method.

In regard to materials forming a core layer that prevents elongation, for example, a single material or two or more materials selected from natural fibers such as cotton, silk or the like, synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers or the like, inorganic fibers such as carbon fibers, glass fibers, boron fibers or the like, and metal fibers such as iron fibers, copper fibers or the like, may be used. Materials produced by forming these fibers into a fabric or yarn may be used. Of course, the present invention is not limited to the abovementioned materials. Yarns used may be monofilament or multi-filament yarns, the spinning method used may be any spinning method such as single spinning, multi-spinning, twin-spinning or the like. Furthermore, for example, fibers of materials selected from the abovementioned set may be spun in mixed spinning. Of course, yarns may be used after being subjected to a treatment that makes the yarns conductive. In regard to fabrics, meanwhile, fabrics of any desired weave such as a knit or the like may be used. Of course, fabrics with an alternating weave may also be used, and a conductive treatment can naturally be performed.

There are no particular restrictions on the manufacturing method used to form the core layer. For instance, examples of methods that can be used include a method in which a fabric woven in tubular form is placed in a mold, and a covering layer is formed on top of this fabric, a method in which a fabric woven in tubular form is immersed in a liquid rubber or the like, so that a covering layer is formed on one or both surfaces of the core layer, a method in which a yarn is wound in spiral form at an arbitrary pitch in a mold or the like, and a covering layer is installed on top of this yarn, or the like.

Furthermore, depending on the layer, a conductive agent used to adjust the resistance may also be included. Examples of such conductive agents include carbon black, graphite, powdered metals such as aluminum, nickel or the like, conductive metal oxide compounds such as tin oxide, titanium oxide, antimony oxide, indium oxide, potassium titanate, antimony oxide-tin oxide compound oxide (ATO), indium oxide-tin oxide compound oxide (ITO) or the like, and materials in which conductive metal oxides are covered with fine insulating particles of barium sulfate, magnesium silicate, calcium carbonate or the like. Naturally, however, the present invention is not limited to materials described above.

In the case of a single-layer belt in which the belt material is uniform, since the expansion and contraction on the inner circumferential surface and outer circumferential surface of the belt are the same, the belt pitch line that determines the movement speed of the belt is in the center of the belt in the direction of thickness as shown in FIG. 4. However, in the case of the abovementioned multi-layer belt, the belt pitch line is not located in the central portion with respect to the direction of thickness of the belt. In such a multi-layer belt, in cases where there is a layer with an exceptionally large Young's modulus among the plurality of layers making up the belt, the belt pitch line is located substantially in the central portion of this layer. This is due to the fact that the layer with a high Young's modulus (hereafter referred to as the "tension layer") constitutes the center line in order to prevent expansion and contraction in the circumferential direction of the belt, while the other layers are wound on the supporting rollers while expanding and contracting. In the case of the abovementioned intermediate transfer belt 10, since the fourth layer constituting the tension layer has an exceptionally large Young's modulus, the belt pitch line is located inside this fourth layer. Furthermore, in the case of a tension layer which has such an exceptionally large Young's modulus, the thickness irregularity of this tension layer in the circumferential direction of the belt has a great effect on the fluctuation of the PLD. In short, in a multi-layer belt, the PLD is determined mainly by the effect of layers that have a large Young's modulus among the plurality of layers making up the belt.

In addition, the PLD also fluctuates in cases where the position of the fourth layer (tension layer) is displaced in the belt thickness direction over one circuit of the belt. For example, if thickness irregularity is present in the fifth layer which is located between the fourth layer (tension layer) and the supporting rollers, then the position of the fourth layer (tension layer) in the belt thickness direction varies according to this thickness irregularity, so that the PLD fluctuates.

Furthermore, in the case of an endless belt which has a joint seam (seamed belt), the method of manufacture is usually as follows: namely, a polyvinylidene fluoride sheet is prepared as the fourth layer, and the end portions of this sheet are superimposed for a length of approximately 2 [mm] and bonded by fusion, so that the belt is formed into an endless belt, after which the other layers are successively formed. In this case, the portion that is bonded by fusion (i.e., the joint seam portion) shows a variation in physical properties as a result of fusion, so that the expansion and contraction characteristics of this portion differ from those of the other portions. Accordingly, even if this portion has the same thickness as the other portions, the PLD of the joint seam portion will deviate greatly from the PLD of the other portions. In such portions, even if there is no fluctuation in the belt thickness, a fluctuation in the PLD occurs, so that a fluctuation in the belt speed occurs when such portions are wound on the driving roller. Furthermore, unlike a seamless belt with no joint seam in which an individual mold is required for each product with a different belt circumferential length, a seamed belt with a joint seam does not require the use of such a mold, and the circumferential length of the belt can be freely adjusted. Accordingly, in these respects, the advantage of a reduction in the manufacturing cost can be obtained.

Next, the driving control of the intermediate transfer belt 10, which is the characterizing portion of the present invention, will be described.

In the present example, it is necessary to cause the intermediate transfer belt 10 to move at a constant speed. In actuality, however, fluctuations are generated in the belt movement speed as a result of part error, the environment and variation over time, and when the belt movement speed of the intermediate transfer belt 10 fluctuates, the actual belt movement position deviates from the target belt movement position, so that the tip end positions of the images of the respective toners on the photosensitive drums 40Y, 40M and 40C are shifted on the intermediate transfer belt, thus causing color deviation to occur. Furthermore, the toner image portions that are transferred onto the intermediate transfer belt 10 when the belt movement speed is relatively rapid assume a shape that is stretched out in the circumferential direction of the belt from the original shape; conversely, the toner image portions that are transferred onto the intermediate transfer belt 10 when the belt movement speed is relatively slow assume a shape that is contracted in the circumferential direction of the belt from the original shape. In this case, a variation in the periodic image density (banding) appears in the images that are finally formed on the sheet in the direction corresponding to the circumferential direction of the belt.

Accordingly, the construction and operation that are used to maintain the intermediate transfer belt 10 at a constant speed with high precision will be described below. Furthermore, the following description is not limited to the intermediate transfer belt 10, but is also broadly applicable to belts for which driving control is performed.

In the present example, the rotational angular speeds $\omega_1$ and $\omega_2$ of two rollers which have different roller diameters or in which the degree to which the PLD of the portion of the belt that is wound on these rollers affects the relationship between the movement speed of the belt and the rotational angular speed of these rollers is different are continuously detected, and the PLD fluctuation f(t) is determined from these two rotational angular speeds $\omega_1$ and $\omega_2$. Furthermore, in the case of a single-layer belt, the abovementioned PLD has a fixed relationship with the belt thickness, and the fluctuation in the PLD has a fixed relationship with the fluctuation in the belt thickness; accordingly, the system may be devised so that the rotational angular speeds of two rollers which have different roller diameters or in which the degree to which the thickness of the portion of the belt that is wound on these rollers affects the relationship between the movement speed of the belt and the rotational angular speed of these rollers is different are continuously detected, and the fluctuation in the belt thickness is determined from these two rotational angular speeds. This PLD fluctuation f(t) is a periodic function which indicates the variation over time in the PLD of the portion of the belt that passes through a specified ground point on the belt movement path while the belt completes one revolution. As was described above, this PLD fluctuation has a great effect on the belt movement speed V; accordingly, if this PLD fluctuation f(t) is determined with a high degree of precision from the rotational angular speeds $\omega_1$ and $\omega_2$ of two supporting rollers, and belt driving control is performed on the basis of this PLD fluctuation f(t), then the movement speed V of the belt can be controlled with a high degree of precision.

Two types of methods may be cited as examples of methods for determining the PLD fluctuation f(t) with a high degree of precision in the present example. The first method is a method in which the two rollers mentioned above are disposed in close proximity to each other in the movement direction of the belt (PLD fluctuation recognition method 1). The second method is a method in which filter processing that does not affect the disposition relationship of the two abovementioned rollers is performed (PLD fluctuation recognition method 2).

(PLD Fluctuation Recognition Method 1)

Figure 7:
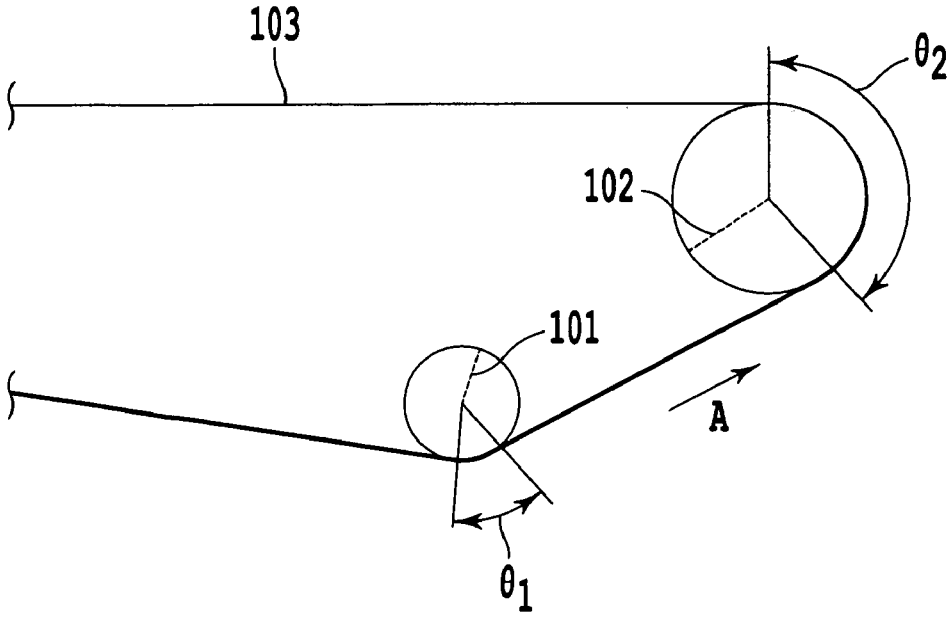
FIG. 7 is a model diagram showing the essential parts of the belt apparatus.

FIG. 7 is a model diagram showing the essential parts of the belt apparatus. This belt apparatus comprises a belt 103, and a first roller 101 and second roller 102 used as supporting rotating bodies on which this belt 103 is mounted. The belt 103 is wound around the first roller 101 at a belt winding angle of $\theta_1$, and is wound around the second roller 102 at a belt winding angle of $\theta_2$. The belt 103 moves endlessly in the direction indicated by the arrow A in the figure. Rotary type encoders used as detection means are respectively disposed on the first roller 101 and second roller 102. Encoders that are able to detect the rotational angular displacements or rotational angular speeds of the respective rollers 101 and 102 may be used as these rotary type encoders. In the present example, encoders that can detect the rotational angular speeds $\omega_1$ and $\omega_2$ of the respective rollers 101 and 102 are used. For example, universally known optical encoders in which timing marks are formed at fixed intervals on concentric circles on a disk made of a transparent material such as a transparent glass, plastic or the like, these encoders are coaxially fastened to the respective rollers 101 and 102, and the timing marks are optically detected, can be used as these rotary type encoders. Furthermore, for example, it would also be possible to use magnetic encoders in which timing marks are magnetically recorded on concentric circles on a disk made of a magnetic material, these encoders are coaxially fastened to the respective rollers 101 and 102, and the timing marks are detected by a magnetic head. Furthermore, it would also be possible to use a universally known tachogenerator. In the present embodiment, for example, the time intervals of the pulses that are continuously output by the rotary type encoders can be measured, and the rotational angular speed can be obtained from the reciprocal of this measured value. Moreover, the rotational angular displacement can be obtained by counting the number of pulses that are continuously output by the rotary type encoders.

The relationships between the rotational angular speed and belt movement speed V for the first roller 101 and second roller 102 can be respectively expressed by the equations shown in Equations (3) and (4) below.

$$V=\{R_1+\kappa_1 f(t)\}\omega \quad \text{Eq. (3)}$$

$$V=\{R_2=\kappa_2 f(t-\tau)\}\omega_2 \quad \text{Eq. (4)}$$

Here, "$\omega_1$" is the rotational angular speed of the first roller 101, "$\omega_2$" is the rotational angular speed of the second roller 102, "V" is the belt movement speed, "$R_1$" is the effective roller radius of the first roller 101, and "$R_2$" is the effective roller radius of the second roller 102.

Furthermore, "$\kappa_1$" is the effective coefficient of PLD fluctuation of the first roller 101 which is determined by the belt winding angle $\theta_1$ of the first roller 101, the belt material, the belt layer structure and the like; this is a parameter that determines the degree to which the PLD affects the belt movement speed. Similarly, "$\kappa_2$" is the effective coefficient of PLD fluctuation of the second roller 102. The reason that rollers 101 and 102 with respectively different effective coefficients of PLD fluctuation are used is that the belt winding states (deformation curvatures) are different, and that the amount of winding of the belt on the respective rollers is different, so that there are cases in which the degree to which the PLD fluctuation affects the relationship between the belt movement speed (amount of belt movement) and the rotational angular speed (rotational angular displacement) of the rollers is different. Furthermore, these effective coefficients of PLD fluctuation $\kappa_1$ and $\kappa_2$ are generally both 0.5 in cases where a belt with a uniform belt material and a single-layer structure is used, and the belt winding angles $\theta_1$ and $\theta_2$ are sufficiently large.

Furthermore, "f(t)" is a periodic function having a period that is the same as the period required for the belt to complete one revolution, which indicates the variation over time in the PLD of the portion of the belt passing through a specified ground point on the belt movement path; this function indicates the deviation from the average value $PLD_{ave}$ of the PLD in the circumferential direction of the belt over one circuit of the belt. Here, the abovementioned specified ground point is set as the location where the belt is wound on the first roller 101. Accordingly, at time t=0, the amount of PLD fluctuation in the portion of the belt that is wound on the first roller 101 is f(0). Furthermore, it would also be possible to use the abovementioned function f(d) instead of the time function f(t) as the function for PLD fluctuation. f(t) and f(d) are mutually interchangeable.

Furthermore, "$\tau$" is the mean time required for the belt 103 to move from the first roller 101 to the second roller 102; below, this will be referred to as the "delay time". This delay time $\tau$ has significance as the phase difference between the PLD fluctuation f(t) in the portion of the belt that is wound on the first roller 101 and the PLD fluctuation f(t−$\tau$) in the portion of the belt that is wound on the second roller 102.

It is difficult to determine the average value $PLD_{ave}$ of the PLD from the layer structure of the belt and the materials and physical properties of the respective layers alone; however, for example, this can be determined by performing a simple test driving of the belt in question, and obtaining the average value of the belt movement speed. Specifically, the average value of the belt movement speed in a case where the driving roller is driven at a fixed rotational angular speed is {(radius r of driving roller+$PLD_{ave}$)×fixed rotational angular speed $\omega_{01}$ of driving roller}. Furthermore, the average value of the belt movement speed when the driving roller is driven at a fixed rotational angular speed is determined from (circumferential length of belt)/(time required for one revolution of the belt). The circumferential length of the belt and the time required for one revolution of the belt can be accurately measured. Accordingly, the average value of the belt movement speed when the driving roller is driven at a fixed rotational angular speed can also be accurately calculated. Furthermore, since the radius r of the driving roller and the fixed rotational angular speed $\omega_{01}$ can also be accurately grasped, $PLD_{ave}$ can be accurately calculated. Moreover, the method used to calculated $PLD_{ave}$ is not limited to this method.

Since the belt movement speed V of the portion of the belt wound on the second roller 102 at the time instant t is the same as the belt movement speed V of the portion of the belt wound on the first roller 101 at the time instant t, the abovementioned Equation (3) can be derived from the abovementioned Equations (1) and (2). Furthermore, since the PLD fluctuation f(t) is sufficiently small relative to the effect roller radii $R_1$ and $R_2$, the abovementioned Equation (3) can be approximated as the abovementioned Equation (4).

In this recognition method 1, the first roller 101 and second roller 102 are disposed in close proximity to each other in the circumferential direction of the belt. In other words, if the first roller 101 and second roller 102 are disposed in close proximity so that the delay time $\tau$ is sufficiently small, an approximation of f(t)=f(t−$\tau$) is possible. Furthermore, the conditions (permissible range) of the delay time $\tau$ for such an approximation will be described later. In cases where such an approximation of f(t)=f(t−$\tau$) is made, the abovementioned Equation (4) becomes the following Equation (5).

$$\omega_2 = \frac{\{R_1 + \kappa_1 f(t)\}}{\{R_2 + \kappa_2 f(t-\tau)\}}\omega_1 \quad \text{Eq. (5)}$$

As is seen from the abovementioned Equation (5), the PLD fluctuation f(t) can be determined from the rotational angular speed $\omega_1$ of the first roller 1 and the rotational angular speed $\omega_2$ of the second roller 102 at the time instant t. In particular, if driving control of the belt 103 is performed so that the rotational angular speed $\omega$ of the first roller 101 is constant, then $\omega_1$ is fixed, and the PLD fluctuation f(t) can be determined merely by detecting the rotational angular speed $\omega_2$ of the second roller 102. Furthermore, envisioning the fact that there may be noise, it is also possible to perform correction control for all of the fluctuation frequency components contained in the PLD fluctuation f(t) that is obtained by passing this through a noise removing filter. However, accurate control within the range of permissible error can be performed up to frequencies where $\tau$ can be ignore because of the relationship between the periods of certain fluctuation frequency components and the delay time $\tau$.

Furthermore, as is clear from the abovementioned Equation (5), the recognition sensitivity $\beta$ of the PLD fluctuation f(t) can be expressed by the following Equation (6), $$\omega_2 \cong \frac{R_1}{R_2}\omega_1 + \frac{R_1}{R_2}\omega_1\left\{\frac{\kappa_1}{R_1}f(t) - \frac{\kappa_2}{R_2}f(t-\tau)\right\} \quad \text{Eq. (6)}$$

Thus, the recognition sensitivity $\beta$ of the PLD fluctuation f(t) is the difference of the ratios of $R_1$ and $R_2$ (which are the effective roller radii ($r+PLD_{ave}$) in the respective rollers) and the effective coefficients $\kappa_1$ and $\kappa_2$ of PLD fluctuation, regardless of the rotational angular speeds $\omega_1$ and $\omega_2$ of the respective rollers 101 and 102. Accordingly, [this sensitivity] increases as this difference increases. In actuality, since the roller radius r has a relatively large value compared to $PLD_{ave}$, the recognition sensitivity $\beta$ is the difference in the ratios of the radii $r_1$ and $r_2$ of the respective rollers and the effective coefficients of PLD fluctuation $\kappa_1$ and $\kappa_2$, so that the recognition sensitivity $\beta$ increases with an increase in the difference in these ratios between the two rollers. Furthermore, this recognition sensitivity $\beta$ is a value in which an increase in the absolute value indicates an increase in the recognition sensitivity of f(t) regardless of the sign of this value; accordingly, if the abovementioned ratios are different, either of the radii of the two rollers 101 and 102 may be larger, or either of the effective coefficients of PLD fluctuation may be larger.

Here, if the belt winding angles $\theta_1$ and $\theta_2$ are reduced in order to adjust the effective coefficients of PLD fluctuation $\kappa_1$ and $\kappa_2$, slipping or the like of the belt 103 tends to occur on these rollers. In this case, the relationship between the belt movement speed and the roller rotation angle becomes unstable. Accordingly, it is desirable that the belt winding angles $\theta_1$ and $\theta_2$ of both of the rollers 101 and 102 be sufficiently large. Consequently, in cases where the recognition sensitivity $\beta$ of the PLD fluctuation f(t) is set at a sufficiently large value, it is better to adjust the roller radii r than to adjust the effective coefficients of PLD fluctuation $\kappa_1$ and $\kappa_2$ of the respective rollers 101 and 102. Accordingly, it is desirable to set the belt winding angles $\theta_1$ and $\theta_2$ of both of the respective rollers 101 and 102 at sufficiently large values, to devise the system so that the effective coefficients of PLD fluctuation $\kappa_1$ and $\kappa_2$ both have the same value, and to set the roller radii r of the respective rollers 101 and 102 so that a sufficiently large recognition sensitivity $\beta$ is obtained.

Accordingly, in the present embodiment, in order to determine the PLD fluctuation f(t) with a high degree of precision, rollers that have greatly different radii are used as the two abovementioned rollers 101 and 102. Furthermore, the PLD fluctuation f(t) is calculated by substituting the rotational angular speeds $\omega_1$ and $\omega_2$ obtained over one circuit of the belt from the output results of the respective rotary type encoders installed on these rollers 101 and 102 into the equation shown in the abovementioned Equation (7). Moreover, if this is repeated so that the PLD fluctuation f(t) is calculated for a plurality of frequency components, and the respective calculated PLD fluctuations f(t) are averaged, a more precise PLD fluctuation f(t) can be determined.

In particular, as was described above, if the rotational angular speed $\omega_1$ of the first roller 101 is set at a constant rotational angular speed $\omega_1$, then $\omega_1$ in the equation shown in the abovementioned Equation (5) becomes a constant, so that this equation becomes the equation shown in the following Equation [(7)]. In this case, the calculation processing used to determine the PLD fluctuation f(t) can be simplified. In other words, the PLD fluctuation f(t) is determined from rotation information detected by the second roller on the basis of the rotation information that the first roller has a constant rotational angular speed. In concrete terms, driving control of the belt 103 is first performed using the output from the rotary type encoder of the first roller 101 so that the rotational angular speed $\omega_1$ of this roller is the rotational angular speed $\omega_{01}$. Subsequently, using the output from the rotary type encoder of the second roller 102, the rotational angular speed $\omega_2$ of this roller is substituted into the following Equation (7), and the PLD fluctuation f(t) is derived. Furthermore, the same is true in cases where the rotational angular speed $\omega_2$ of the second roller 102 is set as a fixed rotational angular speed $\omega_{02}$, and the PLD fluctuation f(t) is derived from the output of the rotary type encoder of $$\omega_2 \cong \frac{R_1}{R_2}\omega_1 + \frac{R_1}{R_2}\omega_1\left\{\frac{\kappa_1}{R_1}f(t) - \frac{\kappa_2}{R_2}f(t-\tau)\right\} \quad \text{Eq. (7)}$$

In particular, if the roller whose rotational angular speed is fixed (of the two rollers 101 and 102 mentioned above) is a driving roller using a stepping motor or DC servo motor as a driving source, then it is sufficient to install a rotary type encoder only on the other roller. Specifically, such a case is advantageous in that a single rotary type encoder is sufficient. On the other hand, however, as was described above, the driving roller tends to show slipping with the belt 103; furthermore, if gears or the like are present in the driving transmission system, then fluctuations may also occur in the rotational angular speed of the driving roller as a result of driving transmission error. As a result, there is a danger that the recognition precision of the PLD fluctuation f(t) may drop. Accordingly, in cases where the PLD fluctuation is to be determined with a higher degree of precision, it is advisable to make both of the two abovementioned rollers 101 and 102 driven rollers.

Next, the conditions (permissible range) of the abovementioned delay time $\tau$ will be described.

This delay time $\tau$ is determined by the distance between the two abovementioned rollers 101 and 102 in the circumferential direction of the belt (hereafter referred to as the "inter-roller distance") and the average value of the belt movement speed. The average value of the belt movement speed usually cannot be easily altered because of the specifications of the product mounted by this belt apparatus and the relationship with other apparatuses mounted on this product. Here, therefore, it will be described how the abovementioned inter-roller distance should be set.

If f(t) is approximated as $f(t-\tau)$ as in this recognition method 1, then an error is generated between the PLD fluctuation f(t) derived by the present recognition method 1 and the actual PLD fluctuation. However, as long as the fluctuation in the belt movement speed of the belt 103 and the deviation of the belt movement position caused by this error are within permissible ranges, this error causes no practical problems.

The nth higher harmonic frequency component $f_n(t)$ of the PLD fluctuation f(t) can be expressed by the following Equation (8). In this equation, "ΔBn" is the amplitude of the nth higher harmonic frequency component, "$\omega_n$" is the angular frequency of the nth higher harmonic frequency component, and "$\alpha_n$" is the phase of the nth higher harmonic frequency component.

$$\beta = \frac{\kappa_1}{R_1} - \frac{\kappa_2}{R_2} \quad \text{Eq. (8)}$$

In cases where such an nth higher harmonic frequency component $f_n(t)$ exists in the PLD fluctuation f(t), [the equation expressing] the rotational angular speed $\omega_2$ of the second roller 102 in a case where belt driving control is performed so that the first roller 101 is caused to rotate at a uniform angular speed $\omega_{01}$ becomes the following Equation (9) from the abovementioned Equation (4).

$$\omega_2 \cong \frac{R_1}{R_2}\omega_{o1} + \frac{R_1}{R_2}\omega_{o1}\left(\frac{\kappa_1}{R_1} - \frac{\kappa_2}{R_2}\right)f(t) \quad \text{Eq. (9)}$$

Here, if the fluctuation component of the rotational angular speed $\omega_2$ of the second roller 102 (the second term on the right side in the abovementioned Equation (9)) is designated as $\Delta\omega_2$, then this fluctuation component $\Delta\omega_2$ can be expressed by the following Equation (10) by calculating the portion of the second term on the right side of the abovementioned Equation (9) that is contained in the large brackets.

$$fn(t) = \Delta Bn \sin(\omega_n t + \alpha_n) \quad \text{Eq. (10)}$$

Here, "K" in the abovementioned Equation (10) is the entity shown in the following Equation (11), and "P" in the abovementioned Equation (10) is the entity shown in the following Equation (12).

$$\omega_2 \cong \frac{R_1}{R_2}\omega_{o1} + \frac{R_1}{R_2}\omega_{o1}\left[\frac{\kappa_1}{R_1}\Delta Bn\sin(\omega_n t + \alpha_n) - \frac{\kappa_2}{R_2}\Delta Bn\sin\{\omega_n(t-\tau) + \alpha_n\}\right] \quad \text{Eq. (11)}$$

$$\Delta\omega_2 = \frac{R_1}{R_2}\omega_{o1}\Delta BnK\sin(\omega_n t + \alpha_n + P) \quad \text{Eq. (12)}$$

In this recognition method 1, since f(t) is approximated as f(t−τ), $f_n(t)$ is approximated as $f_n(t-\tau)$ for the nth higher harmonic frequency component $f_n(t)$ as well. If the nth higher harmonic frequency component in the case of such an approximation is designated as $f_n'(t)$, then the abovementioned fluctuation component $\Delta\omega_2$ can be rewritten as the following Equation (13) from the abovementioned Equation (7).

In other words, the approximated nth higher harmonic frequency component $f_n'$ (t) can be rewritten as the following Equation (14) from the abovementioned Equation (10).

$$K = \sqrt{\left(\frac{\kappa_1}{R_1}\right)^2 + \left(\frac{\kappa_2}{R_2}\right)^2 - 2\frac{\kappa_1\kappa_2}{R_1R_2}\cos(\omega_n\tau)} \quad \text{Eq. (13)}$$

$$P = \tan^{-1}\left\{\frac{\frac{\kappa_2}{R_2}\sin(\omega_n\tau)}{\frac{\kappa_1}{R_1} - \frac{\kappa_2}{R_2}\cos(\omega_n\tau)}\right\} \quad \text{Eq. (14)}$$

Meanwhile, if the target rotational angular speed $\omega_{1c}$ in a case where the rotational angular speed $\omega_1$ of the first roller 101 is controlled so that the belt movement speed is constant is derived using the PLD fluctuation f(t) determined by this recognition method 1, this target rotational angular speed $\omega_{1c}$ can be expressed by the following Equation (15). Furthermore, "$\omega_{1a}$" in this equation is the target average rotational angular speed of the first roller 101. In cases where there is no PLD fluctuation and the belt movement speed is a constant speed $V_0$, $V_0 = R_1 \times \omega_{1a}$.

$$\Delta\omega_2 = \frac{R_1}{R_2}\omega_{o1}\left(\frac{\kappa_1}{R_1} - \frac{\kappa_2}{R_2}\right)f_n'(t) \quad \text{Eq. (15)}$$

If the component of the target rotational angular speed $\omega_{1c}$ of the first roller 101 that corrects the PLD fluctuation f(t) is designated as $\Delta\omega_{1c}$, and the abovementioned Equation (15) is transformed with respect to this component, then the following Equation (16) is obtained.

$$'_n(t) = \Delta BnK\sin(\omega_n t + \alpha_n + P) \Big/ \left(\frac{\kappa_1}{R_1} - \frac{\kappa_2}{R_2}\right) \quad \text{Eq. (16)}$$

Here, the nth higher harmonic frequency component $f_n(t)$ of the PLD fluctuation f(t) in the abovementioned Equation (16) is intrinsically expressed by the abovementioned Equation (8); however, in the present recognition method 1, this is the approximated nth higher harmonic frequency component $f_n'(t)$ determined by the abovementioned Equation (14). The error component $\Delta\omega_{1c_err}$ of the control target value in this case is expressed by the following Equation (17)

$$\omega_{1c} = \frac{\omega_{1a}R_1}{\{R_1 + \kappa_1 f(t)\}} \quad \text{Eq. (17)}$$

If the nth higher harmonic frequency component $f_n(t)$ of the equation shown in the abovementioned Equation (8) and the approximated nth higher harmonic frequency component $f_n'$ (t) of the abovementioned Equation (14) are substituted into this Equation (17), and the equation is transformed, the following Equation (18) is obtained.

$$\Delta\omega_{1c} = -\frac{\kappa_1\omega_{1a}}{R_1}f(t) \quad \text{Eq. (18)}$$

Here, "E" in the abovementioned Equation (18) is the entity shown in the following Equation (19), and "A" in this Equation (19) is the entity shown in the following Equation (20). Furthermore, "C" in the equation shown in the abovementioned Equation (18) is the entity shown in the following Equation 21, and is a constant expressing the initial phase.

$$\Delta\omega_{1c_err} = -\frac{\kappa_1\omega_{1a}}{R_1}\{fn'(t) - fn(t)\} \quad \text{Eq. (19)}$$

$$\Delta\omega_{1c_err} = -\frac{\kappa_1\omega_{1a}\Delta Bn}{R_1}\{E\sin(\omega_n t + C)\} \quad \text{Eq. (20)}$$

$$E = \sqrt{A^2 - 2A\cos P + 1} \quad \text{Eq. (21)}$$

$$A = K\Big/\left(\frac{\kappa_1}{R_1} - \frac{\kappa_2}{R_2}\right) \quad \text{Eq. (22)}$$

Furthermore, if the equation shown in the abovementioned Equation (18) is converted into the error $V_{1c_err}$ of the belt movement speed, then the following Equation (22) is obtained.

Thus, in the present recognition method 1, an error $V_{1C_err}$ is generated in the belt movement speed by the delay time τ determined by the abovementioned inter-roller distance. Accordingly, even if an attempt is made to control the fluctuation in the belt movement speed caused by the PLD fluctuation using the present recognition method 1, there is some remaining fluctuation in the belt movement speed. Generally, the fluctuation in the belt movement speed that is generated in the belt 103 is caused not only by the abovementioned PLD fluctuation, but also by eccentricity of the gears in the driving transmission system, cumulative pitch error and the like. Accordingly, the permissible range of fluctuation in the belt movement speed caused by PLD fluctuation is a permissible range that is assigned to the PLD fluctuation by design. Here, in the driving control of the intermediate transfer belt 10 in the copying machine of the present example, as was described above, color deviation and banding occur as a result of the fluctuation of the belt movement speed. Such color deviation and banding occur as a result of the actual belt movement position deviating from the target belt movement position due to the fluctuation in the belt movement speed, and are aggravated as the amount of this deviation in the belt movement position increase. Furthermore, this color deviation and banding are visually sensed by persons viewing images on the sheet; for example, in the case of banding, the permissible range for keeping this phenomenon at a level that causes no problems in practical terms can be defined by a space frequency fs which indicates the interval (distance) of the variation in the image density. This space frequency fs has a fixed relationship with the time frequency f (f=F×fs (F: a constant)); accordingly, a permissible range of the amount of deviation in the belt movement position which is such that this is kept within the permissible range of the space frequency fs that is determined as the permissible range of banding can also be defined. As a result, the permissible range of the fluctuation in the belt movement speed can also be defined.

The amount of deviation $X_{errT}$ in the belt movement position generated by approximation as in the present recognition method 1 is the sum of the primary through nth higher harmonic frequency components with an integration of the abovementioned Equation (22) indicating the error $V_{1c_err}$ by using the nth higher harmonic frequency component $f_n'(t)$; accordingly, the following Equation (23) is obtained. In this equation, "i" indicates the order number of the frequency component present $$c=\tan^{-1}[\sin P/\{(1/A)-\cos P\}] \quad \text{Eq. (23)}$$

Here, for example, in cases where the permissible range which is such that banding is not visually sensed by human beings is determined, the system is devised so that for each frequency component of the PLD fluctuation f(t), the amount of error $X_{errT}$ in the belt movement position is equal to or less than the permissible amount of deviation in the position $X_{err}$ indicated by the following Equation (24) assigned for the fluctuation in the belt movement speed caused by the PLD fluctuation f(t). Accordingly, the value of the delay time τ, the diameters of the first roller 101 and second roller 102, the winding angles relating to the effective coefficients of PLD fluctuation κ and the like are determined so that the maximum values (amplitude values) of the respective frequency components indicated by the abovementioned Equation (23) are equal to or less than this permissible amount of deviation in the position $X_{err}$. Furthermore, if an amount of deviation in the belt movement position $X_{errT}$ such as that indicated by the abovementioned Equation 23 is generated when the toner images of respective colors formed on each of the plurality of photosensitive drums are superimposed, a color deviation also occurs. The permissible amount of deviation in the position $X_{err}$ of the respective frequency components is also determined by the restrictions arising from this color deviation.

$$\Delta V_{1c_err=-\kappa 1}\omega_{1a}\Delta Bn\{E\sin(\omega_n t+C)\} \quad \text{Eq. (24)}$$

To give a concrete example, the ratio of the radii of the first roller 101 and second roller 102 is set at 2, the respective diameters are set at ϕ30 and ϕ15, and the effective coefficients of PLD fluctuation $\kappa_1$ and $\kappa_2$ of these rollers are set at 0.5. Furthermore, the circumferential length of the belt 103 is sets at 1000 mm, which is commonly used for the intermediate transfer belt 10 in a tandem type image forming apparatus such as the copying machine of the present example. Furthermore, the effect was determined for only the primary component of the PLD fluctuation frequency components.

Figure 8:
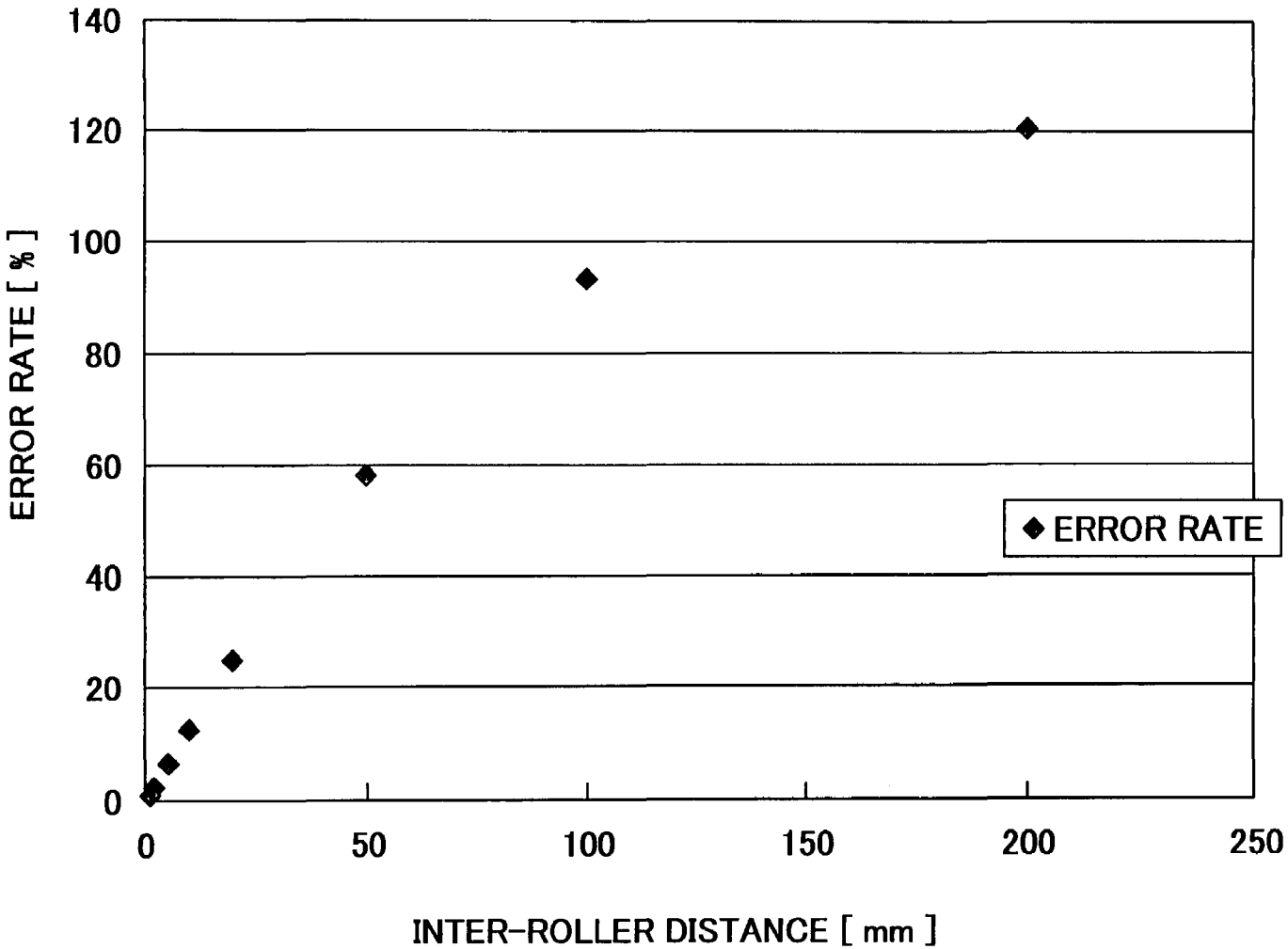
FIG. 8 is a graph showing the error rate which is the proportion of the difference between the control numerical value that is obtained when an approximation is performed and the ideal control numerical value rn a case where an approximation is not performed to the ideal control numerical value in a case where the inter-roller distance is varied.

FIG. 8 is a graph showing the error rate constituting the ratio of the difference between the control numerical value obtained when the inter-rolled distance corresponding to the delay time τ was varied and the abovementioned approximation determined from the abovementioned Equation (23) was performed, and the ideal control numerical value obtained when the abovementioned approximation was not performed, to this ideal control numerical value. For example, this graph indicates that control is performed in an ideal manner when the error rate is 0%, and that when the error rate is 100%, this is the same as a case in which no control is performed, so that a control effect cannot be expected. It is seen from this graph that when the inter-roller distance is set at 50 [mm] or less, the error rate is approximately 50%, so that a control effect that cuts the effect of PLD fluctuation on the speed fluctuation approximately in half is obtained.

(PLD Fluctuation Recognition Method 2)

In the abovementioned recognition method 1, as was described above, the control error increase when the abovementioned inter-roller distance is increased; accordingly, it is necessary to shorten the abovementioned inter-roller distance. As a result, the degree of freedom of the apparatus layout is low. Accordingly, in the present recognition method 2, a method will be described in which the PLD fluctuation f(t) is determined with a high degree of precision from the rotational angular speeds $\omega_1$ and $\omega_2$ of the two abovementioned rollers 101 and 102 independently of the abovementioned inter-roller distance. Furthermore, in the following example, a case in which the diameters of these rollers 101 and 102 are set so that the diameter of the second roller 102 is larger than the diameter of the first roller 101 will be described as an example; however, the same principle could also be used in a converse manner. Strictly speaking, when the values obtained by dividing the effective radii R of the rollers by the effective coefficients of PLD fluctuation κ are compared, the roller 102 shows a greater value than the roller 101.

The relationship between the rotational angular speeds $\omega_1$ and $\omega_2$ of the first roller 101 and second roller 102 is expressed by the abovementioned Equation (4); if this equation is transformed, then the following Equation (25) is obtained.

$$X_{errT} = \sum_{1}^{i} \kappa_1 \frac{\omega_{1a}}{\omega_n} \Delta Bn\{E\cos(\omega_n t + C)\} \quad \text{Eq. (25)}$$

Thus, if the right side of the abovementioned Equation (25) which is normalized so that the coefficient of f(t) is 1 is defined as gf(t), then the following Equation (26) is obtained. "G" in this Equation (26) is the entity shown in Equation (27) below.

$$X_{err} = \kappa_1 \frac{\omega_{1a}}{\omega_n} \Delta Bn\sqrt{A^2 - 2A\cos P + 1} \quad \text{Eq. (26)}$$

$$\left(\omega_2 - \frac{R_1}{R_2}\omega_1\right)\frac{R_2}{\omega_1 \kappa_1} = \left\{f(t) - \frac{\kappa_2 R_1}{\kappa_1 R_2} f(t-\tau)\right\} \quad \text{Eq. (27)}$$

From the relationship of the effective radii R of the rollers and the effective coefficients of PLD fluctuation κ between the respective rollers 101 and 102, G adopts a value that is smaller than 1. Furthermore, as is seen from the abovementioned Equation (25), gf(t) is obtained from the rotational angular speeds $\omega_1$ and $\omega_2$ of the respective rollers 101 and 102 using the effective radii $R_1$ and $R_2$ of the rollers and the effective coefficients of PLD fluctuation $\kappa_1$ and $\kappa_2$. The PLD fluctuation f(t) is determined from this gf(t).

Figure 9:
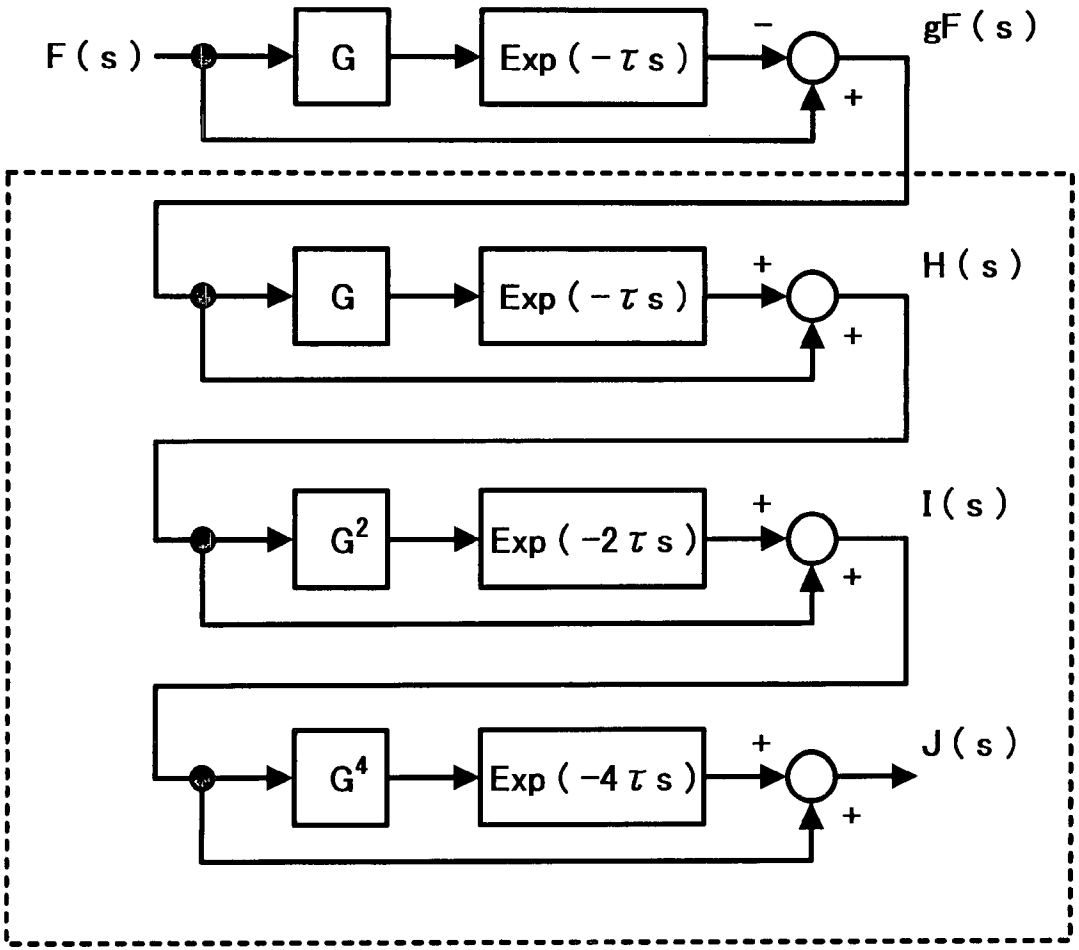
FIG. 9 is a block diagram showing the construction of the control system used to illustrate recognition method 2 using filter processing.

FIG. 9 is a control block diagram used to illustrate this recognition method 2. Furthermore, in this diagram, F(s) which is obtained by subjecting the time function F(t) to a Laplace transformation is used; "s" in the figures indicates Laplace operators. F(s)=L{f(t)} (here, L{x} indicates a Laplace transformation of x). Furthermore, in FIG. 9, for convenience [of illustration], the $0^{th}$ stage shown in the uppermost part of the figure is the entity expressed in the abovementioned Equation (26), while the stages from the first stage on surrounded by a broken line in the figure constitute a filter part.

When gF(s), i.e., the left side of the abovementioned Equation (25) (data obtained from the detected rotational angular speeds $\omega_1$ and $\omega_2$), is input into this filter part, the time function h(t) of the output H(s) of the first stage, i.e., $L^{-1}\{H(s)\}$ (here, $L^{-1}(y)$ indicates the reverse Laplace transformation of y; the same is true in regard to I(s) and J(s) below) is as shown in the following Equation (28).

$$gf(t)=\{f(t)-Gf(t-\tau)\} \quad \text{Eq. (28)}$$

In this case, since $G^2$ is sufficiently smaller than G ($G \gg G^2$), h(t) is closer to the PLD fluctuation f(t) than the abovementioned gf(t). The error $\epsilon_1$ in this case is as shown by the following Equation (29).

$$G = \frac{\kappa_2 R_1}{\kappa_1 R_2} \quad \text{Eq. (29)}$$

Furthermore, the time function i(t) of the output I(s) of the second stage is as shown in the following Equation (30).

$$\begin{aligned} h(t) &= [gf(t) + Ggf(t-\tau)] \quad \text{Eq. (30)} \\ &= [f(t) - Gf(t-\tau)] + G[f(t-\tau) - Gf(t-2\tau)] \\ &= f(t) - G^2 f(t-2\tau) \end{aligned}$$

In this case, since $G^4$ is sufficiently smaller than $G^2$ ($G^2 \gg G^4$), i(t) is even closer to the PLD fluctuation f(t) than the abovementioned h(t). The error $\epsilon_2$ in this case is as shown in the following Equation (31).

$$\epsilon_1=-G^2 f(t-2\tau) \quad \text{Eq. (31)}$$

Furthermore, the time function j(t) of the output J(s) of the third stage is as shown in the following Equation (32).

$$i(t)=f(t)-G^4 f(t-4\tau) \quad \text{Eq. (32)}$$

In this case, since $G^8$ is sufficiently smaller than $G^4$ ($G^4 \gg G^8$), j(t) is even closer to the PLD fluctuation f(t) than the abovementioned i(t). The error $\epsilon^3$ in this case is as shown in the following Equation (33).

$$\epsilon_2=-G^4 f(t-4\tau) \quad \text{Eq. (33)}$$

If the PLD fluctuation f(t) is determined using the data on the left side of the abovementioned Equation (25)(which is data obtained from the detected rotational angular speeds $\omega_1$ and $\omega_2$) in accordance with the following sequence that generalizes the above results, then the PLD fluctuation f(t) can be determined from the detected rotational angular speeds $\omega_1$ and $\omega_2$ with a high degree of precision independently of the abovementioned inter-roller distance.

(First Step)

The value $g_1(t)$ obtained by adding gf(t) and the data obtained by delaying gf(t)×G by the delay time τ is determined.

(Second Step)

The value $g_2(t)$ obtained by adding $g_1(t)$ and the data obtained by delaying $g_1(t) \times G^2$ by a time 2τ which is double the delay time τ is determined.

(Third Step)

The value $g_3(t)$ obtained by adding $g_2(t)$ and the data obtained by delaying $g_2(t) \times G^4$ by a time 4τ which is four times the delay time τ is determined.

(nth Step)

The value $g_n(t)$ obtained by adding $g_{n-1}(t)$ and the data obtained by delaying $g_{n-1}(t)$×the $2^{n-1}$ power of G by a time equal to $2^{n-1}$ times the delay time τ is determined.

In regard to the nth stage in the filter part shown in FIG. 9, an operation is performed so that the input data (or signal) which is the output data of the previous stage is added to data (or a signal) obtained as a value in which the delay element with respect to this data (or signal) is set at $2^{n-1}$ times the abovementioned delay time τ, and the gain element is the $2^{n-1}$ power of the abovementioned G. Then, the output data $g_n(t)$ of the final stage is determined as the PLD fluctuation f(t). Furthermore, the recognition precision of the PLD fluctuation f(t) increases as the number of steps n is increased.

Figure 10:
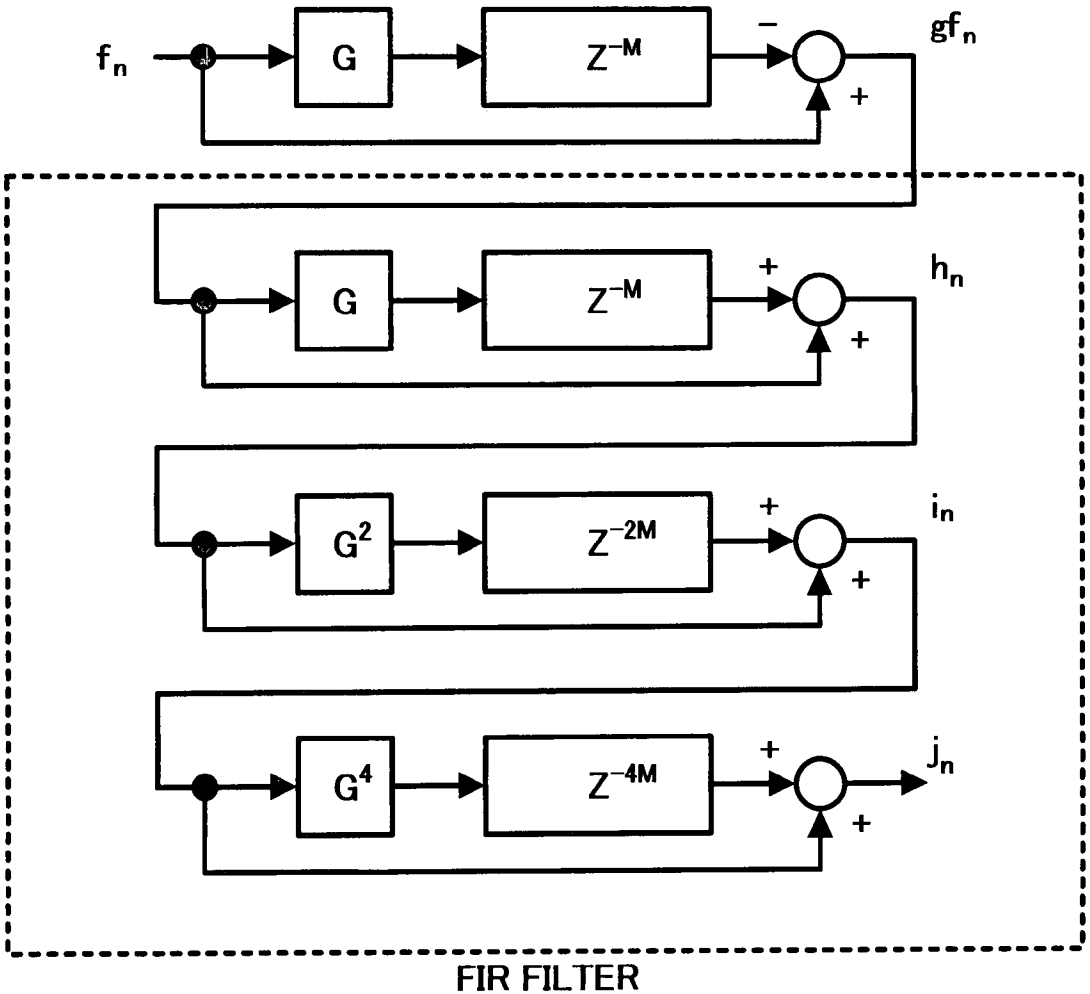
FIG. 10 is a block diagram showing the construction of the control system with the control system of FIG. 9 expressed in a Z conversion.

FIG. 10 is a control block diagram expressing the control block diagram shown in FIG. 9 in a Z conversion. Furthermore, in FIG. 10, gf(n) is expressed as $gf_n$, and f(n) is expressed as fn.

The sampling time of the input data that is input into filter part (FIR filter) shown in FIG. 10 is designated as Ts, the delay time τ is set as M×Ts (M is a natural number), and the time Tb required for the belt 103 to complete one revolution is set as N×Ts (N is a natural number). In this case, the sampling number during one revolution of the belt 103 is N. The PLD fluctuation f(t) determined in accordance with the control block diagram shown in this FIG. 10 comprises a data sequence of N PLD fluctuation values f(n) obtained for each sampling time Ts. Since the processing performed in the filter part in this case is digital processing, the filter processing can be performed using a DSP (digital signal processor), μCPU or the like.

Figure 11A:
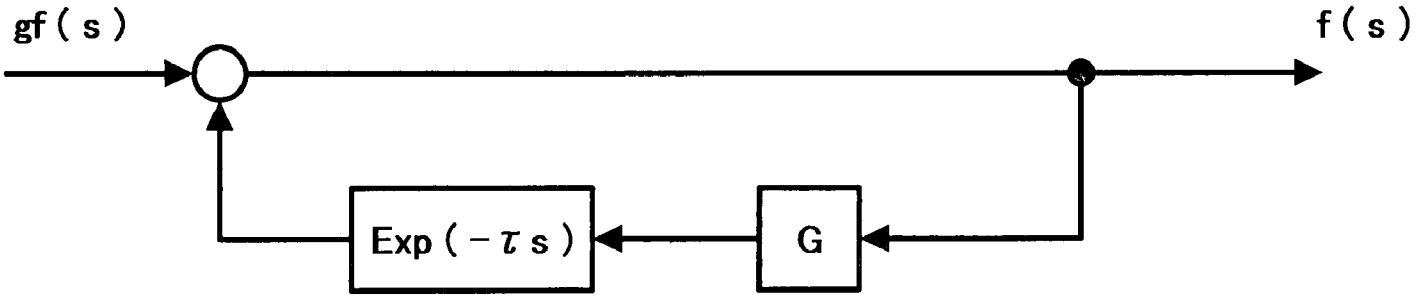
FIG. 11A is a block diagram showing the construction of a control system in which the control system of FIG. 9 expressed in another configuration (IIR type filter)
Figure 11B:
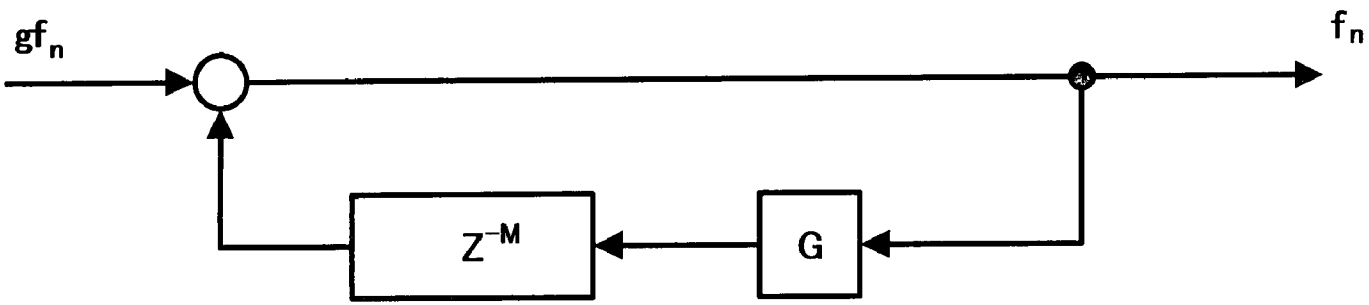
FIG. 11B is a block diagram showing the construction of a control system in which the control system of FIG. 11A is given a discrete expression for digital processing.

Furthermore, the FIR filter shown in FIG. 10 can also be replaced by an IIR filter. If the control block diagram shown in FIG. 10 is expressed as a continuous system, this system is as shown in FIG. 11A; if this is expressed in discrete terms for digital processing, the resulting system is as shown in FIG. 11B.

Thus, in regard to the respective rotational angular speeds $\omega_1$ and $\omega_2$ of the two abovementioned rollers 101 and 102, these rollers rotate while being affected by PLD fluctuations f(t) and f(t−τ) of respectively different phases; since the effective radii R and/or effective coefficients of PLD fluctuation κ of these rollers differ from each other, the proportions of the effective roller radii occupied by the PLD fluctuation components are respectively different. Accordingly, the magnitudes of the rotational angular speed fluctuations caused by the detected PLD fluctuations differ from each other. Noting this point, the present inventors discovered that the PLD fluctuation f(t) can be derived with a high degree of precision independently of the frequency characteristics using the abovementioned FIR filter or IIR filter and algorithm processing similar to that of these filters. Here, in order to derive the PLD fluctuation f(t), normalization was performed so that the coefficient of f(t) is 1. However, in cases where G is greater than 1, normalization may be performed so that the coefficient of the PLD fluctuation f(t−τ) is 1, and the derivation of the PLD fluctuation f(t−τ) may be accomplished by performing similar algorithm processing. In this case, the coefficient on the side of the PLD fluctuation f(t) is the reciprocal of G. In other words, if values are set so that t'=t−τ and τ'=Tb−τ (Tb is the time of one revolution of the belt), and the left side of the abovementioned Equation (27) is multiplied by (−1/G), then the right side can be expressed as f(t')−(1/G)f(t'−τ'); accordingly, the PLD fluctuation can be detected using an FIR filter or IIR filter in the same manner as described above.

Next, concrete belt driving control in which the fluctuation in the belt movement speed caused by the PLD fluctuation is controlled using the PLD fluctuation f(t) determined by the abovementioned recognition method 1 or the abovementioned recognition method 2 will be described.

In regard to concrete belt driving control using the PLD fluctuation f(t), a plurality of control methods are conceivable according to the construction of the apparatus. Here, two control examples, i.e., an example of control relating to an apparatus construction having a mechanism that detects the home position of the belt 103 (belt driving control example 1), and an example of control relating to an apparatus construction that does not have such a mechanism (belt driving control example 2), will be described.

(Belt Driving Control Example 1)

In order to perform appropriate belt driving control in accordance with the PLD fluctuation using the abovementioned PLD fluctuation f(t), it is necessary to grasp the phase of the PLD fluctuation in the belt 103 (i.e., the phase in a case where 1 circuit of the belt is designated as 2π). Methods for grasping this phase include a method in which a home position mark of the belt 103 is first predetermined, this mark is detected, and this phase is grasped using either time measurement information based on a timer, driving motor rotational angle information or rotational angle information based on the output of a rotary type encoder, as shown in this belt driving control example 1.

Figure 12:
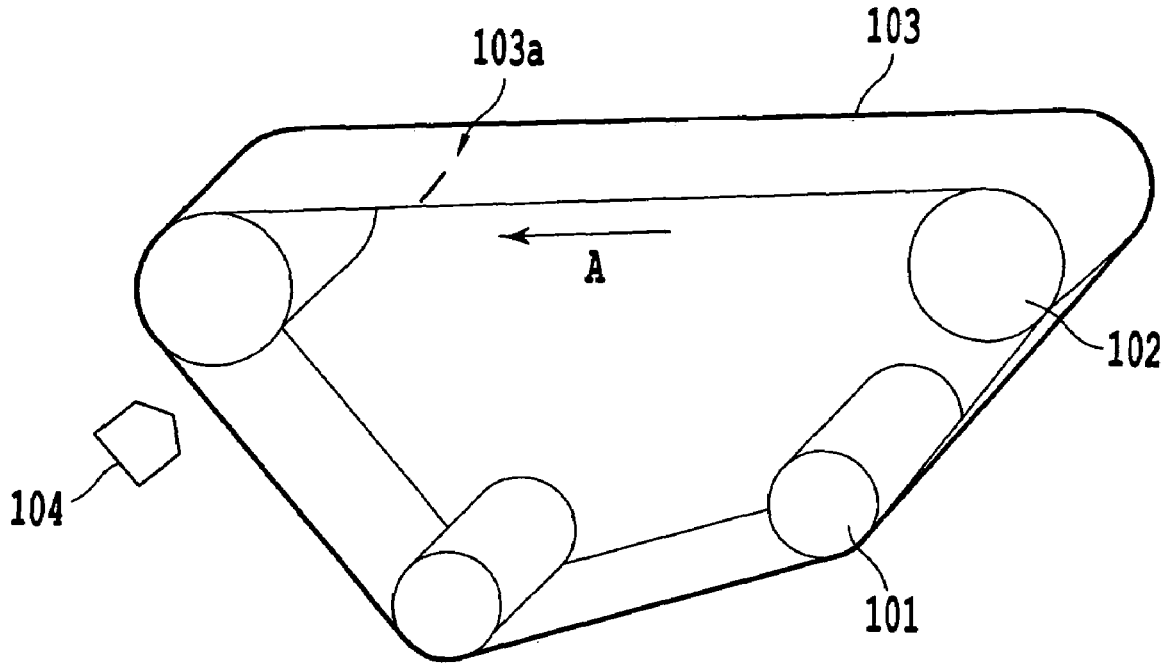
FIG. 12 is a model diagram showing the construction of a device used to detect the home position of the belt in belt driving control example 1.

FIG. 12 is a model diagram showing the construction of the apparatus used to detect the home position of the belt 103 in the present belt driving control example 1. In this control example 1, a home position mark 103*a* is formed on the belt 103, and the phase serving as a reference for 1 circuit of the belt is grasped by detecting this using a mark detecting sensor 104 used as mark detection means. In the present example, a metal film bonded to the belt 103 in a specified position is used as the home position mark 103*a*, and a reflective type photo-sensor which is fastened to a fixed member is used as the mark detecting sensor 104. This mark detecting sensor 104 outputs a pulse signal when the home position mark 103*a* passes through the detection region. The position where the home position mark 103*a* is formed is located on the inner circumferential surface of the belt or on the end portion (in the lateral direction) of the outer circumferential surface of the belt so that this mark does not affect image formation. There may be instances in which image forming substances such as toner, ink or the like adhere to the home position mark 103*a* or sensor surface of the mark detecting sensor 104. In such cases, there is a danger that the home position of the belt 103 may be erroneously recognized. In order to eliminate such erroneous recognition, it is desirable to add, to the mark detecting sensor 104, a function which is used to recognize the belt home position while controlling the sensor output amplitude, pulse width or pulse interval. Furthermore, at least one home position mark 103*a* is necessary; it would also be possible to form a plurality of such marks, and to pattern these marks so that the elimination of erroneous recognition is facilitated.

Figure 13:
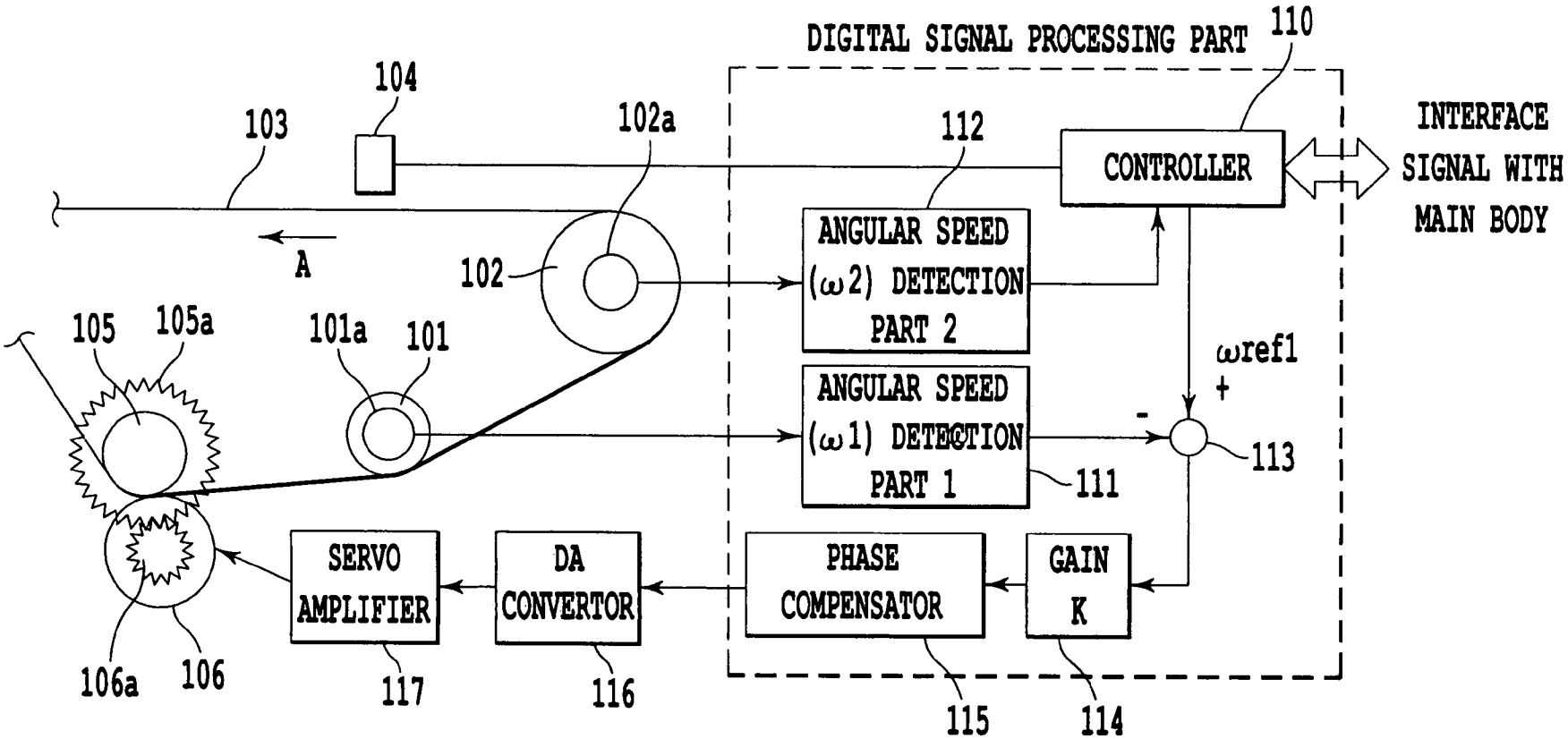
FIG. 13 is a diagram used to illustrate the control operation of the same belt driving control example 1.

FIG. 13 is an explanatory diagram which is used to illustrate the control operation of this belt driving control example 1. Furthermore, in the example shown in this figure, for convenience of description, the position of the mark detecting sensor 104 is different from the position shown in FIG. 12.

The rotational driving force that is generated by the driving motor 106 is transmitted to the driving roller 105 via a speed reduction mechanism comprising a driving gear 106*a* and a driven gear 105*a*. As a result, the driving roller 105 rotates so that the belt 103 moves in the direction indicated by the arrow A in the figure. As a result of this movement of the belt 103, the first roller 101 and second roller 102 perform a following rotation. Rotary type encoders 101*a* and 102*a* are respectively installed on these rollers 101 and 102, and the output signals of these encoders are input into the angular speed detection parts 111 and 112 of a digital signal processing part. These rotary type encoders may also be connected via a speed reduction device such as a gear or the like. A surface treatment is performed, and the belt winding angle and the like are set, so that there is no slipping between the first roller 101 and second roller 102 and the inner circumferential surface of the belt 103. In the present example, the diameter of the second roller 102 is larger than that of the first roller 101. The data control signals that are calculated and output by the digital signal processing part are input into a servo amplifier 117 via a DA converter 116, and the driving motor 106 is driven in accordance with these control signals.

In the digital signal processing part, the first angular speed detection part 111 detects the rotational angular speed $\omega_1$ of the first roller 101 from the output signal of the first rotary type encoder 101*a*. Similarly, the second angular speed detection part 112 detects the rotational angular speed $\omega_2$ of the second roller 102 from the output signal of the second rotary type encoder 102*a*. The controller 110 calculates the control target value $\omega_{ref1}$ on the basis of the PLD fluctuation data of the belt 103 in accordance with target belt speed commands from the copying machine main body. In concrete terms, the belt 103 is first driven so that the rotational angular speed $\omega_1$ of the first roller 101 is maintained at the command control target value $\omega_{ref1}$ based on commands from the copying machine main body. Specifically, the belt 103 is driven so that rotational angular speed $\omega_1$ of the first roller 101 is maintained at a constant speed. Accordingly, the command control target value $\omega_{ref1}$ in this case is the abovementioned constant rotational angular speed $\omega_{01}$. If the rotational angular speed $\chi_2$ of the first roller 101 is constant, the data for the PLD fluctuation f(t) can be acquired from the rotational angular speed $\omega_2$ of the second roller 102 by the abovementioned recognition method 1 or the abovementioned recognition method 2 using the pulse signals from the mark detecting sensor 104 as a reference. Then, an appropriate correction control target value $\omega_{ref1}$ is generated and output in accordance with the data for this PLD fluctuation f(t).

The correction control target value $\omega_{ref1}$ thus output from the controller 110 is compared with the rotational angular speed $\omega_1$ of the first roller 101 by a comparator 113, and the deviation is output from the comparator 113. This deviation is input into the gain (K) 114 and phase compensator 115, and a motor control signal is output from the phase compensator 115. The deviation that is input into the gain (K) is the deviation between the control target value $\omega_{ref1}$ correcting the PLD fluctuation of the belt 103 and the detected rotational angular speed $\omega$ of the first roller 101. In the present embodiment, this deviation is generated by slipping between the driving roller 105 and belt 103, driving transmission error caused by the eccentricity of the driving gear 106*a* and driven gear 105*a* or the like, fluctuation in the belt movement speed caused by the eccentricity of the driving roller 105 and the like. The driving motor 106 is driven by the motor control signals so that this deviation is reduced and the belt 103 moves at a uniform speed. Accordingly, for example, an adjustment is performed using a PID control device so that the deviation of the belt 103 that is the object of control with respect to the target speed is reduced, and so that the system is stabilized with no overshoot or oscillation.

In order to maintain the belt movement speed V at a constant speed $V_0$, it is sufficient to control the rotational angular speed $\omega_1$ of the first roller 101 so that this speed is as shown in the following Equation (34). Furthermore, if the rotational angular speed $\omega_2$ of the second roller 102 is controlled, this control is performed so that this speed is as shown in the following Equation (35).

$$j(t)=f(t)-G^8f(t-8\tau) \quad \text{Eq. (34)}$$

$$\epsilon_3=-G^8f(t-8\tau) \quad \text{Eq. (35)}$$

In this belt driving control example 1, even if there is a fluctuation in the PLD in the circumferential direction of the belt 103, the system is controlled so that the rotational angular speed $\omega_1$ of the first roller 101 is the correction control target value $\omega_{ref1}$ corrected by the PLD fluctuation f(t). Accordingly, the fluctuation in the belt movement speed caused by the PLD fluctuation can be controlled.

(Belt Driving Control Example 2)

Next, [the abovementioned] belt driving control example 2 in which the mechanism for detecting the home position shown in FIG. 12 is eliminated so that a reduction in cost is achieved will be described.

The basic processing is the same as that in the abovementioned belt driving control example 1; however, in this belt driving control example 2, the home position of the belt 103 is grasped using a virtual home position signal that is used to specify the home position of the belt 103 in virtual terms instead of the pulse signals of the mark detecting sensor 104. For example, the completion of one revolution by the belt 103 from an arbitrary position is predicted using the cumulative rotational angle of the rollers obtained by the rotary type encoders 101*a* and 102*a* or the like as a virtual home position signal. In this case, since the cumulative rotational angle in a case where the rollers rotate during one revolution of the belt 103 can be grasped beforehand, the completion of one revolution by the belt 103 can be predicted from the cumulative rotational angle. In this case, the point in time at which the count of the cumulative rotational angle is initiated is t=0 in the PLD fluctuation f(t). Furthermore, this point in time corresponds to the time at which a pulse signal from the mark detecting sensor is received in the abovementioned belt driving control example 1.

Furthermore, in the present belt driving control example 2, the prediction of the completion of one revolution by the belt 103 shows the generation of an error with respect to the actual value due to the part precision, such as the roller diameter or $PLD_{ave}$ (which is the average value of the PLD of the belt), changes in the environment, changes in parts over time and the like.

To describe this in detail, the abovementioned virtual home position signal is set so that this signal is generated with each rotational period of the belt 103. Various methods are conceivable as this setting method besides the abovementioned cumulative rotational angles of the rollers. For example, a method is conceivable in which the completion of one revolution by the belt 103 from an arbitrary position is predicted using the cumulative rotational angle of the driving motor 106, and the system is set so that a virtual home position signal is generated when a cumulative rotational angle corresponding to one revolution of the belt is reached. Furthermore, if the belt 103 moves at a predetermined average movement speed, a method is conceivable in which time required for one revolution of the belt is predicted from this average movement speed, and the system is set so that a virtual home position signal is generated when the time corresponding to one revolution of the belt is reached.

If there is an error between one revolution of the belt as predicted from the virtual home position signal and the actual revolution of the belt, the phase of the PLD fluctuation f(t) shows a cumulative deviation. Accordingly, if the abovementioned belt driving control is performed using the data of the PLD fluctuation f(t), a fluctuation will be generated in the belt movement speed, and this fluctuation will be increased to a large value.

To describe this point in greater detail, even in cases where the PLD fluctuation f(t) is determined with reference to the virtual home position signal, if the target rotational angular speed of the first roller 101 is controlled by $\omega_{ref1}$ shown in the abovementioned Equation (34), the rotational angular speed $\omega_2$ detected for the second roller 102 must be $\omega_{ref2}$ indicated in the abovementioned Equation (35). Here, assuming that that the virtual home position obtained from the virtual home position signal deviates from the actual home position by a time of d, then the belt movement speed $V_d$ in this case is as shown in the following Equation (36).

$$V_0 = \{R_1 + \kappa_1 f(t)\}\omega_1 \quad \text{Eq. (36)}$$

$$\omega_1 = \frac{V_0}{\{R_1 + \kappa_1 f(t)\}} \cong \frac{V_0}{R_1}\left\{1 - \frac{\kappa_1}{R_1} f(t)\right\} = \omega_{ref1}$$

If the abovementioned Equation (34) is substituted into this Equation (36) so that the equation is transformed, the following Equation (37) is obtained.

$$\omega_2 \cong \frac{V_0}{R_2}\left\{1 - \frac{\kappa_2}{R_2} f(t-\tau)\right\} = \omega_{ref2} \quad \text{Eq. (37)}$$

The rotational angular speed $\omega_{2d}$ of the second roller 102 in this case is as shown in the following Equation (38).

$$V_d = \{R_1 + \kappa_1 f(t-d)\}\omega_{ref1} \quad \text{Eq. (38)}$$

Furthermore, if the abovementioned Equation (37) is inserted into this Equation (38) so that the equation is transformed, the following Equation (39) is obtained.

$$V_d \cong V_0\left\{1 + \frac{\kappa_1}{R_1}(f(t-d) - f(t))\right\} \quad \text{Eq. (39)}$$

Accordingly, the amount of deviation $\omega_{2\delta}$ in the rotational angular speed of the second roller 102 resulting from the fact that the virtual home position obtained from the virtual home position signal deviates from the actual home position by a time of d is as shown in the following Equation (40). The amount of deviation $\omega_{2\delta}$ in the rotational angular speed of the second roller can be determined as the difference between the rotational angular speed detection data $\omega_{2d}$ for the second roller and the reference data $\omega_{ref2}$ that should exist for the second roller.

$$\omega_{2d} = \frac{V_d}{\{R_2 + \kappa_2 f(t-\tau-d)\}} \quad \text{Eq. (40)}$$

If the abovementioned Equation (36) and the abovementioned Equation (39) are substituted into this Equation (40) so that the equation is transformed, the following Equation (41) is obtained.

$$\omega_{2d} \cong \frac{V_0}{R_2}\left\{1 - \frac{\kappa_2}{R_2} f(t-\tau-d) + \frac{\kappa_1}{R_1}(f(t-d) - f(t))\right\} \quad \text{Eq. (41)}$$

It is seen that the amount of deviation $\omega_{2\delta}$ appearing in the abovementioned Equation (41) is the result of the superimposition of a fluctuation component (first term) generated as a result of the fact that the virtual home position deviates from the actual home position by a time of d in the first roller 101, and a fluctuation component (second term) generated as a result of the fact that the virtual home position similarly deviates from the actual home position by a distance of d in the second roller 102.

When the absolute value of this deviation amount $\omega_{2\delta}$ exceeds a fixed value, the amount is again corrected, or a correction is again performed when the absolute value of the average, squared average or square root of the squared average of the deviation amount $\omega_{2\delta}$ for one circuit of the belt exceeds a fixed value. This correction is accomplished by detecting the rotational angular speed $\omega_2$ of the second roller 102 in a state in which the rotational angular speed $\omega_1$ of the first roller 101 is controlled to a fixed rotational angular speed $\omega_{01}$, determining a new PLD fluctuation f(t) by means of this, and then performing a control action using the data of this f(t) so that the rotational angular speed $\omega_1$ of the first roller 101 coincides with the reference rotational angular speed $\omega_{ref1}$.

(Updating of PLD Fluctuation)

Next, the control that is used when the determined PLD fluctuation f(t) is updated will be described.

Depending on the belt material, the belt thickness may vary as a result of changes in the environment (temperature and humidity) and wear caused by use over time, the Young's modulus may vary as a result of repeated bending and stretching, and there may be cases in which the PLD of the belt 103 varies over time, so that the PLD fluctuation of the belt 103 is caused to vary. Moreover, there are also cases in which the replacement of the belt 103 results in a variation of the PLD fluctuation from the PLD fluctuation prior to this replacement. Furthermore, there are also cases in which the virtual home position deviates from the actual home position as in the abovementioned belt driving control example 2. In such cases, it is necessary to update the PLD fluctuation f(t).

In a broad classification, there are two conceivable methods for updating the PLD fluctuation f(t), i.e., a method in which updating is performed intermittently, and a method in which updating is performed continuously. A method in which monitoring is performed in order to determine whether or not belt driving control based on the PLD fluctuation f(t) is being appropriately performed, and the PLD fluctuation f(t) is updated only in cases where it is judged that such control is not being appropriately performed, may be cited as an example of the former type of method. Furthermore, a method in which the PLD fluctuation f(t) is periodically updated without performing such monitoring may also be cited as an example of this type of method. A method in which the PLD fluctuation f(t) is constantly determined, and this PLD fluctuation f(t) is continuously updated, may be cited as an example of the latter type of method.

Here, the principle whereby updating is performed for the PLD fluctuation f(t) once determined will first be described.

Assuming that the PLD fluctuation f(t) has once been accurately determined, the rotational angular speed ω of the first roller 101 is maintained at $\omega_{ref1}$ shown in the abovementioned Equation (34). Here, when the actual PLD fluctuation f(t) has varied to g(t), the variation $\omega_{2\epsilon}$ in the rotational angular speed of the second roller 102 is as shown in the following Equation (42).

$$\omega_{2\delta}=\omega_{2d}-\omega_{ref2} \quad \text{Eq. (42)}$$

This may be said to be the result of the superimposition of a fluctuation component (first term) generated in the first roller 101 as a result of the variation of the PLD fluctuation f(t) to g(t), and a fluctuation component (second term) generated in the second roller 102 as a result of the variation of the PLD fluctuation f(t) to g(t), as in the abovementioned Equation (41). Accordingly, the updating method used in a case where the PLD fluctuation f(t) varies to g(t) (shown below) is capable of performing a correction that includes the error caused by the deviation of the virtual home position as in the abovementioned belt driving control example 2.

If the abovementioned Equation (42) is transformed using the abovementioned Equation (43), then the following Equation (44) is obtained. "G" in this Equation (44) is the same as that shown in the abovementioned Equation (27).

$$\omega_{2\delta}=\frac{V_0}{R_2}\left[\frac{\kappa_1}{R_1}\{f(t-d)-f(t)\}-\frac{\kappa_2}{R_2}\{f(t-\tau-d)-f(t-\tau)\}\right] \quad \text{Eq. (43)}$$

$$\omega_{2\varepsilon}=\frac{V_0}{R_2}\left[\frac{\kappa_1}{R_1}\{g(t)-f(t)\}-\frac{\kappa_2}{R_2}\{g(t-\tau)-f(t-\tau)\}\right] \quad \text{Eq. (44)}$$

The abovementioned $\epsilon(t)$ can be detected by shortening the inter-roller distance between the first roller 101 and second roller 102 as in the abovementioned recognition method 1, or can be detected by filter processing as in the abovementioned recognition method 2, and can thus be determined on the basis of the abovementioned deviation amount $\omega_{2\epsilon}$. Then, when this $\epsilon(t)$ has been determined, a new PLD fluctuation f'(t) in which $\epsilon(t)$ is added to the PLD deviation f(t) prior to variation is determined. The new PLD fluctuation f'(t) is as shown in the following Equation (45), and is equal to the PLD fluctuation g(t) following variation.

$$\epsilon(t)=g(t)-f(t) \quad \text{Eq. (45)}$$

Accordingly, if belt driving control is performed using the newly determined PLD fluctuation f'(t) instead of the PLD fluctuation f(t), appropriate belt driving control corresponding to the PLD fluctuation g(t) following variation can be performed.

Here, furthermore, a method was described in which the abovementioned $\epsilon(t)$ was determined from the abovementioned and the PLD fluctuation f(t) was corrected to g(t) using this $\epsilon(t)$. However, it would also be possible to use a method in which updating is performed by directly determining this g(t).

Next, the installation locations of the rotary type encoders used to detect the rotational angular speeds $\omega_1$ and $\omega_2$ of the two abovementioned rollers 101 and 102 that are required in order to perform the abovementioned belt driving control will be described.

In the abovementioned belt driving control, if the rotational angular speeds of two rollers with different diameters (strictly speaking, in which the recognition sensitivity $\beta$ shown in the abovementioned Equation (6) is not zero, or G shown in the abovementioned Equation (27) is not 1) can be detected, then the fluctuation in the belt movement speed caused by the PLD fluctuation of the belt 103 can be controlled. For example, there are three conceivable locations for the installation of the rotary type encoders used to detect these rotational angular speeds. The first is a case in which the rotary type encoders are installed on two driven rollers (with different diameters) other than the driving roller 105, as shown in FIG. 13 (rotary type encoder installation example 1). The second is a case in which the rotary type encoders are installed on the driving roller 105 and one of the driven rollers which has a different diameter than this driving roller (rotary type encoder installation example 2). The third is a case in which the rotary type encoders are installed on the driving roller 105 and two driven rollers 101 and 102 with different diameters, or in which the rotary type encoders are further installed on the driving roller 105 and driven rollers 101 and 102 whose diameters differ from that of the this driving roller (rotary type encoder installation example 3). Furthermore, cases in which a rotary type encoder is installed on the driving roller 105 include not only cases in which this rotary type encoder is installed on the roller shaft of the driving roller 105, but also cases in which this rotary type encoder is installed on the motor shaft of the driving motor 106.

(Rotary Type Encoder Installation Example 1)

In the present installation example 1, as is shown in FIG. 13, rotary type encoders are installed on two driven rollers 101 and 102 having mutually different diameters. In this case, as was described above, the system has a function which allows feedback control so that the rotational angular speed $\omega_1$ of the first roller 101 assumes the control target value $\omega_{ref1}$ determined by the controller 110. Accordingly, the PLD fluctuation f(t) can be obtained with a high degree of precision in a state in which the transmission error of the driving transmission system and the slipping between the driving roller and the belt are corrected. For example, by determining the PLD fluctuation f(t) from the detection results for the rotational angular speed $\omega_2$ of the second roller 102 in a state in which the driving roller is thus feedback-controlled, it is possible to obtain the PLD fluctuation f(t) with a high degree of precision regardless of the transmission error of the driving transmission system or slipping between the driving roller 105 and belt 103.

(Rotary Type Encoder Installation Example 2)

Figure 14:
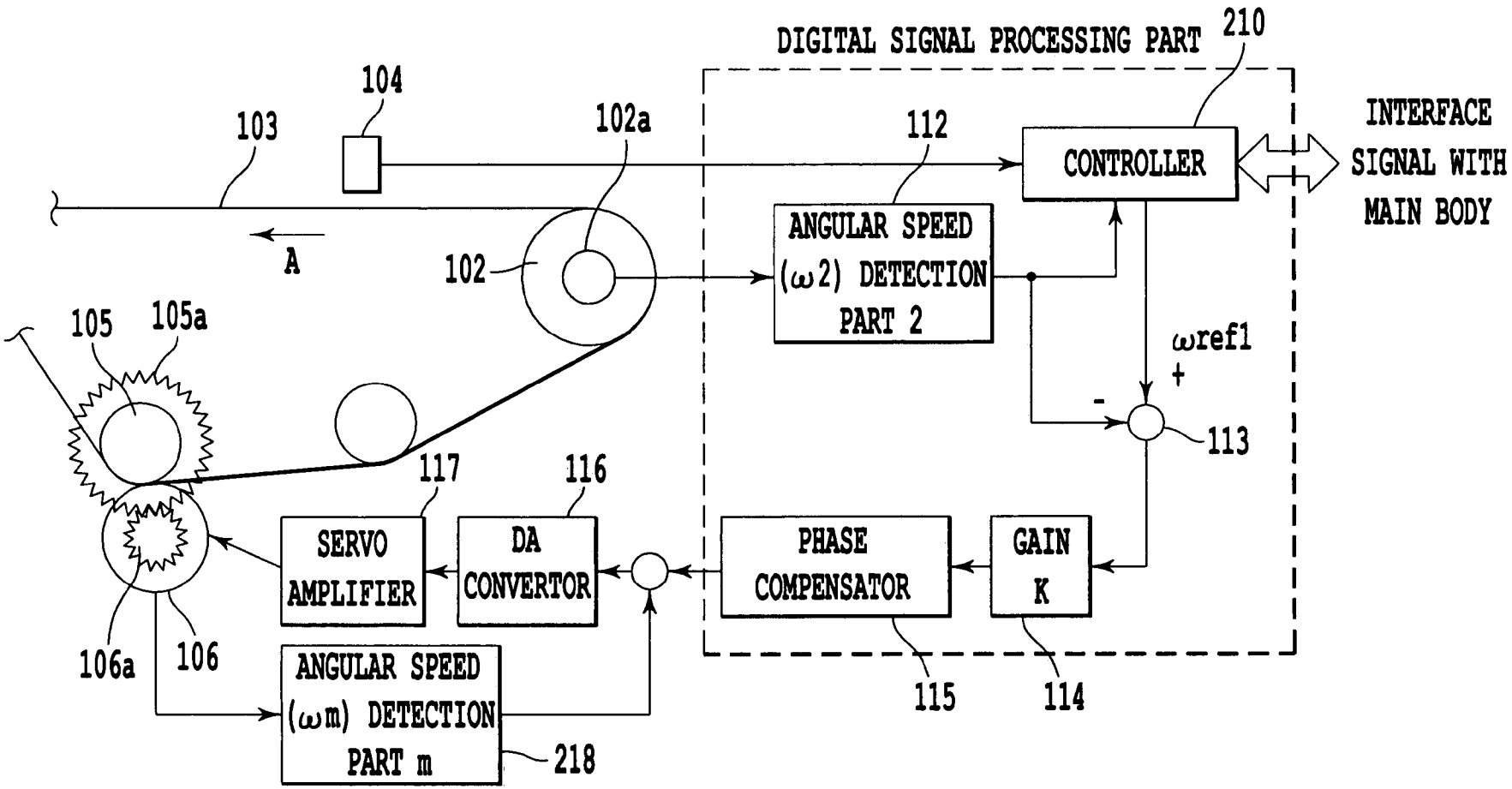
FIG. 14 is a diagram used to illustrate the control operation in rotary type encoder installation example 2.

FIG. 14 is an explanatory diagram which is used to illustrate the control operation in this installation example 2.

In this installation example 2, the motor and driving roller are connected via a gear; here, a DC servo motor is used as the driving motor 106, and the encoder is attached to either the motor shaft or the driving roller shaft, and the system has a function that allows feedback correction by detecting the rotational angular speed. In addition to a DC servo motor, a stepping motor in which the rotational angular speed can be controlled by the frequency of input driving pulses may be employed. In this case, since the rotational angular speed can be controlled by the frequency of the driving pulses input into the stepping motor even without encoder feedback, there is no need to install an encoder on the motor shaft or driving roller. In the present installation example 2 as well, the rotational angular speeds $\omega_m$ and $\omega_2$ of the driving roller 105 and driven roller 102 can be detected. At the rotational angular speed $\omega_m$ of the motor shaft, rotation can be accomplished with the rotational angular speed of the driving roller 105 in a fixed relationship. Accordingly, the rotational angular speed $\omega_m$ of this motor shaft corresponds to the rotational angular speed $\omega_1$ of the first roller 101 in the abovementioned installation example 1. However, in cases where a speed reduction mechanism is provided, this corresponds to the rotational angular speed $\omega_1$ in a state in which the speed reduction ratio is taken into account. As a result, in this installation example 2, as in the abovementioned installation example 1, the PLD fluctuation f(t) can be obtained with a high degree of precision. However, in this installation example 2, the rotational angular speed $\omega_2$ of the second roller 102 detected by the angular speed detection part 112 includes fluctuations caused by the error of the driving transmission system and slipping between the driving roller 105 and the belt 103; accordingly, it is necessary to determine the PLD fluctuation f(t) with these fluctuations alleviated. In particular, the coefficient of friction is increased by roughening the surfaces of the rollers or the like so that slipping does not occur between the driving roller 105 and the belt 103. However, in the present installation example 2, since there is no need to install a rotary type encoder 102*a* on the driven roller 102, the number of required parts is correspondingly decreased, so that a low cost can be achieved compared to the abovementioned installation example 1.

(Rotary Type Encoder Example 3)

Figure 15:
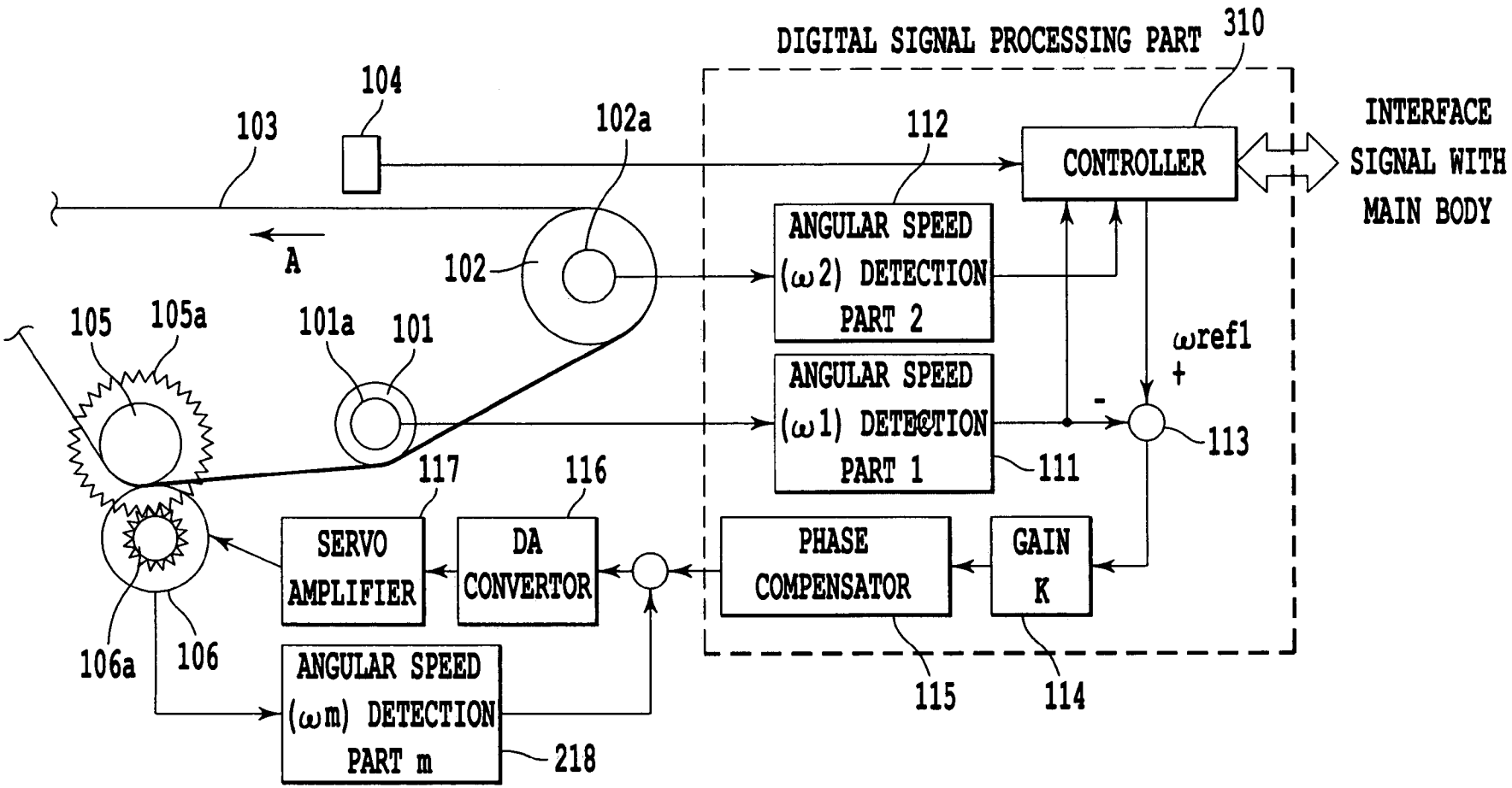
FIG. 15 is a diagram used to illustrate the control operation in rotary type encoder installation example 3.

FIG. 15 is an explanatory diagram which is used to illustrate the control operation that is performed in the present installation example 3.

In the present installation example 3, as in the abovementioned installation example 2, a motor that allows driving control of the rotational angular speed, such as a DC servo motor or stepping motor, is used as the driving motor 106. Furthermore, in the present installation example 3, as in the abovementioned installation example 1, rotary type encoders 101*a* and 102*a* are respectively installed on two driven rollers 101 and 102 which have mutually different diameters. Accordingly, in the present installation example 3, as in the abovementioned installation example 1 [sic], the PLD fluctuation f(t) can be obtained with a high degree of precision comparable to that achieved in the abovementioned installation example 1. In addition, in the present installation example 3, the construction used is a construction that acquires information relating to the rotational angular speed $\omega_m$ of the motor shaft, i.e., a construction that takes a minor loop, so that a more stable control system can be designed.

Furthermore, by determining the average rotational angular speeds of the first roller 101 and second roller 102 while the motor shaft rotates at a constant rotational angular speed, i.e., while the driving roller 105 is driven at a constant rotational angular speed, it is possible to determine the average rotational angular speeds of the first roller 101 and second roller 102, so that the diameter ratio of the first roller 101 and second roller 102 can be accurately determined. Accordingly, even if the diameters of the first roller 101 and second roller 102 show manufacturing variation, or if there are variations in the environment or variations over time so that the effective roller radii $R_1$ and $R_2$ of the respective rollers used in the determination of the PLD fluctuation f(t) deviate from the actual values, this diameter ratio can be corrected.

As was described above, the effective roller radius R here indicates ($r+PLD_{ave}$), so that the roller radius fluctuates according to variation in $PLD_{ave}$. In the abovementioned Equation (25), the effective roller radius R is an important parameter, and the precision of detection of the PLD fluctuation increases as the precision of this ratio increases. This is also true in cases where recognition method 1 is used in the abovementioned Equation (5). The ratio of the effective roller radii R of the first roller 101 and second roller 102 can also be obtained by determining the rotational angular speed ratio or rotational angular ratio of the first roller 101 and second roller 102 with the first roller 101 controlled to a constant rotational angular speed; accordingly, it may be said that the same is true of the abovementioned rotary type encoder installation examples 1 and 2 as well. Furthermore, in rotary type encoder installation example 3, the effective coefficients of PLD fluctuation $\kappa_1$ and $\kappa_2$ of the respective rollers 101 and 102 can also be corrected. Specifically, the PLD fluctuation $f_2(t)$ is determined using the rotational angular speeds $\omega_d$ and $\omega_2$ of the driving roller 105 and second roller 102. Further, the PLD fluctuation $f_1(t)$ is determined using the rotational angular speeds $\omega_d$ and $\omega_1$ of the driving roller 105 and first roller 101. The two PLD fluctuations $f_1(t)$ and $f_2(t)$ thus determined are for the same belt 103; inherently, therefore, these values should be equal. However, assuming that the effective roller radii $R_1$ and $R_2$ of the respective rollers 101 and 102 are accurate, then there may be cases in which these values are not equal because of error in the set values of the effective coefficients of PLD fluctuation $\kappa_1$ and $\kappa_2$. In such cases, if the ratios $p\kappa_1$ ($\kappa_1/\kappa_d$) and $p\kappa_2$ ($=\kappa_2/\kappa_d$) ($\kappa_d$: effective coefficient of PLD fluctuation in the driving roller part) which are such that the two abovementioned PLD fluctuations $f_1(t)$ and $f_2(t)$ coincide with each other are determined, and the ratio $\kappa_2/\kappa_1$ of the effective coefficients of PLD fluctuation is corrected, the ratio $R_1/R_2$ of the effective roller radii can be obtained with a high degree of precision as described above; accordingly, it is seen from the abovementioned Equation (27) that a highly precise PLD fluctuation f(t) can be recognized. This is effective in cases where either the effective roller radius or effective coefficient of PLD fluctuation of the first roller 101 tends to fluctuate from that of the second roller.

Here, the method used to determine the actual coefficients of PLD fluctuation $\kappa$ of the first roller 101 and second roller 102 will be described. The relationship between the driving roller 105 and first roller 101 can be expressed by the following Equations (46) and (47) so that this relationship can easily be estimated by the abovementioned Equation (25). Furthermore, the relationship between the driving roller 105 and second roller 102 can be expressed by the following Equations (48) and (49).

$$\omega_{2\varepsilon} = \frac{V_0\kappa_1}{R_1 R_2}[\varepsilon(t) - G\varepsilon(t-\tau)] \quad \text{Eq. (46)}$$

$$f'(t) = f(t) + \varepsilon(t) = f(t) + g(t) - f(t) = g(t) \quad \text{Eq. (47)}$$

Here, $\omega_d$ is the rotational angular speed of the driving roller, $R_d$ is the effective radius of the driving roller, and $\tau_1$ is the delay time determined by the passage of the belt between the driving roller 105 and the first roller 101.

$$h_{out1}(t)=f(t)-G_1^{2^{n-1}}f(t-2^{n-1}\tau_1) \quad \text{Eq. (48)}$$

$$h_{out2}(t)=f(t)-G_2^{2^{n-1}}f(t-2^{n-1}\tau_2) \quad \text{Eq. (49)}$$

Here, $\tau_2$ is the delay time determined by the passage of the belt between the driving roller 105 and the second roller 102.

Here, the system is devised so that the ratios $pR_1$ and $pR_2$ of the effective roller radii are determined by the method described above, $R_2$ on the left side of the abovementioned Equation (48) is replaced with $R_2=(pR_1/pR_2)\,R_1$, and the ratio of the effective coefficients of PLD fluctuation $p\kappa_1=\kappa_1/\kappa_d$ or $p\kappa_2=\kappa_2/\kappa_d$ corresponding to the PLD fluctuation effective coefficient $\kappa_1$ or $\kappa_2$ that tends more to fluctuate is altered, so that the PLD fluctuation calculation results are $f_1(t)=f_2(t)$. Then, the numerical ratio $\kappa_2/\kappa_1$ of the effective coefficients of PLD fluctuation of the first roller and second roller is determined from the respective effective coefficient ratios thus determined ($p\kappa_2/p\kappa_1=(\kappa_2/\kappa_d)/(\kappa_1/\kappa_d)=\kappa_2/\kappa_1$). As a result, an even higher-precision PLD fluctuation f(t) can be recognized. The effective roller radius $R_1$ on the left side of the abovementioned Equation (46) shows little fluctuation, and if this is obtained beforehand, the precision is increased even further. Alternatively, the effective roller radius $R_2$ on the left side of the abovementioned Equation (48) shows little fluctuation, and if this is obtained beforehand, the precision is similarly further increased. However, in the detection of rotation information for the purpose of calculating this effective roller radius ratio and PLD fluctuation effective coefficient ratio, it is advisable to perform low-speed driving in order to slipping with the belt in the driving roller parts.

(Concrete Example 1)

Next, concrete example 1 regarding the updating of the PLD fluctuation f(t) will be described. This concrete example 1 is an example of a case in which there is no mechanism for detecting the home position of the belt 103 (as in the abovementioned recognition method 2), and in which a rotary type encoder is also installed on the motor shaft of the driving motor 106 so that driving control can be performed as in the abovementioned rotary type encoder installation example 3, and rotary type encoders 101*a* and 102*a* are respectively installed on two driven rollers 101 and 102 with mutually different diameters. Of course, as was described above, working is also possible using a construction in which a rotary type encoder is not installed on the motor shaft.

FIG. 11 is an explanatory diagram used to illustrate the updating processing in this concrete example 1. Furthermore, in this figure, the rotary type encoder 106*b* installed on the driving motor 106 is disposed in the DC servo motor used as this driving motor 106. Furthermore, the digital signal processing part used as control means (which is surrounded by a broken line in the figure) is constructed from a digital circuit, DSP, μCPU, RAM, ROM, FIFO (fast in fast out) or the like. Of course, the concrete hardware construction is not limited to this. Depending on the control block in the figure, processing may also be performed by the operation of firmware in some cases.

In this concrete example 1, since there is no mechanism for detecting the home position of the belt 103, the virtual home position deviates so that a phase error is generated as described in the abovementioned recognition method 2. Furthermore, there is also a danger that the actual PLD fluctuation of the belt 103 may vary according to changes in the environment or changes over time. Accordingly, there is a need to update PLD fluctuations f(t) determined in the past. In the present concrete example 1, whether intermediate updating is performed or continuous updating is performed can be determined in accordance with the load on the calculation processing part such as the CPU or the like.

In the present concrete example 1, in cases where updating is performed intermittently, it is monitored whether or not the precision of the PLD fluctuation f(t) is within a fixed permissible range by checking the fluctuation in the belt movement speed, and when this permissible range is exceeded, processing that updates the PLD fluctuation f(t) is performed. In concrete terms, as was described above, a judgment is performed as to whether or not the absolute value of $\epsilon(t)$ shown in the abovementioned Equation (43), the average of this absolute value, the squared average or the square root of the squared average is within a predetermined permissible range, and in cases where this value exceeds this permissible range, processing that updates the PLD fluctuation f(t) is performed. Of course, processing that performs updating at fixed intervals may also be performed in accordance with the operating time or amount of operation of the copying machine. Furthermore, in cases where the absolute value of $\epsilon(t)$, the average of this absolute value, the squared average or the square root of the squared average is still outside of the abovementioned permissible range even if updating processing is performed, this means that there is a mistake in the various initial values that are assumed; accordingly, an error is reported.

To describe this in detail, the controller 410 first switches off the switches SW1 and SW2, compares the reference signal data $\omega_{01}$ ($=V_0/R_1$) for the rotational angular speed and the rotational angular speed $\omega_1$ of the first roller 101 detected by the angular speed detection part 111, and drives the belt 103 so that the first roller 101 is maintained at the fixed rotational angular speed $\omega_{01}$. The two phase compensators 115*a* and 115*b* function so that error is constantly eliminated, and stable feedback control is performed. When the rotational angular speed $\omega_1$ of the first roller is the constant rotational angular speed oil, the rotational angular speed $\omega_2$ of the second roller 102 determined by the angular speed detection part 112 is as shown in the following Equation (50) (from the abovementioned Equation (27)). "G" in this Equation (50) is the same as that shown in the abovementioned Equation (27). Furthermore, in this concrete example 1, since digital processing is assumed, tn which expresses the time t in discrete terms is used instead of the time t. Accordingly, the abovementioned PLD fluctuation f(t) is replaced by f(tn).

$$h_{out1}(t)-h_{out2}(t)=G_2^{2^{n-1}}f(t-2^{n-1}\tau_2)-G_1^{2^{n-1}}f(t-2^{n-1}\tau_1) \qquad \text{Eq. (50)}$$

The PLD fluctuation f(tn) is determined from the rotational angular speed $\omega_2$ of this second roller 102, and processing is performed that stores the data for one circuit of the belt in the FIFO 419 used as fluctuation information storage means. In this processing, first of all, in a state in which the switches SW1 and SW2 are off, the fixed data $(R_1\times\omega_{01})/R_2$ calculated by the block 1302 is subtracted by the subtractor 1313 from the detected rotational angular speed $\omega_2$ of the second roller 102. Then, the value output by this subtractor 1313 is multiplied by the fixed data $R_2/(\kappa_1\times\omega_{01})$ in the block 1304, and this output data is input into the FIR filer (or IIR filter) of the block 1315. In other words, the output data of the block 1304 is f(tn)−Gf(tn−τ), and this data is input into the FIR filter (or IIR filter). The output of this filter consists of the respective data (PLD fluctuation data) fn constructing the data sequence of the PLD fluctuation f(tn). The controller 410 monitors the rotational angular speed $\omega_1$ of the first roller 101, and switches the switch SW1 on when this rotational angular speed $\omega_1$ is a uniform speed, and the time during which accurate PLD fluctuation data fn is output from the FIR filter (or IIR filter) has elapsed. The reason for this is that since a delay element is included in both the FIR filter and IIR filter, the output of accurate PLD fluctuation data fn is not performed in the initial stage of filter execution. Then, the controller 410 counts the number of encoder output pulses for the first roller 101, and when it is confirmed that the belt 103 has completed one revolution, the controller 410 switches the switch SW1 off. The PLD fluctuation data fn output from the FIR filter (or IIR filter) is accumulated in a PLD fluctuation data FIFO 419 which has the capacity to store PLD fluctuation data fn corresponding to one circuit of the belt. In this concrete example 1, in cases where the data inside this FIFO 419 is empty, PLD fluctuation data fn can be accommodated by switching the switch SW1 on.

Thus, the PLD fluctuation data fn is accumulated inside the FIFO 419 according to the rotation of the belt 103. If the reference data $\omega_{ref1}$ for the first roller 101 is generated according to Equation (51) using this PLD fluctuation data fn, then driving control corresponding to the PLD fluctuation data f(tn) is performed.

$$\frac{|h_{out1}(t)|_{PP}}{|h_{out2}(t)|_{PP}} \cong \frac{1-G_1^{2^{n-1}}}{1-G_2^{2^{n-1}}} \quad \text{Eq. (51)}$$

Figure 16:
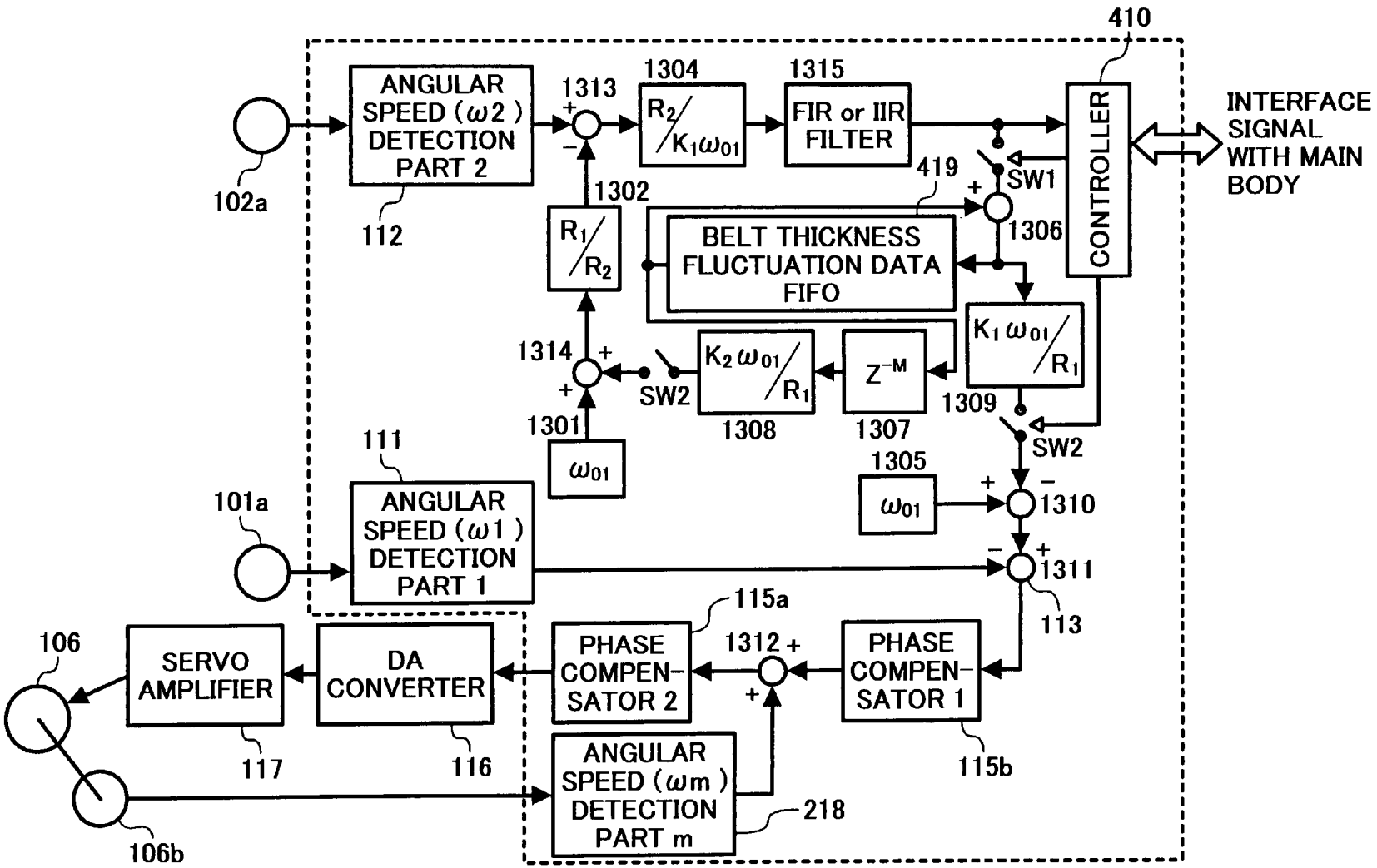
FIG. 16 is a diagram used to illustrate the updating processing in concrete example 1 of the present embodiment.

The calculation processing in parentheses in this Equation (51) is performed by the block 1309. Furthermore, if the two switches SW2 shown in FIG. 16 are switched on. Then the reference data $\omega_{ref1}$ for the first roller 101 is output from the subtraction part 1310.

Furthermore, when the switch SW2 is switched on, processing that detects the control error $\omega_{2\epsilon}$ expressed by the abovementioned Equation (44) is performed. In this processing, the fluctuation in the rotational angular speed of the second roller 102 predicted from the PLD fluctuation data fn accumulated in the FIFO 419 is first calculated by the blocks 1307 and 1308, and the fixed rotational angular speed $\omega_{01}$ of the block 1301 is added. Afterward, calculations are performed by the block 1302, and subtraction from the rotational angular speed $\omega_2$ detected by the respective speed detection parts 112 is performed by the subtractor 1313. The output from this subtractor 1313 is $\omega_{2\epsilon}$ in the abovementioned Equation (44). This is input into the block 1304. As a result, the output of the FIR filter 1315 is input into the controller 410 as PLD fluctuation error data $\epsilon$n. Then, in cases where this PLD fluctuation error data $\epsilon$n exceeds a specified value, the controller 410 switches the switch SW1 on for a time corresponding to one revolution of the belt, determines new PLD fluctuation data fn, and accomplished updating by storing this data in the FIFO 419. Furthermore, if the switches SW1 and SW2 are both switched on in a state in which PLD fluctuation data fn prior to updating is already stored in the FIFO 419, correction of the PLD fluctuation shown in the abovementioned Equation (45) is performed in the adder 1306, and the corrected PLD fluctuation data is re-stored in the FIFO 419.

Furthermore, in cases where PLD fluctuation data fn is accumulated in the FIFO 419, it would also be possible to take data for a multiple number of revolutions of the belt, average this data fn, and store the resulting value in the FIFO 419. In this case, the FIFO 419 also functions as past information storage means. Furthermore, in the case of PLD fluctuation error data en as well, it would similarly be possible to take data en for a multiple number of revolutions of the belt, and to use a value that averages this data, so that error caused by random fluctuations generated by gear backlash, noise and the like is reduced.

Next, a case in which updating is performed continuously will be described. In this case, the correction of the PLD fluctuation shown in the abovementioned Equation (45) is constantly performed. In other words, in FIG. 16, both the switches SW1 and SW2 are switched to an "on" state.

In concrete terms, in a case where the PLD fluctuation data FIFO 419 is empty, the controller 410 first switches the switch SW1 off, compares the reference signal $\omega_{01}$ and the rotational angular speed $\omega_1$ of the first roller 101 determined by the angular speed detection part 111, and drives the belt 103 so that the first roller 101 is maintained at the constant rotational angular speed $\omega_{01}$. Then, when the output of the FIR filter or IIR filter has stabilized, the switch SW1 is switched on, and PLD fluctuation data is accumulated in the FIFO 419 for one circuit of the belt. Subsequently, when both of the switches SW1 and SW2 are simultaneously placed in an "on" state, data in which the output data en of the FIR filter 1315 and the output data of the FIFO 419 are added constitutes new PLD fluctuation data fn that is again input into the FIFO 419. From the relationship shown in the abovementioned Equations (42) and (44), this data en is PLD fluctuation error data that is obtained form the output of the FIR filter or IIR filter. In this case, the PLD fluctuation data fn for which the error has been corrected is rotated by an amount corresponding to one period of the belt inside the FIFO. If the reference signal $\omega_{ref1}$ for the first roller 101 is generated using this PLD fluctuation data fn according to Equation (51), then driving control corresponding to the PLD fluctuation f(tn) is performed. In this case, if the controller 410 judges that the PLD fluctuation error data en has exceeded a specified value, the copying machine main body is informed of an abnormality.

Furthermore, in this concrete example 1, the system was realized using the memory functions of the FIFO 419, to which the stored input data of the PLD fluctuation data fn is shifted in accordance with a clock signal, and the block 1307 which outputs the input data after delaying this data for a fixed time. However, this may also be realized by an address-controlled memory function.

(Concrete Example 2)

Next, another concrete example 2 regarding the updating of the PLD fluctuation f(t) will be described. Furthermore, in this concrete example 2, a case will be described in which the PLD fluctuation data fn is not corrected as in the abovementioned concrete example 1, but control is instead performed so that newly determined PLD fluctuation data fn is successively accumulated in the FIFO 419. Furthermore, in the following description, a case will be described in which newly determined PLD fluctuation data fn is successively accumulated in the FIFO 419, and updating is continuously performed using the PLD fluctuation data fn prior to one circuit of the belt.

First, the rotational angular speed $\omega_2$ of the second roller 102 is detected; then, PLD fluctuation data gn is newly determined from data excluding the reference data $\omega_{ref1}$ calculated from the PLD fluctuation data fn stored in the FIFO 419. In other words, in a state in which driving control of the belt is performed on the basis of the PLD fluctuation data fn currently stored in the FIFO 419, the rotational angular speed $\omega_2'$ of the second roller 102 is detected with the virtual home position as a reference. Then, the reference data $\omega_{ref1}$ in this case is multiplied by a factor of $(R_1/R_2)$, this is subtracted from the rotational angular speed $\omega_2'$, new reference data is determined using the signal $\omega_2''$ obtained from this, and driving control is performed using this new reference data as a reference.

The rotational angular speed $\omega_2'$ of the second roller 102 that is detected using the virtual home position as a reference is as shown in the following Equation (52).

$$\omega_2 = \frac{R_1}{R_2}\omega_{01} + \frac{\kappa_1}{R_2}\omega_{01}\{f(tn) - Gf(tn-\tau)\} \quad \text{Eq. (52)}$$

Here, the abovementioned signal $\omega_2''$ is determined from the following Equation (53).

$$\omega_{ref1} = \omega_{01}\left\{1 - \frac{\kappa_1}{R_1} f(tn)\right\} \quad \text{Eq. (53)}$$

Accordingly, the following Equation (54) is obtained from the abovementioned Equations (51) and (52). "G" in this Equation (56) is the same as the entity shown in the abovementioned Equation (27), and adopts a value that is less than 1 from the relationship of the roller diameters of the first roller 101 and second roller 102 in concrete example 2.

$$\omega_2' = \frac{R_1\omega_{01}}{R_2}\left[1 + \frac{\kappa_1}{R_1}\{g(tn) - f(tn)\} - \frac{\kappa_2}{R_2}\{g(tn-\tau)\}\right] \quad \text{Eq. (54)}$$

The PLD fluctuation data g(tn) can be determined from this Equation (54). In concrete terms, for example, this can be obtained as the data sequence of new PLD fluctuation data gn by means of the abovementioned FIR filter or IIR filter.

Figure 17:
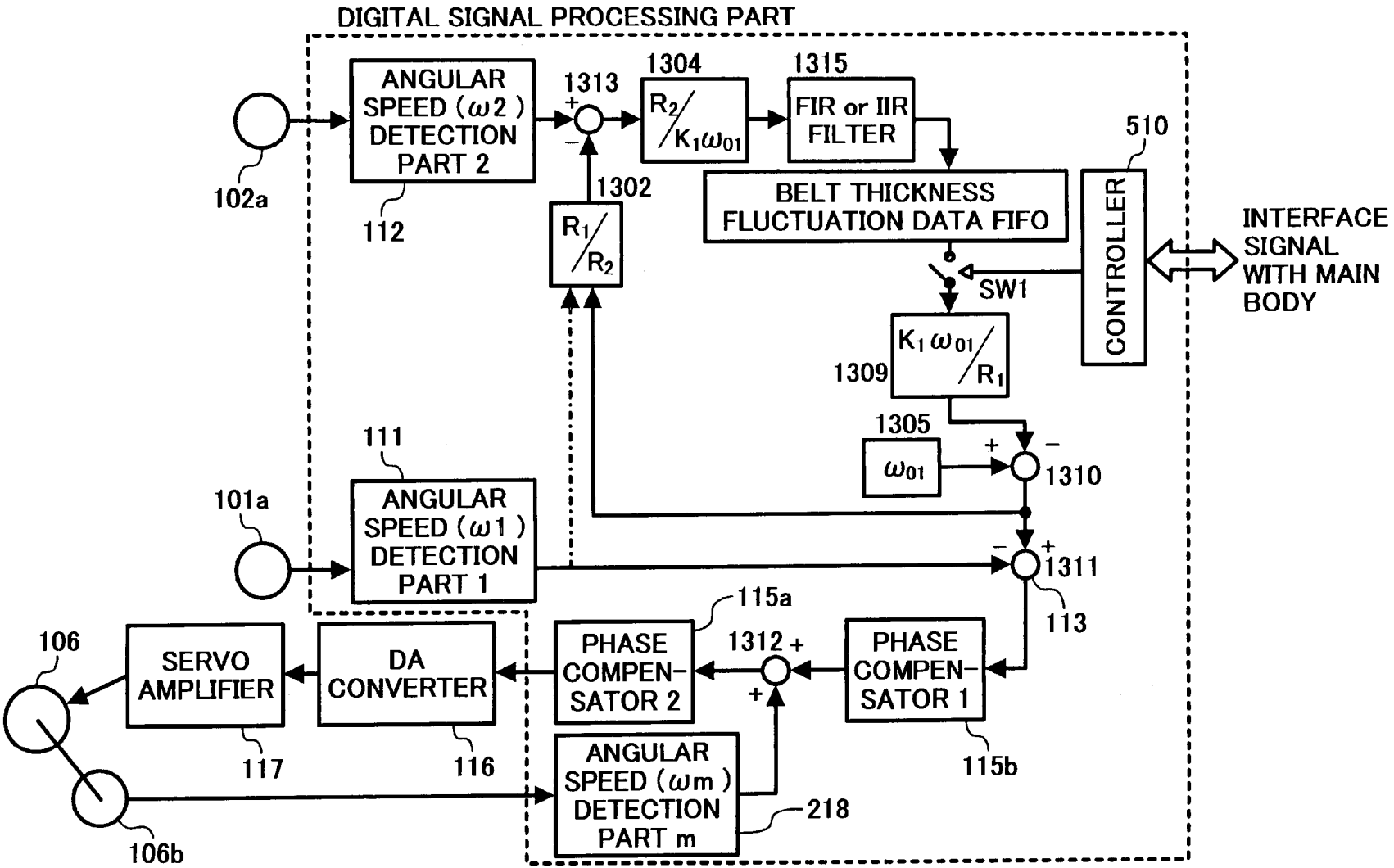
FIG. 17 is a diagram used to illustrate the updating processing in concrete example 2 of the present embodiment.

FIG. 17 is an explanatory diagram used to illustrate the updating processing in this concrete example 2. Furthermore, in this figure, as in the abovementioned concrete example 1, the rotary type encoder 106*b* that is disposed on the driving motor 106 is provided in the DC servo motor that is used as the driving motor 106. Furthermore, the digital signal processing part surrounded by a broken line in the figure is constructed from a digital circuit, DSP, μCPU, RAM, ROM, FIFO (first in first out) and the like of course, the concrete hardware construction is not limited to this construction. Depending on the control block in the figures, processing may also be performed by calculations using firmware in some cases.

In this concrete example 2, the controller 510 first switches the switch SW1 off, compares the reference data $\omega_{01}$ ($=V_0/R_1$) and the rotational angular speed $\omega_1$ of the first roller 101 determined by the angular speed detection part 111, and drives the belt 103 so that the first roller 101 is maintained at the constant rotational angular speed $\omega_{01}$. When the rotational angular speed $\omega$ of the first roller 101 is the constant rotational angular speed $\omega_{01}$, the rotational angular speed $\omega_2$ of the second roller 102 determined by the angular speed detection part 112 is as shown in the following Equation (55).

$$\omega_2'' = \omega_2' - \frac{R_1}{R_2}\omega_{ref1} \quad \text{Eq. (55)}$$

Here, $\omega_{01}$ output from the subtractor 1310 is multiplied by a factor of $(R_1/R_2)$ in the block 1302, and the fixed data $(R_1\times\omega_{01})/R_2$ is input into the subtractor 1313. Then, the value output by this subtractor 1313 is multiplied by the fixed data $R_2(\kappa_1\times\omega_{01})$ in the block 1304. This output data is input into the FIR filter or IIR filter of the block 1315. In other words, the output data of the block 1304 is f(tn)−Gf(tn−τ), and this data is input into the FIR filter or IIR filter. The output of this filter consists of the respective PLD fluctuation data fn constituting the data sequence of the PLD fluctuation f(tn). The controller 510 410 monitors the rotational angular speed $\omega_1$ of the first roller 101, and switches the switch SW1 on when this rotational angular speed $\omega_1$ is a uniform speed, and the time during which accurate PLD fluctuation data fn is output from the FIR filter (or IIR filter) has elapsed. The reason for this is that since a delay element is included in both the FIR filter and IIR filter, the output of accurate PLD fluctuation data fn is not performed in the initial stage of filter execution. If the reference data $\omega_{ref1}$ for the first roller 101 is calculated by the block 1309 using this PLD fluctuation data fn in accordance with the abovementioned Equation (51), driving control corresponding to the PLD fluctuation f(tn) is performed.

Furthermore, in this concrete example 2, the abovementioned FIFO 419 is inserted in cases where a construction in which time is required for the derivational calculation of the PLD fluctuation data fn or digital signal processing including the multiplication of the block 1309 is adopted. In other words, the abovementioned reference signal $\omega_{ref1}$ is produced by means of the PLD fluctuation data fn prior to one circuit of the belt. Furthermore, since the rotational angular speed $\omega_1$ of the first roller 101 is controlled by the abovementioned reference data $\omega_{ref1}$, a construction may also be used in which the rotational angular speed detection data $\omega_1$ for the first roller 101 is directly input into the block 1302 as indicated by the one-dot chain line in the figure.

Furthermore, in this concrete example 2, if the abovementioned signal $\omega_2''$ includes variation caused by temperature or manufacturing variation in the roller diameters of the first roller 101 and second roller 102, DC component error caused by calculation error or the like, error is generated in the subsequent filter processing of the FIR filter or IIR filter. In cases where this error is a problem, a high band pass filter that excludes the DC component of the abovementioned signal $\omega_2''$ is inserted prior to the filter processing of the FIR filter or IIR filter.

Furthermore, in the abovementioned concrete examples 1 and 2, a low band pass filter may be inserted in order to exclude fluctuations in the rotational period of the first roller 101 or second roller 102, other periodic fluctuations, or fluctuations in the high band frequency region including noise, on the basis of rotational angular speed $\omega_2$ of the second roller 102 detected by the angular speed detection part 112. As a result, fluctuations in the belt movement speed caused by PLD fluctuations can be correctively controlled in a stable manner with a higher degree of precision. This low band pass filter can be installed before the FIR filter or IIR filter, or after the angular speed detection part 112.

Furthermore, in the abovementioned concrete examples 1 and 2, averaging processing may be performed in order to reduce random detection error generated by gear backlash, noise or the like. In other words, data fn for N circuits of the belt (N is a natural number) is input into a RAM (random access memory) on a first in first out (FIFO) basis, and data for N circuits of the belt (or a smaller amount of data) in the RAM is subjected to averaging processing; this averaged data is then used as PLD fluctuation data. In cases where the PLD fluctuation data is continuously updated, reference data is produced by data in which PLD fluctuation data for less than one revolution of the belt up to (at most) PLD fluctuation data for less than N revolutions of the belt is averaged.

Furthermore, in the abovementioned concrete examples 1 and 2, it would also be possible to convert the abovementioned reference data $\omega_{ref1}$ indicating the rotational angular speed into data indicating the rotational angular position, and to perform control by comparing this with the rotational angular position obtained from the output of the rotary type encoder 101*a* installed on the first roller 101.

Furthermore, in the abovementioned concrete examples 1 and 2, it would also be possible to convert the abovementioned reference data $\omega_{ref1}$ into a pulse sequence, and to perform PLL control so that the continuously output pulse phase is controlled on the basis of output of the rotary type encoder 101*a* installed on the first roller 101.

Next, a modification of the present embodiment will be described.

In the abovementioned embodiment, an electrophotographic image forming apparatus was described; in the present modification, however, an image forming apparatus using an ink jet system will be described. Here, a description of points that are the same as in the abovementioned embodiment will be omitted.

Figure 18:
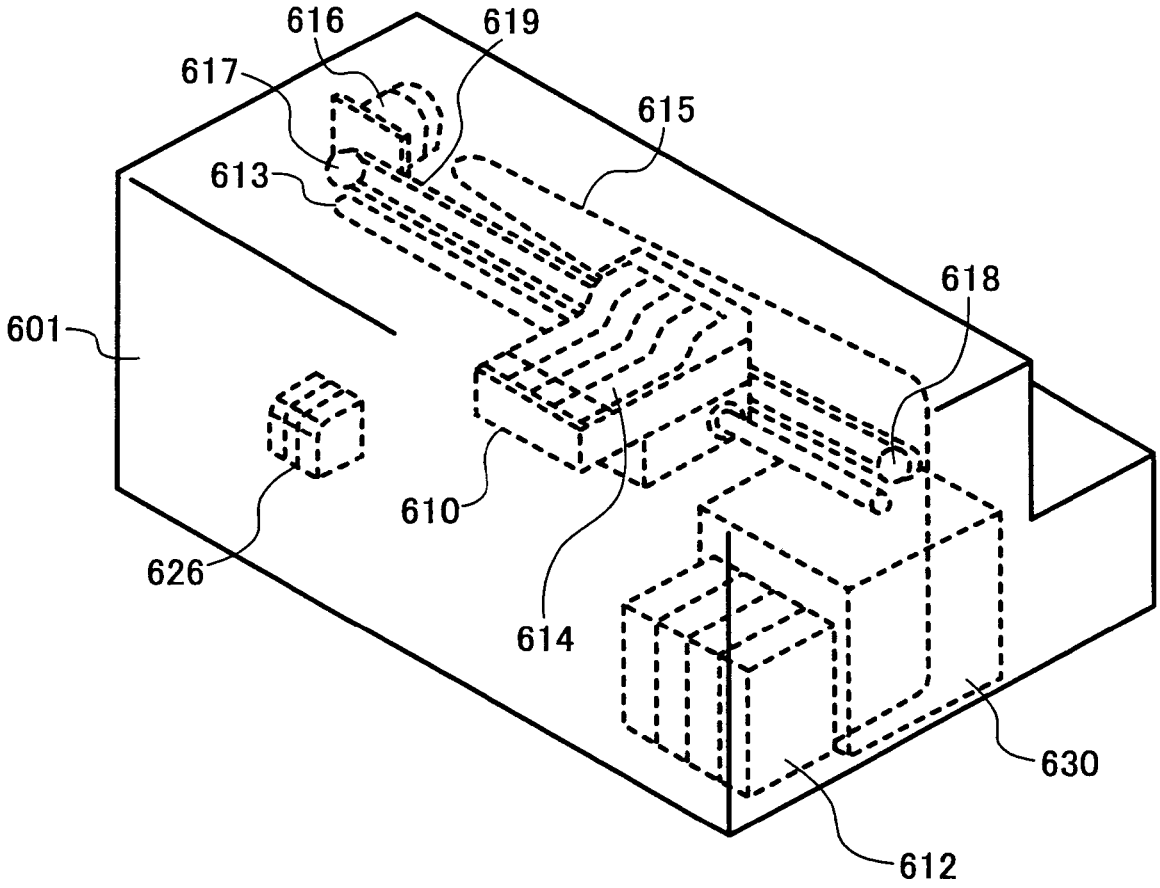
FIG. 18 is a perspective view showing the internal construction of the ink jet recording apparatus in a modification of the concrete example of the present embodiment.
Figure 19:
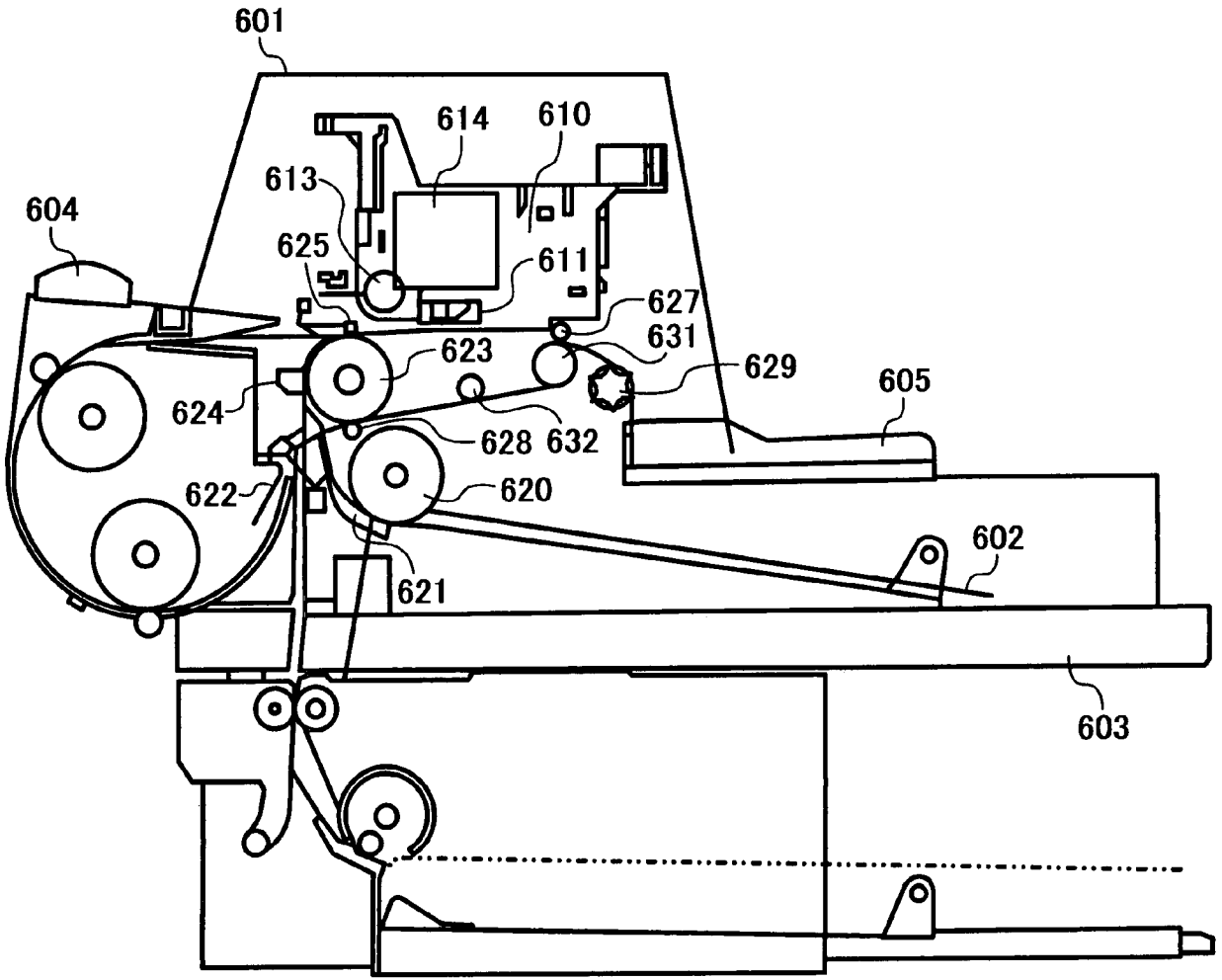
FIG. 19 is a side view showing the construction of the mechanism part of the same ink jet recording apparatus.

FIG. 18 is a perspective view showing the internal construction of the ink jet recording apparatus of the present modification. FIG. 19 is a side view of the mechanism part of this ink jet recording apparatus. This ink jet recording apparatus has a carriage 610 that can move in the main scanning direction inside the apparatus main body 601. A recording head 611 is caused to scan this carriage 610. Furthermore, an ink cartridge 612 which supplies ink to the recording head 611 is also accommodated inside the apparatus main body 601. A paper supply cassette 603 which can carry a plurality of sheets of recording paper 602 is mounted in the lower part of the apparatus main body 601 so that this cassette 603 can be freely pulled out from the side surface. Furthermore, a manual insertion tray 604 used to supply recording paper 602 by manual insertion is attached to the apparatus main body 601 so that this tray 604 can be swung open. This ink jet recording apparatus takes in recording paper 602 that is conveyed from the paper supply cassette 603 or manual insertion tray 604, forms images on this recording paper by means of the recording head 611 of the carriage 610, and then discharges the paper into a paper discharge tray 605 mounted on the back surface side.

The printing mechanism part comprises the abovementioned carriage 610 and the abovementioned ink cartridge 612. This printing mechanism part is held by a main guide rod 613 constituting a guide member that is installed as a lateral bridging part on the left and right side plates (not shown in the figures), so that this printing mechanism part can slide in the main scanning direction of the carriage 610. The carriage 610 is held by the main guide rod 613 so that the discharge direction of ink droplets of the respective colors yellow (Y), cyan (C), magenta (M) and black (Bk) that are discharged from the recording head 611 faces downward. Furthermore, sub-tanks 614 used to supply inks of respective colors to the recording head 611 are mounted on the upper part of the carriage 610. The sub-tanks 614 for the respective colors are connected to replaceably mounted ink cartridges 612 via ink supply tubes 615, so that the sub-tanks 614 receive a supply of ink from the ink cartridges 612. The carriage 610 is mounted so that the back surface side is free to slide on the main guide rod 613. Furthermore, in order to scan this carriage 610 in the main scanning direction, a timing belt 619 is mounted on a driven pulley 618 and a driving pulley 617 that is rotationally driven by a main scanning motor 616, and this timing belt 619 is fastened to the carriage 610.

Furthermore, in the present modification, the recording head 611 may use a separate recording head for each color, or may comprise a single recording head having nozzles that discharge ink droplets of the respective colors. Furthermore, the recording head 611 that is used may be a piezo type head which applies pressure to the ink via vibrating plates that form the wall surfaces of the liquid chambers (ink passages) using electromechanical transducer elements such as piezoelectric elements or the like, a bubble type head which applies pressure to the ink by generating bubbles using a film bubbling device based on a heat-generating resistor, an electrostatic type head which applies pressure to the ink by displacing vibrating plates that form the wall surfaces of the ink flow passages by means of an electrostatic force between these vibrating plates and electrodes facing these vibrating plates, or the like. Furthermore, in the present modification, an electrostatic type ink jet head is used.

This ink jet recording apparatus uses a paper feed roller 620 and friction pad 621 which separate and convey the recording paper 602 from the paper supply cassette 603, a guide member 622 which guides the recording paper 602, a conveying roller 623 which inverts and conveys the supplied recording paper 602, a conveying roll 624 which is pressed against the circumferential surface of the conveying roller 623, and a tip end roll 625 which regulates the feed-out angle of the recording paper 602 from the conveying roller 623; here, the recording paper 602 set in the paper supply cassette 603 is conveyed to a point beneath the recording head 611. This conveying roller 623 is rotationally driven via a gear train (not shown in the figures) by a sub-scanning motor 626.

An electrostatic conveyor belt 627 which guides the recording paper 602 that is fed out from the conveying roller 623 (in a movement range in the sub-scanning direction of the carriage 610) to a point beneath the recording head 611 is installed in this ink jet recording apparatus. This electrostatic conveyor belt 627 holds the conveyed recording paper 602 on its surface by being electrostatically charged using a charger 628, and is arranged so that the paper surface and head surface can be maintained parallel to each other. A paper discharge roll 629 which feeds out the recording paper 602 into the paper discharge tray 605 is disposed on the downstream side of this electrostatic conveyor belt 627 with respect to the paper conveying direction. Furthermore, a maintenance and recovery mechanism 630 which is used to maintain and restore the reliability of the recording head 611 is disposed on one end part of the carriage 610 with respect to the direction of movement. While waiting for printing, the carriage 610 is positioned at this maintenance and recovery mechanism 630, and the recording head 611 is capped by capping means or the like.

The belt driving control apparatus described in the abovementioned embodiment can be utilized for the driving control of the electrostatic conveyor belt 627 or the timing belt 619. In the electrostatic conveyor belt 627, if there are fluctuations in the amount of belt conveying during the conveying of the paper, positional deviation and irregularity in the [optical] density are generated; accordingly, high-precision conveying control is required. Similarly, in the case of the timing belt 619 as well, if fluctuations in the speed of the carriage 610 occur during scanning, positional deviation and irregularity in the [optical] density are generated; accordingly, high-precision conveying control is necessary.

To describe the electrostatic conveyor belt 627, this electrostatic conveyor belt 627 is a single-layer belt whose principal material is a polyimide (PI). Since there is a distribution in the thickness deviation in one circuit of the belt, a PLD fluctuation is generated when the belt is driven. The rotational angular speed or rotational angular displacement of the conveying roller 623 is obtained by disposing a rotary type encoder on the shaft of the conveying roller 623, or by using rotation detection means contained in the sub-scanning motor 626. Furthermore, a rotary type encoder (not shown in the figures) is disposed on the shaft of the driven roller 631 on which the electrostatic conveyor belt 627 is mounted, so that the rotational angular speed or rotational angular displacement of the driven roller 631 is obtained. The conveying roller 623 and driven roller 631 have a radius ratio of 2:1. Since the two rotational angular speeds of the conveying roller 623 and driven roller 631 (which have different diameters) are thus obtained, the electrostatic conveyor belt 627 can be driven at a desired movement speed and amount of movement by the processing shown in FIGS. 16 and 17 on the basis of the rotational angular speed $\omega_1$ of the conveying roller 623 and the rotational angular speed $\omega_2$ of the driven roller 631, in the same manner as in the abovementioned embodiment.

Next, the timing belt 619 will be described.

Figure 20:
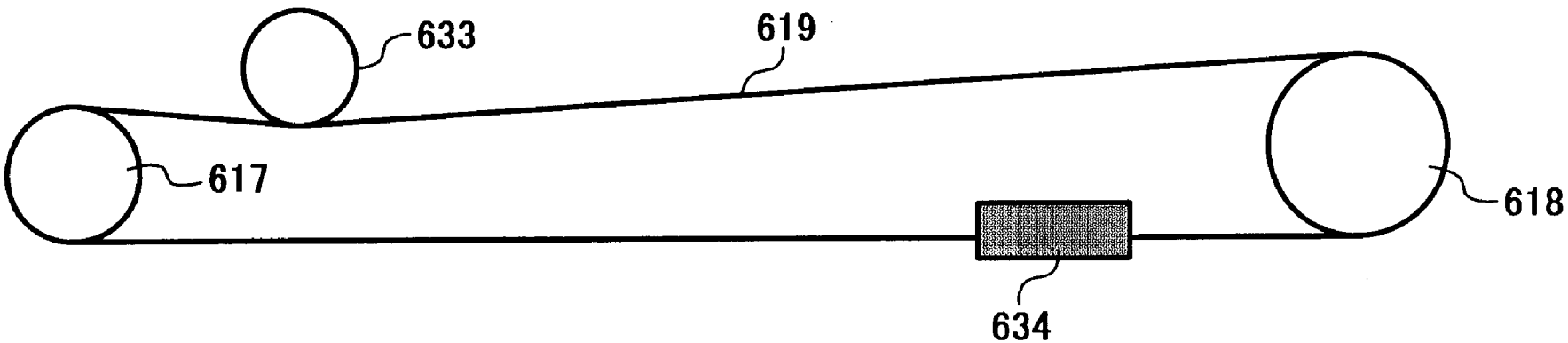
FIG. 20 is diagram showing the schematic construction of the carriage driving mechanism part installed in the same ink jet recording apparatus.

FIG. 20 is a schematic structural diagram showing the carriage driving mechanism part. The timing belt 619 is a tooth-equipped endless belt consisting of a polyurethane belt which has a belt length of 1.2 m, in which the number of belt teeth is 300 teeth, and in which the belt width is 15 mm. Three wire ropes with a wire element diameter of 0.1 mm are bundled and enveloped along the circumferential direction of the belt as tension bodies in this timing belt 619. The driving pulley 617 is a tooth-equipped pulley with 18 teeth, and the driven pulley 618 is a tooth-equipped pulley with 27 teeth. The tension pulley 633 is installed in order to apply an appropriate tension to the timing belt 619. It would also be possible to endow the driven pulley 618 with a tension applying function, and to omit the tension pulley 633. However, if a roller on which a rotary type encoder is installed is endowed with a tension mechanism, there may be cases in which a rotation detection error is generated by the displacement of the roller caused by tension.

The timing belt 619 has a PLD fluctuation over one circuit of the belt as a result of thickness deviation of the polyurethane rubber and the like caused by disposition error of the wire ropes (tension bodies) and molding error during manufacture. The rotational angular speed or rotational angular displacement of the driving pulley 617 is obtained by installing a rotary type encoder on the shaft of the driving pulley 617, or by using rotation detection means contained in the main scanning motor 616. Furthermore, a rotary type encoder is installed on the shaft of the driven pulley 618, and the rotational angular speed or rotational angular displacement of the driven pulley 618 is thus obtained. The radius ratio of the driving pulley 617 to the driven pulley 618 is 2:3. Since the two rotational angular speeds of the driving pulley 617 and driven pulley 618 (which have different diameters) are thus obtained, the timing belt 619 can be driven at a desired movement speed and amount of movement by the processing shown in FIGS. 16 and 17 on the basis of the rotational angular speed $\omega_1$ of the driving pulley 617 and the rotational angular speed $\omega_2$ of the driven pulley 618, in the same manner as in the abovementioned embodiment.

Furthermore, the carriage 610 has a carriage gripping part 634 for gripping the timing belt 619, so that the carriage 610 can be fixed at any desired position on the timing belt 619. This carriage gripping part 634 is constructed so that this part is freely detachable with respect to the timing belt 619. Accordingly, the carriage 610 can be retracted and detached from the timing belt 619. In cases where a PLD fluctuation is recognized, the carriage 610 is removed from the timing belt 619 and the timing belt 619 is driven, so that the PLD fluctuation over one circuit of the timing belt 619 is recognized.

Furthermore, a linear encoder mechanism which reads a high-precision scale pattern formed on the timing belt 619 along the circumferential direction of the belt by means of a sensor installed on the carriage 610 is generally used as means for detecting the scanning position of a conventional carriage 610. In the present modification, however, since rotary type encoders are installed on the pulleys 617 and 618 on which the timing belt 619 is mounted, the scanning position of the carriage 610 can be detected from the outputs of these rotary type encoders. Accordingly, in the present modification, the following advantage is obtained: namely, there is no need to form a high-precision scale pattern on the timing belt 619, and there is likewise no need to install a sensor on the carriage 610. This advantage is especially beneficial in the case of an apparatus in which the scanning distance of the carriage 610 is long.

Thus, the belt driving control apparatus of the embodiment is an apparatus in which the driving of the abovementioned belt 103 is controlled by controlling the rotation of the driving roller 105, which is a driving supporting rotating body to which the rotational driving force is transmitted (among the plurality of supporting rollers 101, 102 and 105 used as supporting rotating bodies on wich the belt 103 is mounted). This belt driving control apparatus has a digital signal processing part used as control means that perform rotational control of the driving roller 105 on the basis of detection results for the rotational angular displacement or rotational angular speed of two rollers, i.e., the first roller 101 and second roller 102 (among the abovementioned plurality of supporting rollers) which have different effective roller radii, or in which the degree to which the PLD of the belt portions that are wound on these rollers affects the relationship between the movement speed V of the belt and the rotational angular speeds $\omega_1$ and $\omega_2$ of these rollers is different, so that the fluctuation in the belt movement speed V that is generated by the PLD fluctuation in the circumferential direction of the belt 103 is reduced. In the present embodiment, this digital signal processing part determines PLD fluctuation information f(t) with an arbitrary ground point on the movement path of the belt 103 taken as the virtual home position, and performs the abovementioned rotational control using this PLD fluctuation information f(t). In this apparatus, as was described above, the fact that the magnitude of the PLD fluctuation in the circumferential direction of the belt that is detected from the rotational angular speeds $\omega_1$ and $\omega_2$ of the two driven rollers 101 and 102 differs according to the magnitude of the effective roller radii $R_1$ and $R_2$, the winding angles of the belt $\theta_1$ and $\theta_2$, the material of the belt, the layer structure of the belt and the like is utilized, so that the PLD fluctuation that is applied to the relationship between the belt movement speed V and the rotational angular speeds $\omega_1$ and $\omega_2$ of the rollers 101 and 102 can be specified with a high degree of precision from the rotational angular displacements or rotational angular speeds $\omega_1$ and $\omega_2$ of these rollers 101 and 102, even if this fluctuation is complicated. As a result, the driving of the belt 103 can be controlled with a high degree of precision so that the fluctuation in the belt movement speed caused by the PLD fluctuation can be reduced.

Furthermore, in cases where the belt 103 is a single-layer belt made of a uniform belt material, driving control can also be performed using the belt thickness fluctuation which has a fixed relationship with the PLD fluctuation. Specifically, rotational control of the driving roller 105 can be performed on the basis of detection results for the rotational angular displacement or rotational angular speed of two rollers, i.e., the first roller 101 and second roller 102 (among the abovementioned plurality of supporting rollers) which have different effective roller radii, or in which the degree to which the thickness of the belt portions that are wound on these rollers affects the relationship between the movement speed V of the belt and the rotational angular speeds $\omega_1$ and $\omega_2$ of these rollers is different, so that the fluctuation in the belt movement speed V that is generated by the belt thickness fluctuation in the circumferential direction of the belt 103 is reduced.

Furthermore, in the present embodiment, the abovementioned rotational control is performed using approximate PLD fluctuation information f(t) and f(t−τ) which is rotational fluctuation information for the two rollers 101 and 102 respectively recognized from the rotational angular displacements or rotational angular speeds $\omega_1$ and $\omega_2$ of these two rollers detected at the same instant in time as described in PLD fluctuation recognition method 1. As a result, the processing that is sued to determine the PLD fluctuation information f(t) can be simplified. Furthermore, if the inter-roller distance between the two rollers 101 and 102 is sufficiently close, the delay time τ is sufficiently small so that the PLD fluctuation information f(t) can be determined with a sufficiently high degree of precision even if f(t) is taken as being equal to f(t−τ).

Furthermore, in the present embodiment, as was described in PLD fluctuation recognition method 2, since the data obtained on the basis of the detection results for the rotational angular displacements or rotational angular speeds $\omega_1$ and $\omega_2$ of the two rollers 101 and 102 respectively detected at the same instant in time (the data on the left in the abovementioned Equation (25)), or the data obtained on the basis of the other rotational angular displacement or rotational angular speed $\omega_2$ in a state in which one of these rollers 101 or 102 is maintained at a uniform angular speed $\omega_{01}$, is detection information containing the two sets of PLD fluctuation information f(t) and f(t−τ), normalization which is such that the coefficient of one set of PLD fluctuation information is 1 is performed in accordance with the abovementioned Equation (25), processing which reduces the error Gf(t−τ) between the determined time function gf(t) and the time function f(t) which is the PLD fluctuation information that is to be determined is performed, and the abovementioned rotational control is performed using these processing results as the PLD fluctuation information. However, the coefficient of the other PLD fluctuation information after normalization is induced to be less than 1. Furthermore, the processing that reduces the error refers to the performance of addition processing in which the data of the original time function gf(t) that gives the delay element corresponding to the time τ required for the belt 103 to move between these rollers 101 and 102, and the gain element based on the respective degrees $\kappa_1$ and $\kappa_2$ to which the PLD of the respective belt portions that are respectively wound on these rollers 101 and 102 affects the movement speed V of these respective belt portions, and the effective roller radii $R_1$ and $R_2$ of these rollers, is added to the normalized time function gf(t) which is such that the coefficient of the PLD fluctuation information is 1, so that the abovementioned rotational control is performed with the processing results h(t) used as the PLD fluctuation information f(t). As a result, the PLD fluctuation information f(t) can be obtained with a high degree of precision without any dependence on the inter-roller distance of the two rollers 101 and 102. Consequently, the degree of freedom of the apparatus layout can be increased.

In particular, in the present embodiment, as was described in PLD fluctuation recognition method 2, the processing that reduces the abovementioned error refers to a case in which processing in which [i] addition processing is performed which applies a gain to the input time function, and said input time function is added to data in which the phase of said input time function is delayed or advanced by the delay time τ which is the movement time required for the belt 103 to move between the abovementioned two rollers 101 and 102, and [ii] this addition processing is further performed for the processing results obtained, is repeated a specified number of times, and a gain obtained by multiplying the gain G used in the first addition processing by a factor of $2^{n-1}$ is used as said gain in the nth addition processing, while a time obtained by multiplying the specified time τ used in the first addition processing by a factor of $2^{n-1}$ is used as said specified time τ in the nth addition processing. This processing is characterized in that the effective coefficients of PLD fluctuation $\kappa_1$ and $\kappa_2$ of the abovementioned two supporting rotating bodies and the effective radii $R_1$ and $R_2$ of said two supporting rotating bodies are set so that gain G used in the abovementioned first addition processing determined by Equation (27) is less than 1. Since such processing can be performed using an FIR filter or the like, stable processing is possible.

Furthermore, as is shown in FIGS. 11A and 11B, the processing that reduces the abovementioned error may be performed as follows: namely, the gain G determined by the abovementioned Equation (27) is applied to the input time function, and addition processing is performed in which an operation in which the phase of said input time function is delayed or advanced by the movement time required for the abovementioned belt to move between the abovementioned two rollers 1101 and 102 is regressively performed, and [this] is added to said input time function. The processing results may be used as the abovementioned PLD fluctuation information f(t). In this case, dependent type (non-regressive type) calculation processing performed by the abovementioned FIR filter can be performed as regressive type processing; accordingly, similar processing can be performed using little calculation processing or a simple circuit construction.

Furthermore, in the present embodiment, a PLD fluctuation data FIFO 419 is installed as fluctuation information storage means for storing PLD fluctuation information f(t) for the period corresponding to the time Tb required for the belt 103 to complete one revolution. As a result, in addition to the calculation time and calculation apparatus used the recognition and correction of the PLD fluctuation information f(t), calculation time for other processing can be ensured.

Furthermore, in the present embodiment, processing which re-determines the PLD fluctuation information f(t) is performed at a specified timing. As a result, the PLD fluctuation information f(t) can again be determined at a timing when the PLD fluctuation of the belt 103 exceeds permissible limits as a result of the environment or use over time. Consequently, even if the PLD fluctuation of the belt 103 should vary, high-precision belt driving control can be maintained. In particular, as was described in the abovementioned concrete example 1, if the abovementioned specified timing is set at a timing at which the difference between the PLD fluctuation data predicted on the basis of the belt movement position of the belt 103 and the PLD fluctuation information f(t) and the actual PLD fluctuation data exceeds permissible limits, more stable and higer-precision belt driving control can be maintained.

Furthermore, in the present embodiment, as was described in the abovementioned concrete example 2, the abovementioned rotational control may be performed while performing processing that determines the PLD fluctuation information f(t). In this case, even more stable and higher-precision belt driving control can be maintained. In this case, furthermore, since there is no need to store PLD fluctuation information f(t) for one circuit of the belt, such storage means become unnecessary.

Furthermore, in the present embodiment, as was described above, a PLD fluctuation data FIFO 419 may be installed as past information storage means for storing past PLD fluctuation information for one circuit of the belt, and the abovementioned rotational control may be performed using information obtained from the past PLD fluctuation information stored in this FIFO and newly determined PLD fluctuation information by performing averaging processing or the like as the abovementioned PLD fluctuation information f(t). In this case, since PLD fluctuation information determined in the past and newly determined PLD fluctuation information can be subjected to averaging processing, the PLD fluctuation information f(t) can be determined with a higher degree of precision. As a result, the effect of random fluctuations caused by gear backlash, noise or the like on the detection error can be reduced.

Furthermore, in the belt apparatus of the present embodiment, the apparatus has a belt 103 which is mounted on plurality of rollers including supporting rollers 101, 102 and 105, a driving motor 106 used as a driving source which generates a rotational driving force that is used to drive this belt, rotary type encoders 101*a* and 102*a* and angular speed detection parts 111 and 112 used as detection means for detecting the rotational angular displacements or rotational angular speeds $\omega_1$ and $\omega_2$ of two rollers, i.e., a first roller 101 and second roller 102 (among the abovementioned rollers) which have different diameters, or in which the degree to which the PLD of the portions of the belt that are wound on these rollers affects the relationship between the movement speed V of the belt and the rotational angular speeds $\omega_1$ and $\omega_2$ of these rollers is different. Here, the abovementioned belt driving control apparatus is used as a belt driving control apparatus that controls the driving of the belt 103 by controlling the rotation of the driving roller 105 to which a rotational driving force is transmitted (among the abovementioned rollers). As a result, as was described above, a belt apparatus can be realized in which the driving control of the belt 103 can be performed with a high degree of precision.

Furthermore, in rotary type encoder installation example 1 of the present embodiment, the abovementioned two rollers 101 and 102 are both driven rollers that rotate in connection with the movement of the belt 103. In this case, when the PLD fluctuation f(t) is to be determined, there is no dependence on fluctuation components that cause recognition error (slipping between the driving roller 105 and the belt 103 or the like). Accordingly, the PLD fluctuation f(t) can be determined with a higher degree of precision.

In particular, as was described in rotary type encoder installation example 3 of the present embodiment, if a motor which has feedback control means for performing feedback control which detect the rotational angular displacement or rotational angular speed $\omega_m$ of the motor itself, and which perform feedback control so that this rotational angular displacement or rotational angular displacement $\omega_m$ is maintained at the target rotational angular displacement or rotational angular speed, is used as the abovementioned driving motor 106, a more stable control system can be designed. Since the effective coefficients of PLD fluctuation $\kappa_1$ and $\kappa_2$ of the abovementioned driven rollers 101 and 102 can be corrected, the PLD fluctuation f(t) can be determined with an even higher degree of precision.

Furthermore, in rotary type encoder installation example 2 of the present embodiment, the two rollers involving the rotational angular displacement or rotational angular speed used to determine the PLD fluctuation information f(t) include the driving roller 105. Furthermore, means which detect the rotational angular displacement or rotational angular speed $\omega_m$ of the driving motor 106, or means which detect the target rotational angular displacement or target rotational angular speed that is input into the driving motor 106, are used as detection means for detecting the rotational angular displacement or rotational angular speed of this driving roller 105. As a result, for example, if a pulse motor is used as the driving motor, it is sufficient if there is at least one rotary type encoder; accordingly, the cost of the system can be reduced. In other words, since one of the rotational angular displacements or rotational angular speeds used to determine the PLD fluctuation information f(t) is the rotational angular displacement or rotational angular speed of the driving roller 105 which can be guaranteed to have a constant rotational angular displacement or rotational angular speed, the abovementioned PLD fluctuation information f(t) can be determined using only the rotational angular displacement or rotational angular speed $\omega_2$ of the other roller 102, so that the recognition processing can also be simplified.

Furthermore, in the present embodiment, as was described in the abovementioned belt driving control example 1, a mark detection sensor 104 used as mark detection means for detecting a home position mark 103*a* constituting a mark that indicates a reference position on the belt 103 is provided in order to grasp the reference belt movement position of the belt 103. Furthermore, the relationship between the belt movement position corresponding to the determined PLD fluctuation information f(t) and the actual belt movement position is grasped on the basis of the detection timing of this mark detection sensor 104, and the abovementioned rotational control is performed on the basis of this position. As a result, the reference position for one circuit of the belt can be confirmed, so that the determined PLD fluctuation information f(t) can be used for belt driving control in a state suited to the PLD fluctuation of the belt 103, so that belt driving control can be appropriately performed.

Furthermore, in the present embodiment, as was described in the abovementioned belt driving control example 2, the relationship between the belt movement position corresponding to the determined PLD fluctuation information f(t) and the actual belt movement position is grasped on the basis of the average time required for the belt 103 to complete one revolution (which is grasped beforehand), or on the basis of the circumferential length of the belt (which is likewise grasped beforehand), and the abovementioned rotational control is performed on this basis. As a result, the reference position (virtual home position) for one circuit of the belt can be confirmed without forming the abovementioned home position mark 103*a* on the belt 103, or installing the abovementioned mark detection sensor 104. Accordingly, the cost of the system can be reduced.

Furthermore, in the present embodiment, as was described in the abovementioned PLD fluctuation recognition method 1, the distance between the abovementioned two rollers 101 and 102 in the circumferential direction of the belt (inter-roller distance) is set so that the permissible range $X_{err}$ of the respective frequency components generated by the approximation of the abovementioned $f(t)=f(t-\tau)$ is equal to or les than the total positional deviation error $X_{errT}$ determined beforehand. As a result, even if f(t) is approximated as being equal to $f(t-\tau)$, the PLD fluctuation information f(t) can be determined with a sufficiently high degree of precision.

Furthermore, in cases where the abovementioned belt 103 is a seamed belt which has a joint seam in at least one place in the circumferential direction of the belt, the area of this seam is thicker than the other portions of the belt, so that the physical properties vary, and the expansion and contraction characteristics may differ from those of other part of the belt. In such cases, even if the seam area has the same thickness as other portions of the belt, the PLD of the seam area shows a great deviation from the PLD of these other portions. In the belt driving control apparatus of the present embodiment, as was described above, in the case of belts with a protruding PLD fluctuation as well, this PLD fluctuation can be specified with a high degree of precision. Accordingly, in the case of such a seamed belt as well, the abrupt belt speed fluctuation that may be generated when the seam portion is wound on the driving roller can be suppressed, so that driving control can be performed with a high degree of precision.

Furthermore, in cases where the abovementioned belt 103 is a multi-layer belt which as a plurality of layers in the belt thickness direction, even if the belt thickness is the same, the PLD fluctuates according to the layer structure and the like, so that fluctuations are generated in the belt speed. In the belt driving control apparatus of the present embodiment, as was described above, the PLD fluctuation is specified, and driving control is performed on the basis of this PLD fluctuation; accordingly, driving control can be performed with a high degree of precision in the case of multi-layer belts as well.

Furthermore, as was described in the abovementioned modification, in cases where the driving pulley 617 and driven pulley 618 (among the abovementioned plurality of supporting rotating bodies) have a plurality of teeth in the direction of rotation, and the timing belt 619 has teeth as engaging parts that engage with the abovementioned plurality of teeth, the PLD also fluctuates in this timing belt 619, so that a fluctuation is generated in the belt speed. Specifically, such PLD fluctuation of the belt may occur regardless of the belt shape and structure, and if such PLD fluctuation occurs, the belt movement speed fluctuates. Accordingly, not only in belts that are driven by friction with roller surfaces as in the case of the abovementioned intermediate transfer belt 10, but also in the case of tooth-equipped belts such as the timing belt 619 in the abovementioned modification, a belt speed fluctuation caused by PLD fluctuation may occur. In such belts as well, as was described in the abovementioned modification, the PLD fluctuation can be specified, and driving control can be performed on the basis of this PLD fluctuation, so that driving control can be performed with a high degree of precision.

Furthermore, the abovementioned description also applies to cases in which the rotational angular speed is replaced by a rotational angular displacement. The reason for this is that an integration of the rotational angular speed results in such a rotational angular displacement, so that the relationship between the PLD fluctuation f(t) and the rotational angular displacement of the rollers can be similarly determined. In concrete terms, the rotational angular displacement can be determined by removing an average increment (slope component of the rotational angular displacement) from the detected rotational angular displacement, and the PLD fluctuation f(t) can be acquired from this rotational angular displacement by a method similar to the abovementioned recognition method 1 or recognition method 2 described for the rotational angular speed.

Furthermore, in the abovementioned embodiment, in cases where the belt 103 moves in the opposite direction, if the fact that the belt is rotating is taken into account, it is sufficient to replace the delay time $\tau$ in the abovementioned description with $Tb-\tau$ (Tb: belt rotation time). In this case, $2(Tb-\tau)=2Tb-2\tau=Tb-2\tau$, and in the case of $N(Tb-\tau)$ (N is a natural number), $N(Tb-\tau)=Tb-N\tau$. In other words, when the PLD fluctuation f(t) is to be detected using the FIR filter or IIR filter described in this recognition method 2, if processing is performed with the delay time set as a time of $N(Tb-\tau)$, the delay time processing is lengthened; in actuality, however, this is the same as delay time processing for a time of $Tb-N\tau$.

Furthermore, in the abovementioned embodiment, driving control of the intermediate transfer belt in a tandem type image forming apparatus is described as an example. As was described above, the present invention is useful for the driving control of belts (paper conveyor belts, photosensitive belts, intermediate transfer belts, fixing belts or the like) employed in image forming apparatuses using electrophotographic techniques, ink jet techniques or printing techniques. The reason for this is that an extremely high degree of precision is required in the driving control of belts used in such image forming apparatuses. Accordingly, in regard to apparatuses requiring extremely high precision in belt driving control, the present invention is also useful in image forming apparatuses other than tandem type image forming apparatuses, and in apparatuses other than image forming apparatuses.

Thus, the present invention can solve the abovementioned problems encountered in the prior art. In short, compared to cases in which belt driving control is performed on the basis of belt thickness irregularities in the circumferential direction of the belt measured by means of a belt thickness measuring instrument, belt driving control can be performed with a higher degree of precision.

Various modifications will become possible for those skilled in the art after receiving the teachings of the present disclosure without departing from the scope thereof.

What is claimed is:

1. A belt driving control apparatus for performing driving control of a belt which is installed on a plurality of supporting rotating bodies including driven rotating supporting bodies which rotate in connection with the movement of the belt, and driving supporting rotating bodies that transmit a driving force to said belt, comprising control means for performing said driving control on the basis of rotation information relating to the rotational angular displacement or rotational angular speed in two supporting rotating bodies among said plurality of supporting rotating bodies which have different diameters, or in which the degree to which the pitch line distance of the portion of the belt that is wound on each of these supporting rotating bodies affects the relationship between the movement speed of said belt and the rotational angular speed of each of these supporting rotating bodies is different, so that the fluctuation of the movement speed of said belt that is generated by the fluctuation in the pitch line distance in the circumferential direction of said belt is reduced.

2. The belt driving control apparatus as claimed in claim 1, wherein said control means perform said driving control using approximate rotation fluctuation information which is determined with rotation fluctuation information for said two supporting rotating bodies respectively determined from rotation information for said two supporting rotating bodies detected at the same instant in time, being in the same phase.

3. The belt driving control apparatus as claimed in claim 2, further comprising fluctuation information storage means for storing rotation fluctuation information for a time period corresponding to the time required for said belt to complete one revolution.

4. The belt driving control apparatus as claimed in claim 3, wherein said control means perform processing that again determines said rotation fluctuation information at a timing at which the difference between the rotation fluctuation information stored in said fluctuation information storage means and the newly determined rotation fluctuation information exceeds the permissible range.

5. The belt driving control apparatus as claimed in claim 2, wherein said control means perform processing that again determines said rotation fluctuation information at a specified timing.

6. The belt driving control apparatus as claimed in claim 2, wherein said control means perform said driving control while performing processing that determines said rotation fluctuation information.

7. The belt driving control apparatus as claimed in claim 2, further comprising past information storage means for storing past rotation fluctuation information for at least one revolution of the belt, wherein said control means perform said driving control using information obtained from the past rotation fluctuation information stored in said past information storage means and newly determined rotation fluctuation information.

8. The belt driving control apparatus as claimed in claim 1, wherein said control means perform processing so that the value of one of two sets of rotation fluctuation information of different phases contained in one or both sets of rotation information for said two supporting rotating bodies is reduced, and performs said driving control using the results of this processing.

9. The belt driving control apparatus as claimed in claim 8, wherein said processing comprises processing for adding information obtained by giving the delay time constituting a belt passage time required for the belt to move through the distance between said two supporting rotating bodies on a belt movement path and the gain based on said degree for said two supporting rotating bodies, to the two sets of rotation fluctuation information of different phases contained in the rotation information for one or both of said two supporting rotating bodies, and processing in which processing for further performing said addition processing for said processing result is repeated n ($n \geqq 1$) times, a gain obtained by multiplying the gain G in the first addition processing by 2n-1 being used as said gain in the nth addition processing, and a time obtained by multiplying said belt passage time by 2n-1 being used as said delay time in the nth addition processing.

10. The belt driving control apparatus as claimed in claim 8, wherein in said processing, information obtained by giving the delay time constituting the belt passage time required for the belt to move through the distance between said two supporting rotating bodies on a belt movement path and the gain based on said degree for said two supporting rotating bodies to the two sets of rotation fluctuation information of different phases contained in the rotation information for one or both of said two supporting rotating bodies is taken as output information, and processing for feeding back said output information and adding this output information to said two sets of rotation fluctuation information is performed.

11. The belt driving control apparatus as claimed in claim 8, further comprising fluctuation information storage means for storing rotation fluctuation information for a time period corresponding to the time required for said belt to complete one revolution.

12. The belt driving control apparatus as claimed in claim 11, wherein said control means perform processing that again determines said rotation fluctuation information at a timing at which the difference between the rotation fluctuation information stored in said fluctuation information storage means and the newly determined rotation fluctuation information exceeds the permissible range.

13. The belt driving control apparatus as claimed in claim 8, wherein said control means perform processing that again determines said rotation fluctuation information at a specified timing.

14. The belt driving control apparatus as claimed in claim 8, wherein said control means perform said driving control while performing processing that determines said rotation fluctuation information.

15. The belt driving control apparatus as claimed in claim 8, further comprising past information storage means for storing past rotation fluctuation information for at least one revolution of the belt, wherein said control means perform said driving control using information obtained from the past rotation fluctuation information stored in said past information storage means and newly determined rotation fluctuation information.

16. A belt driving control apparatus for performing driving control of a belt which is installed on a plurality of supporting rotating bodies including driven rotating supporting bodies which rotate in connection with the movement of the belt, and driving supporting rotating bodies that transmit a driving force to said belt, comprising control means for performing said driving control on the basis of rotation information relating to the rotational angular displacement or rotational angular speed in two supporting rotating bodies among said plurality of supporting rotating bodies which have different diameters, or in which the degree to which the thickness of the portion of the belt that is wound on each of these supporting rotating bodies affects the relationship between the movement speed of said belt and the rotational angular speed of each of these supporting rotating bodies is different, so that the fluctuation of the movement speed of said belt that is generated by the fluctuation in the belt thickness in the circumferential direction of said belt is reduced.

17. The belt driving control apparatus as claimed in claim 16, wherein said control means perform said driving control using approximate rotation fluctuation information which is determined with rotation fluctuation information for said two supporting rotating bodies respectively determined from rotation information for said two supporting rotating bodies detected at the same instant in time, being in the same phase.

18. The belt driving control apparatus as claimed in claim 17, further comprising fluctuation information storage means for storing rotation fluctuation information for a time period corresponding to the time required for said belt to complete one revolution.

19. The belt driving control apparatus as claimed in claim 18, wherein said control means perform processing that again determines said rotation fluctuation information at a timing at which the difference between the rotation fluctuation information stored in said fluctuation information storage means and the newly determined rotation fluctuation information exceeds the permissible range.

20. The belt driving control apparatus as claimed in claim 17, wherein said control means perform processing that again determines said rotation fluctuation information at a specified timing.

21. The belt driving control apparatus as claimed in claim 17, wherein said control means perform said driving control while performing processing that determines said rotation fluctuation information.

22. The belt driving control apparatus as claimed in claim 17, further comprising past information storage means for storing past rotation fluctuation information for at least one revolution of the belt, wherein said control means perform said driving control using information obtained from the past rotation fluctuation information stored in said past information storage means and newly determined rotation fluctuation information.

23. The belt driving control apparatus as claimed in claim 16, wherein said control means perform processing so that the value of one of two sets of rotation fluctuation information of different phases contained in one or both sets of rotation information for said two supporting rotating bodies is reduced, and performs said driving control using the results of this processing.

24. The belt driving control apparatus as claimed in claim 23, wherein said processing comprises processing for adding information obtained by giving a delay time constituting a belt passage time required for the belt to move through the distance between said two supporting rotating bodies on a belt movement path and the gain based on said degree for said two supporting rotating bodies, to the two sets of rotation fluctuation information of different phases contained in the rotation information for one or both of said two supporting rotating bodies, and processing in which processing for further performing said addition processing for said processing result is repeated n ($n \geqq 1$) times, a gain obtained by multiplying the gain G in the first addition processing by $2^{n-1}$ being used as said gain in the nth addition processing, and a time obtained by multiplying said belt passage time by $2^{n-1}$ being used as said delay time in the nth addition processing.

25. The belt driving control apparatus as claimed in claim 23, wherein in said processing, information obtained by giving the delay time constituting the belt passage time required for the belt to move through the distance between said two supporting rotating bodies on the belt movement path and the gain based on said degree for said two supporting rotating bodies to the two sets of rotation fluctuation information of different phases contained in the rotation information for one or both of said two supporting rotating bodies is taken as output information, and processing for feeding back said output information and adding this output information to said two sets of rotation fluctuation information is performed.

26. The belt driving control apparatus as claimed in claim 23, further comprising fluctuation information storage means for storing rotation fluctuation information for a time period corresponding to the time required for said belt to complete one revolution.

27. The belt driving control apparatus as claimed in claim 26, wherein said control means perform processing that again determines said rotation fluctuation information at a timing at which the difference between the rotation fluctuation information stored in said fluctuation information storage means and the newly determined rotation fluctuation information exceeds the permissible range.

28. The belt driving control apparatus as claimed in claim 23, wherein said control means perform processing that again determines said rotation fluctuation information at a specified timing.

29. The belt driving control apparatus as claimed in claim 23, wherein said control means perform said driving control while performing processing that determines said rotation fluctuation information.

30. The belt driving control apparatus as claimed in claim 23, further comprising past information storage means for storing past rotation fluctuation information for at least one revolution of the belt, wherein said control means perform said driving control using information obtained from the past rotation fluctuation information stored in said past information storage means and newly determined rotation fluctuation information.

31. A belt apparatus comprising:

a belt which is installed on a plurality of supporting rotating bodies including driven rotating supporting bodies which rotate in connection with the movement of the belt, and driving supporting rotating bodies that transmit a driving force to said belt;

a driving source which generates a rotational driving force for driving said belt;

belt driving control means for performing driving control of said belt; and detection means for detecting at least one of the rotational angular displacement and rotational angular speed in two supporting rotating bodies among said plurality of supporting rotating bodies which have different diameters, or in which the degree to which the thickness or pitch line distance of the portion of the belt that is wound on each of these supporting rotating bodies affects the relationship between the movement speed of said belt and the rotational angular speed of each of these supporting rotating bodies is different;

said belt driving control means comprising control means for performing said driving control on the basis of rotation information relating to said rotational angular displacement or rotational angular speed detected by said detection means so that the fluctuation in the movement speed of said belt that is generated by the fluctuation in said pitch line distance or said belt thickness in the circumferential direction of said belt is reduced.

32. The belt apparatus as claimed in claim 31, wherein said two supporting rotating bodies are both driven supporting rotating bodies that rotate in connection with the movement of said belt.

33. The belt apparatus as claimed in claim 32, wherein said driving source comprises feedback control means for detecting the rotational angular displacement or rotational angular speed of said driving source, and for feeding back said rotational angular displacement or rotational angular speed.

34. The belt apparatus as claimed in claim 31, wherein said driving supporting rotating bodies are included in said two supporting rotating bodies.

35. The belt apparatus as claimed in claim 31, further comprising mark detection means for detecting marks indicating a reference position on said belt so as to grasp a reference belt movement position of said belt, wherein the control means of a belt driving control apparatus acquire rotation fluctuation information and perform said driving control with the detection timing of said mark detection means as a reference.

36. The belt apparatus as claimed in claim 31, wherein the control means of said belt driving control apparatus perform said driving control while grasping relationship information between the pitch line distance fluctuation and the belt movement position on the basis of a mean time required for said belt to complete one revolution, which is grasped beforehand, or a belt period length which is grasped beforehand.

37. The belt apparatus as claimed in claim 31, wherein the distance between said two supporting rotating bodies in the circumferential direction of the belt is set so that the error generated by said approximation is within a predetermined permissible range.

38. The belt apparatus as claimed in claim 31, wherein said belt has a joint seam in at least one place in the circumferential direction of the belt.

39. The belt apparatus as claimed in claim 31, wherein said belt has a plurality of layers in the thickness direction of the belt.

40. The belt apparatus as claimed in claim 31, wherein at least one of said plurality of supporting rotating bodies has a plurality of teeth in the direction of rotation, and said belt has an engaging part that engages with said plurality of teeth.

41. An image forming apparatus comprising:

a latent image carrying body comprising a belt that is installed on a plurality of supporting rotating bodies;

latent image forming means for forming a latent image on said latent image carrying body;

developing means for developing the latent image on said latent image carrying body;

transfer means for transferring a sensible image on said latent image carrying body onto a recording material; and a belt apparatus that drives said latent image carrying body;

said belt apparatus comprising a belt which is installed on a plurality of supporting rotating bodies including driven rotating supporting bodies which rotate in connection with the movement of the belt, and driving supporting rotating bodies that transmit a driving force to said belt, a driving source which generates a rotational driving force for driving said belt, belt driving control means for performing driving control of said belt; and detection means for detecting at least one of the rotational angular displacement and rotational angular speed in two supporting rotating bodies among said plurality of supporting rotating bodies which have different diameters, or in which the degree to which the thickness or pitch line distance of the portion of the belt that is wound on each of these supporting rotating bodies affects the relationship between the movement speed of said belt and the rotational angular speed of each of these supporting rotating bodies is different, wherein said belt driving control means comprises control means for performing said driving control on the basis of rotation information relating to said rotational angular displacement or rotational angular speed detected by said detection means so that the fluctuation in the movement speed of said belt that is generated by the fluctuation in said pitch line distance or said belt thickness in the circumferential direction of said belt is reduced.

42. The belt apparatus as claimed in claim 41, wherein said two supporting rotating bodies are both driven supporting rotating bodies that rotate in connection with the movement of said belt.

43. The belt apparatus as claimed in claim 42, wherein said driving source comprises feedback control means for detecting the rotational angular displacement or rotational angular speed of said driving source, and for feeding back said rotational angular displacement or rotational angular speed.

44. The belt apparatus as claimed in claim 41, wherein said driving supporting rotating bodies are included in said two supporting rotating bodies.

45. The belt apparatus as claimed in claim 41, further comprising mark detection means for detecting marks indicating a reference position on said belt so as to grasp a reference belt movement position of said belt, wherein the control means of said belt driving control apparatus acquire said rotation fluctuation information and perform said driving control with the detection timing of said mark detection means as a reference.

46. The belt apparatus as claimed in claim 41, wherein the control means of said belt driving control apparatus perform said driving control while grasping relationship information between the pitch line distance fluctuation and the belt movement position on the basis of the mean time required for said belt to complete one revolution, which is grasped beforehand, or the belt period length which is grasped beforehand.

47. The belt apparatus as claimed in claim 41, wherein the distance between said two supporting rotating bodies in the circumferential direction of the belt is set so that the error generated by said approximation is within a predetermined permissible range.

48. The belt apparatus as claimed in claim 41, wherein said belt has a joint seam in at least one place in the circumferential direction of the belt.

49. The belt apparatus as claimed in claim 41, wherein said belt has a plurality of layers in the thickness direction of the belt.

50. The belt apparatus as claimed in claim 41, wherein at least one of said plurality of supporting rotating bodies has a plurality of teeth in the direction of rotation, and said belt has an engaging part that engages with said plurality of teeth.

51. An image forming apparatus comprising:

a latent image carrying body;

latent image forming means for forming a latent image on said latent image carrying body;

developing means for developing the latent image on said latent image carrying body;

an intermediate transfer body comprising a belt which is installed on a plurality of supporting rotating bodies;

first transfer means for transferring a sensible image on said latent image carrying body onto said intermediate transfer body;

second transfer means for transferring the sensible image on said intermediate transfer body onto a recording material; and a belt apparatus that drives said intermediate transfer body;

said belt apparatus comprising a belt which is installed on a plurality of supporting rotating bodies including driven rotating supporting bodies which rotate in connection with the movement of the belt, and driving supporting rotating bodies that transmit a driving force to said belt, a driving source which generates a rotational driving force for driving said belt, belt driving control means for performing driving control of said belt; and detection means for detecting at least one of the rotational angular displacement and rotational angular speed in two supporting rotating bodies among said plurality of supporting rotating bodies which have different diameters, or in which the degree to which the thickness or pitch line distance of the portion of the belt that is wound on each of these supporting rotating bodies affects the relationship between the movement speed of said belt and the rotational angular speed of each of these supporting rotating bodies is different, wherein said belt driving control means comprises control means for performing said driving control on the basis of rotation information relating to said rotational angular displacement or rotational angular speed detected by said detection means so that the fluctuation in the movement speed of said belt that is generated by the fluctuation in said pitch line distance or said belt thickness in the circumferential direction of said belt is reduced.

52. The belt apparatus as claimed in claim 51, wherein said two supporting rotating bodies are both driven supporting rotating bodies that rotate in connection with the movement of said belt.

53. The belt apparatus as claimed in claim 52, wherein said driving source comprises feedback control means for detecting the rotational angular displacement or rotational angular speed of said driving source, and for feeding back said rotational angular displacement or rotational angular speed.

54. The belt apparatus as claimed in claim 51, wherein said driving supporting rotating bodies are included in said two supporting rotating bodies.

55. The belt apparatus as claimed in claim 51, further comprising mark detection means for detecting marks indicating a reference position on said belt so as to grasp a reference belt movement position of said belt, wherein the control means of said belt driving control apparatus acquire said rotation fluctuation information and perform said driving control with the detection timing of said mark detection means as a reference.

56. The belt apparatus as claimed in claim 51, wherein the control means of said belt driving control apparatus perform said driving control while grasping relationship information between the pitch line distance fluctuation and the belt movement position on the basis of a mean time required for said belt to complete one revolution, which is grasped beforehand, or a belt period length which is grasped beforehand.

57. The belt apparatus as claimed in claim 51, wherein the distance between said two supporting rotating bodies in the circumferential direction of the belt is set so that the error generated by an approximation is within a predetermined permissible range.

58. The belt apparatus as claimed in claim 51, wherein said belt has a joint seam in at least one place in the circumferential direction of the belt.

59. The belt apparatus as claimed in claim 51, wherein said belt has a plurality of layers in a thickness direction of the belt.

60. The belt apparatus as claimed in claim 51, wherein at least one of said plurality of supporting rotating bodies has a plurality of teeth in the direction of rotation, and said belt has an engaging part that engages with said plurality of teeth.

61. An image forming apparatus comprising:

a latent image carrying body;

latent image forming means for forming a latent image on said latent image carrying body;

developing means for developing the latent image on said latent image carrying body;

a recording material conveying member comprising a belt which is installed on a plurality of supporting rotating bodies;

transfer means for transferring a sensible image on said latent image carrying body onto a recording material conveyed by said recording material conveying member, either via an intermediate transfer body or directly without an intermediate transfer body; and a belt apparatus that drives said recording material conveying member;

said belt apparatus comprising a belt which is installed on a plurality of supporting rotating bodies including driven rotating supporting bodies which rotate in connection with the movement of the belt, and driving supporting rotating bodies that transmit a driving force to said belt, a driving source which generates a rotational driving force for driving said belt, belt driving control means for performing driving control of said belt; and detection means for detecting at least one of the rotational angular displacement and rotational angular speed in two supporting rotating bodies among said plurality of supporting rotating bodies which have different diameters, or in which the degree to which the thickness or pitch line distance of the portion of the belt that is wound on each of these supporting rotating bodies affects the relationship between the movement speed of said belt and the rotational angular speed of each of these supporting rotating bodies is different, wherein said belt driving control means comprises control means for performing said driving control on the basis of rotation information relating to said rotational angular displacement or rotational angular speed detected by said detection means so that the fluctuation in the movement speed of said belt that is generated by the fluctuation in said pitch line distance or said belt thickness in the circumferential direction of said belt is reduced.

62. The belt apparatus as claimed in claim 61, wherein said two supporting rotating bodies are both driven supporting rotating bodies that rotate in connection with the movement of said belt.

63. The belt apparatus as claimed in claim 62, wherein said driving source comprises feedback control means for detecting the rotational angular displacement or rotational angular speed of said driving source, and for feeding back said rotational angular displacement or rotational angular speed.

64. The belt apparatus as claimed in claim 62, wherein said driving supporting rotating bodies are included in said two supporting rotating bodies.

65. The belt apparatus as claimed in claim 61, further comprising mark detection means for detecting marks indicating a reference position on said belt so as to grasp a reference belt movement position of said belt, wherein the control means of said belt driving control apparatus acquire said rotation fluctuation information and perform said driving control with the detection timing of said mark detection means as a reference.

66. The belt apparatus as claimed in claim 61, wherein the control means of said belt driving control apparatus perform said driving control while grasping relationship information between the pitch line distance fluctuation and the belt movement position on the basis of a mean time required for said belt to complete one revolution, which is grasped beforehand, or a belt period length which is grasped beforehand.

67. The belt apparatus as claimed in claim 61, wherein the distance between said two supporting rotating bodies in the circumferential direction of the belt is set so that the error generated by an approximation is within a predetermined permissible range.

68. The belt apparatus as claimed in claim 61, wherein said belt has a joint seam in at least one place in the circumferential direction of the belt.

69. The belt apparatus as claimed in claim 61, wherein said belt has a plurality of layers in a thickness direction of the belt.

70. The belt apparatus as claimed in claim 61, wherein at least one of said plurality of supporting rotating bodies has a plurality of teeth in the direction of rotation, and said belt has an engaging part that engages with said plurality of teeth.

* * * * *